US005427896A

United States Patent [19]

Hayashi

[11] Patent Number: 5,427,896

[45] Date of Patent: Jun. 27, 1995

[54] METHOD FOR PROCESSING COLOR PHOTOGRAPHIC MATERIAL

[75] Inventor: Hiroshi Hayashi, Kanagawa, Japan

[73] Assignee: Fuji Photo Film Co., Ltd., Japan

[21] Appl. No.: 16,916

[22] Filed: Feb. 12, 1993

[30] Foreign Application Priority Data

Feb. 14, 1992 [JP] Japan ..... 4-059124

[51] Int. Cl.[6] ..... G03C 11/00

[52] U.S. Cl. ..... 430/372; 430/384; 430/385; 430/393; 430/428; 430/455; 430/460; 430/558

[58] Field of Search ..... 430/558, 384, 385, 372, 430/393, 455, 460, 428

[56] References Cited

U.S. PATENT DOCUMENTS

| | | | |
|---|---|---|---|
| H,953 | 8/1991 | Goto et al. | 430/393 |
| 4,524,129 | 6/1985 | Kishimoto et al. | 430/393 |
| 4,908,300 | 3/1990 | Koboshi et al. | 430/460 |
| 5,256,526 | 10/1993 | Suzuki et al. | 430/384 |
| 5,270,153 | 12/1993 | Suzuki et al. | 430/384 |

FOREIGN PATENT DOCUMENTS

| | | |
|---|---|---|
| 0342637 | 11/1989 | European Pat. Off. . |
| 0431568 | 6/1991 | European Pat. Off. . |
| 0488248 | 6/1992 | European Pat. Off. . |
| 0491197 | 6/1992 | European Pat. Off. . |
| 0500045 | 8/1992 | European Pat. Off. . |
| 2361639 | 11/1989 | Japan . |
| 9108517 | 6/1991 | WIPO . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A method for processing a color photographic material comprising a support having on at least one surface thereof at least one layer containing a light-sensitive silver halide emulsion and a non-diffusing oil-soluble coupler capable of forming a dye by coupling with the oxidation product of an aromatic primary amine developing agent, wherein the oil-soluble dye is a pyrrolotriazole cyan coupler and the color photographic material is processed after color development with a bath containing, as a fixing agent, at least one of nitrogen-containing heterocyclic compounds having a sulfide group, meso-ionic compounds and thioether compounds.

13 Claims, 2 Drawing Sheets

METHOD FOR PROCESSING COLOR PHOTOGRAPHIC MATERIAL

FIELD OF THE INVENTION

This invention relates to a method for processing a color photographic material, and more particularly to a method for processing a color photographic material which has excellent processing solution stability and color reproducibility, where stain scarcely occurs and an image of good quality is obtained.

BACKGROUND OF THE INVENTION

A color image forming method which is most widely used in the field of silver halide color photographic materials includes a method wherein exposed silver halide is allowed to function as an oxidizing agent, and oxidized aromatic primary amine color developing agents react with couplers to form indophenol, indoaniline, indamine, azomethine, phenoxazine, phenazine and analogous dyes. In this system, a method is used wherein a color image is reproduced by subtractive color photography. Generally, a color image is formed by changing the amounts of dyes formed by the three yellow, magenta and cyan colors.

Generally, phenol or naphthol cyan couplers are used to form a cyan dye image. However, since these couplers have undesired absorption in green light region and the blue light region, they have a serious problem in that particularly blue and green color reproducibility is greatly lowered. Accordingly, a solution to this problem is required.

EP 249,453A2 has proposed 2,4-diphenylimidazole cyan couplers to solve this problem. Dyes formed from these couplers show a reduction in undesired absorption in the green light and blue light regions in comparison with conventional dyes and certainly have improved in color reproducibility. However, these couplers are not considered to be fully satisfactory with respect to color reproducibility, and a further improvement is required. In addition, these couplers have serious problems in that the reactivity of these couplers with oxidized developing agents, that is, the coupling activity of these couplers is low, and the fastness of dyes formed to heat and light is quit low. Accordingly, these couplers can not be put to practical use.

JP-A-64-552 (the terms "JP-A" as used herein means an "unexamined published Japanese patent application"), JP-A-64-553, JP-A-64-554, JP-A-64-555, JP-A-64-556 and JP-A-64-557 disclose pyrazoloazole cyan couplers. These couplers show a reduction of undesirable absorption in the green and blue regions in comparison with conventional dyes. However, these couplers have problems in that the color reproducibility is not sufficient and color developability is quite low.

Couplers having a 1H-pyrrolo[1,2-b][1,2,4]triazole mother nucleus are disclosed in a paper (pages 108 to 110) comprising the substance of a lecture at the annual meeting (held May 23 and 24, 1985) of the Photographic Society of Japan, JP-A-62-279340 and JP-A-62-278552. These couplers are known as magenta couplers. The absorption spectra of the dyes, of these pyrrolotriazole couplers described in this 1985 paper of Photographic Society of Japan are slightly broader than those of dyes from well known pyrrolotriazole magenta couplers, and these couplers are not considered to have satisfactory hue as magenta couplers.

Further, JP-A-62-291646 and JP-A-63-32548 disclose couplers with a pyrrolotriazole mother nucleus. However, these couplers are clearly described as magenta couplers, and all of compounds exemplified therein are limited to couplers which form magenta dyes.

Generally, the processing of silver halide color photographic materials comprises a color development stage and a desilvering stage. In the desilvering stage, developed silver formed in the color development stage is oxidized by a bleaching agent having an oxidation effect to form a silver salt (bleaching). The silver salt together with unused silver halide is converted into a soluble silver salt by a fixing agent and is removed from light-sensitive layers (fixing).

Iron(III) ion complex salts (e.g., iron(Ill) complex salts of aminopolycarboxylic acids) are mainly used as bleaching agents, and thiosulfates are usually used as fixing agents.

In one embodiment, bleaching and fixing are separately carried out in a bleaching stage and in a fixing stage, respectively. In another embodiment, bleaching and fixing are simultaneously carried out as a bleaching-fixing stage. The details of these processing stages are described in James, *The Theory of Photographic Process*, 4th Edition (1977).

Generally, the above-described processing stages are carried out in automatic processors. Particularly, small-size automatic processors comprising miniature laboratories have been provided in shops in recent years, and rapid attention to customers has spread. Since the processors are miniaturized and rapid processing is required, the bleaching agents and the fixing agents are used in the same bath as a bleaching-fixing bath in the processing of color paper.

Rapid processing in the processing stages and easy maintenance have been highly demanded in recent years. High speed-up and the improvement of the stability of processing solutions in the bleaching-fixing stage have been demanded. Further, processing is carried out at various places, and hence a problem in the disposal of waste water in processing has become serious.

Iron(III) complex salts of ethylenediaminetetraacetic acid have been conventionally used in the bleaching stage. In addition thereto, potassium ferricyanide and iron chloride are conventionally known as bleaching agents which have a strong oxidizing power and are capable of achieving rapid bleaching. However, potassium ferricyanide is not widely used form the standpoint of the preservation of environment, and iron chloride can not be widely used from the standpoint of its inconvenience in handling due to metal corrosion. Iron(III) complex salts of 1,3-diaminopropanetetraacetic acid have been proposed as general-purpose bleaching agents with a rapid bleaching effect in recent years. However, when the complex salts are used, bleach fog tends to occur. Hence these complex salts are not considered to be satisfactory bleaching agents.

Thiosulfates used as fixing agents are deteriorated by oxidation and form sulfide precipitates. Accordingly, sulfites are generally added as preservatives to prevent oxidation of thiosulfates. A further improvement in the stability of the processing solutions used is required as replenishment rate is reduced However, when the amounts of the sulfites are increased, a problem with regard to solubility is arises. When the sulfites are oxidized, the precipitate of sodium sulfate is formed. Accordingly, these problems can not be solved. These problems become even more serious with a reduction in the pH of the processing solutions. Further, from the viewpoint of rapid processing it is required that there are developed compounds which are superior in fixing properties to thiosulfates.

When a rapid bleaching-fixing operation is carried out after rapid color development, developing agents, sensitizing dyes and dyes contained in the light-sensitive materials can not be sufficiently removed and stain is formed on images after processing, even though the developing agents, the sensitizing dyes and dyes can be removed in conventional bleaching-fixing stage.

Accordingly, it has been highly desired to develop a fixing agent and a bleaching agent which do not have the above-described problems and to provide a processing composition containing the same and a processing method using the same.

To solve these problems, Japanese Patent Application No. 3-255889 discloses that when a bleaching-fixing solution containing at least one compound selected from the group consisting of nitrogen-containing heterocyclic compounds having a sulfide group, meso-ionic compounds and thioether compounds as fixing agents having excellent stability against oxidation is used in place of thiosulfates, the solution is stable against oxidation, no precipitate is formed when the replenishment rate is low, bleach fog is small in comparison with thiosulfates, and good results can be obtained particularly when bleaching-fixing agents are used in combination with strong oxidizing agents.

When light-sensitive materials containing the above described 1H-pyrrolo[1,2-b][1,2,4]triazote couplers are processed with processing solutions containing thiosulfates as the fixing agents, color reproducibility (color turbidity) can be greatly improved in comparison with the prior art. However, it has been found that when the finished prints are stored under high temperature conditions or under high temperature and humidity conditions, yellow color staining is noticeable because color turbidity is improved, and color reproduction in the low density area is deteriorated. Particularly, in the system wherein rapid processing is contemplated and the replenishment rate of the processing solution is lowered, materials with concerns that colored materials will be formed may be left behind, such materials have a large effect, and stain is markedly formed on images when the processing time is shortened. An adverse effect thereof is observed.

Further, light-sensitive materials are distributed to miniature laboratories and processed there. Where leisurely processing is conducted, it has been found that the fixing agents and silver salts are deposited on light-sensitive material-conveying rollers during the course of leisurely processing. The term "leisurely processing" as used herein refers to the following situations.

(1) The amount of light-sensitive materials processed per day is small, or the processing time is short.

(2) The amount of light-sensitive materials processed per unit time during operation is small.

(3) The interval of time between operations is long. For example, the processing time required for one operation is short (the amount of the material to be processed is small), but the down time is long, or even when working time is long, the down time -until the subsequent operation is long.

When the fixing agents or the silver salts are deposited on the conveying rollers during leisurely processing, the deposits are transferred onto the light-sensitive materials, whereby the light-sensitive materials are stained. Accordingly, the conveying rollers must be frequently cleaned.

SUMMARY OF THE INVENTION

An object of the present invention is to provide a method for processing a photographic material which can solve the above-described problems.

Another object of the present invention is to provide a photographic material which is free from the above-described problems, has excellent color reproducibility (color turbidity being low), can prevent stain from being formed and enables ultra-rapid processing to be carried out and, moreover, which does not stain the light-sensitive material-conveying rollers.

The above-described objects of the present invention have been achieved by the following processing methods (1) to (3).

(1) A method for processing an imagewise exposed color photographic material comprising a support having on at least one side thereof at least one layer containing a light-sensitive silver halide emulsion and at least one non-diffusing oil-soluble coupler capable of forming a dye by the coupling reaction thereof with the oxidation product of an aromatic primary amine developing agent, wherein the color photographic material contains at least one member selected from the group consisting of cyan couplers represented by the following general formulas (I) and (II) as the oil-soluble coupler:

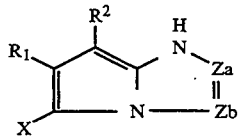

(I)

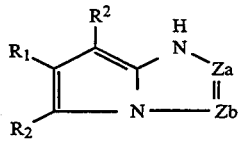

(II)

wherein Za and Zb each represents —C($R_3$)= or —N= provided that one of Za and Zb is —N= and the other is —C($R_3$)=; $R_1$ and $R_2$ each represents an electron attracting group (electrophilic group) having a Hammett's substituent constant $\sigma_p$ value of at least 0.20 and the sum of $\sigma_p$ value of $R_1$ and $R_2$ is at least 0.65; $R_3$ represents a hydrogen atom or a substituent group; and X represents a hydrogen atom or a group which is eliminated by the coupling reaction with the oxidation product of an aromatic primary amine color developing agent; or $R_1$, $R_2$, $R_3$ or X may be a bivalent group and the coupler may be in the form of a dimer or a higher polymer through the bivalent group or may form a homopolymer or a copolymer wherein the compound is bonded to a high-molecular weight chain;

where the method comprises color developing the photographic material and then processing the photographic material with a bath having a fixing ability and containing at least one compound, as a fixing agent, selected from the group consisting of nitrogen-containing heterocyclic compounds having a sulfide group, meso-ionic compounds and thioether compounds after color developing.

(2) A method for processing a color photographic material as described in the (1) above, wherein the silver halide emulsion comprises light-sensitive silver halide grains having a silver chloride content of 90 mol % or higher.

(3) A method for processing a color photographic material as described in (1) or (2) above, wherein the processing time of the photographic material is 120 seconds or less from the commencement of development until completion of the drying stage.

DETAILED DESCRIPTION OF THE INVENTION

Figure 1:
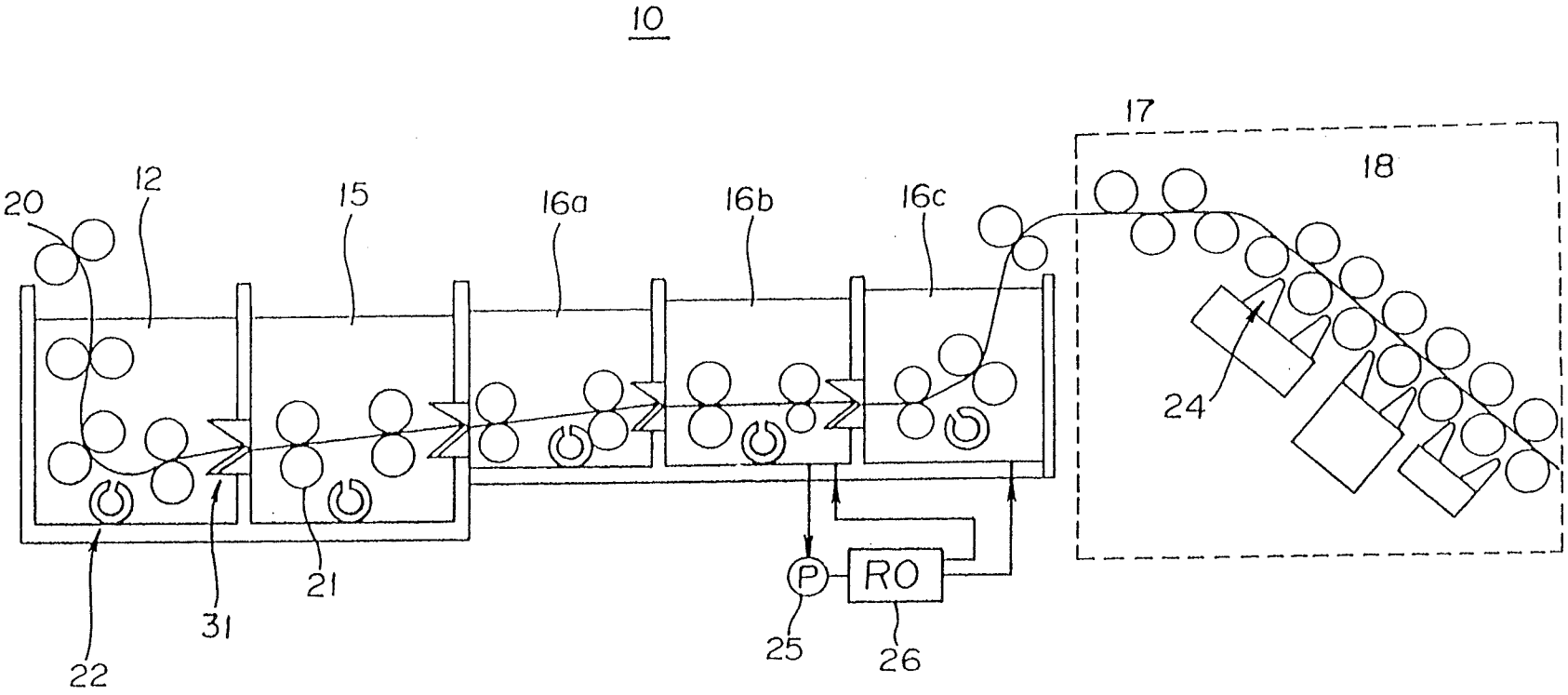
FIG. 1 shows schematically one embodiment of a processor suitable for use in carrying out the processing method of the present invention.

The present invention is illustrated in more detail below.

First, the cyan couplers of general formula (I) or (II) which can be used as oil-soluble couplers present in color photographic materials to be processed according to the present invention are illustrated below.

In general formula (I) or (II), Za and Zb each represents —C($R_3$)= or —N=, provided that one of Za and Zb is —N= and the other is —C($R_3$)=.

Namely, the cyan couplers of the present invention can be specifically represented by the following general formulas (I-a), (I-b), (II-a) and (II-b).

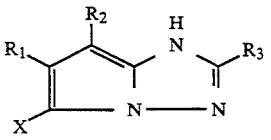
(I-a)

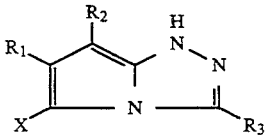
(I-b)

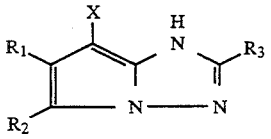
(II-a)

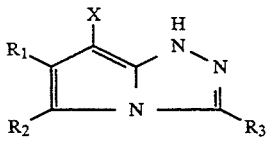
(II-b)

wherein $R_1$, $R_2$, $R_3$ and X are as defined above in general formulas (I) and (II).

$R_3$ represents a hydrogen atom or a substituent. Examples of the substituent include a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group and an azolyl group. These groups may be further substituted by one or more substituents.

More specifically, $R_3$ represents a hydrogen atom, a halogen atom (e.g., chlorine, bromine), an alkyl group (e.g., a straight-chain or branched alkyl group having 1 to 32 carbon atoms, an aralkyl group, an alkenyl group, an alkynyl group, a cycloalkyl group, a cycloalkenyl group, more specifically, methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, 3-(2,4-di-t-aminophenoxy)propyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzthiazolyl), a cyano group, a hydroxyl group, a nitro group, a carboxyl group, an amino group, an alkoxy group (e.g., methoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoyl), an acylamino group (e.g., acetamido, benzamido, tetradecaneamido, 2-(2,4-di-t-aminophenoxy)-butaneamido, 4-(3-t-butyl-4-hydroxyphenoxy)-butaneamido, 2-{4-(4-hydroxyphenylsulfonyl)phenoxy}decaneamido), an alkylamino group (e.g., methylamino, butylamino, dodecylamino, diethylamino, methylbutylamino), an anilino group (e.g., phenylamino, 2-chloroanilino, 2-chloro-5-tetradecaneaminoanilino, 2-chloro-5-dodecyloxycarbonylanilino, N-acetylanilino, 2-chloro-5-{2-(3-t-butyl-4-hydroxyphenoxy)dodecaneamido}-anilino), a ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methoxy-5-t-butylbenzenesulfonamido), a carbamoyl group (e.g., N-ethylcarbamoyl, N,N-dibutylcarbamoyl, N-(2-dodecyloxyethyi)carbamoyl, N-methyl-N-dodecylcarbamoyl, N-(3-(2,4-di-tamylphenoxy)-propyl)carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethytsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g., 1-phenyltetrazole-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g., phenoxycarbonylamino), an imido group (e.g., N-succinimido, N-phthalimido, 3-octadecenylsuccinimido), a heterocyclic thio group (e.g., 2-benzthiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl) or an azolyl group (e.g., imidazolyl, pyrazolyl, 3-chloropyrazole-1-yl, triazolyl).

Preferably, $R_3$ is an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group or an azolyl group.

More preferably, $R_3$ is an alkyl group or an aryl group. An alkyl group having at least one substituent and an aryl group having at least one substituent are preferred from the viewpoint of cohesiveness. Still more preferably, $R_3$ is an alkyl group or an aryl group, each group having at least one substituent selected from the group consisting of an alkoxy group, a sulfonyl group, a sulfamoyl group, a carbamoyl group, an acylamido group and an sufonamide group. Particularly preferably, $R_3$ is an alkyl group or an aryl group, each group being substituted by at least one of an acylamido group and a sulfonamido group. It is preferred that when the aryl group has one or more substituent groups, the substituent group is attached in at least the orthoposition.

In the cyan couplers used in the present invention, $R_1$ and $R_2$ are each an electron attracting group having a Hammett's substituent constant $\sigma_p$ value of at least 0.20, and when the sum of $\sigma_p$ values of $R_1$ and $R_2$ is at least 0.65, the couplers form a color to form a cyan color image. The sum of $\sigma_p$ values of $R_1$ and $R_2$ is preferably at least 0.70, and the upper limit thereof is about 1.8.

$R_1$ and $R_2$ are each an electron attracting group having a Hammett's substituent constant $\sigma_p$ value of at least 0.20, preferably at least 0.30. The upper limit of each group is 1.0 or below, Hammett's rule is an empirical rule proposed by L. P. Hammet in 1935 to discuss quantitatively the effect of substituent on the reaction or equilibrium of benzene derivatives. The propriety of the rule is widely recognized at present.

There are two substituent constants determined by Hammett's rule. Namely, there are $\sigma_p$ value and $\sigma_m$ value. These values are described widely in the literature. For example, these substituent constants are fully described in J. A. Dean, *Lange's Handbook of Chemistry*, 12nd Edition (1979) (McGraw Hill) and *Area of Chemistry*, a special issue, No. 122, pp. 96≈103 (1979) (published by Nankoudo). In the present invention, $R_1$ and $R_2$ are defined by Hammett's substituent constant $\sigma_p$ value. However, this means that substituent groups are not limited to those which are already described in the literature and whose substituent constant values are known from the literature. Even when the values are not known from the literature, the values are included within the range thereof, so long as the values are measured on the basis of Hammett's rule.

Examples of suitable electron attracting groups having a $\sigma_p$ value of at least 0.20 represented by $R_1$ and $R_2$ include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkytsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted by other electrophilic group having a $\sigma_p$ value of at least 0.20, a heterocyclic group, a halogen atom, an azo group and a selenocyanato group. These groups may be further substituted by one or more substituents. Examples of suitable substituents include those already described above in the definition of the substituent represented by $R_3$.

More specifically, examples of suitable electrophilic group having a $\sigma_p$ value of at least 0.20 represented by $R_1$ and $R_2$ include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, N-{3-(2,4-di-t-amylphenoxy)-propyl}carbamoyl), an alkoxycarbonyl group (e.g., methoxycarbonyl, ethoxycarbonyl, isopropyloxycarbonyl, tertbutyloxycarbonyl, isobutyloxycarbonyl, butyloxycarbonyl, dodecyloxycarbonyl, octadecyloxycarbonyl), an aryloxycarbonyl group (e.g., phenoxycarbonyl), cyano group, nitro group, a dialkylphosphono group (e.g., dimethylnitro a diarylphosphono group (e.g., diphenylphosphono), a diarylphosphinyl group (e.g., diphenylphosphono), phosphinyl), an alkylsulfinyl group (e.g., 3-phenoxydipropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-Ndodecylsulfamoyl, N,N-diethylsulfamoyl), a thiocyanate group, a thiocarbonyl group (e.g., methylthiocarbonyl, phenylthiocarbonyl), a halogenated alkyl group (e.g., trifluoromethyl, heptafluoropropyl), a halogenated alkoxy group (e.g., trifluoromethyloxy), a halogenated aryloxy group (e.g., pentafluorophenyloxy), a halogenated alkylamino group (e.g., N,N-di-(trifluoromethyl)amino), a halogenated alkylthio group (e.g., difluoromethylthio, 1,1,2,2-tetrafluoroethylthio), an aryl group substituted by other electron attracting group having a $\sigma_p$ value of at least 0.20 (e.g., 2,4-dinitrophenyl, 2,4,6-trichlorophenyl, pentachlorophenyl), a heterocyclic group (e.g., 2-benzoxazolyl, 2-benzthiazolyl, phenyl-2-benzimidazolyl, 5-chloro-1-tetrazolyl, 1-pyrrolyl), a halogen atom (e.g., chlorine, bromine), an azo group (e.g., phenylazo) and selenocyanate group. These groups may be further substituted by one or more substituents, so long as they can be substituted. Examples of suitable substituents include those already described above in the definition of the substituent group represented by $R_3$.

Preferably, $R_1$ and $R_2$ are each an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by at least two other electron attracting groups having a $\sigma_p$ value of at least 0.20 or a heterocyclic group. More preferably, $R_1$ and $R_2$ are each an acyl group, an alkoxycarbonyl group, a nitro group, a cyano group, an arylsulfonyl group, a carbamoyl group or a halogenated alkyl group.

Most preferably, $R_1$ is a cyano group. Particularly preferably, $R_2$ is an aryloxycarbonyl group or an alkoxycarbonyl group. Most preferably, $R_2$ is a branched alkoxycarbonyl group or an alkoxycarbonyl group having an electron attracting group.

X represents a hydrogen atom or an atom or group which is eliminated by the coupling reaction with the oxidation product of an aromatic primary amine color developing agent. Examples of eliminable atoms or groups represented by X include a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkylthio group, an arylthio group, a heterocyclic thio group, an alkyl or arylsulfinyl group, a carbamoylamino group, a five-membered or six-membered nitrogen containing heterocyclic group, an imido group and an arylazo group. These groups may be further substituted by one or more substituents. Examples of substituents include those already described above in the definition of the substituents represented by $R_3$.

More specifically, examples of eliminable atoms or groups represented by X include a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy 3-ethoxycarboxyphenoxy, 3-acetylaminophenoxy, 2-carboxyphenoxy), an acyloxy group (e.g., acetoxy, tetradecanoyloxy, benzoyloxy), an alkyl- or arylsulfonyloxy group (e.g., methanesulfonyloxy, toluenesulfonyloxy), an acylamino group (e.g., dichloroacetylamino, heptafluorobutyrylamino), an alkyl- or arylsulfonamido group (e.g., methanesulfonamido, trifluoromethanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, tetrazoylthio), an alkyl- or arylsulfinyl group (e.g., isopropylsulfinyl), a carbamoylamino group (e.g., N-methylcarbamoylamino, N-phenylcarbamoylamino), a five-membered or six-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an arylazo group (e.g., phenylazo, 4-methoxyphenylazo). In addition thereto, there is the case where the compound is in the form of a bis type coupler wherein X as an eliminable group is bonded to the coupler through a carbon atom formed by condensing the compound with a four equivalent type coupler in the presence of an aldehyde or a ketone. Further, X may include a photographically useful group such as a development inhibitor or a development accelerator.

Preferably, X is a halogen atom, an alkoxy group, an aryloxy group, an alkyl- or arylthio group, an alkyl- or arylsulfinyl group or a five-membered or six-membered nitrogen-containing heterocyclic group which is bonded to the coupling active site through a nitrogen atom. More preferably, X is a halogen atom, an alkyl- or arylthio group or an alkyl- or arylsulfinyl group. Particularly preferably, X is an arylthio group or an arylsulfinyl group.

In general formula (i) or (II), $R_1$, $R_2$, $R_3$ or X may be a bivalent group, and the cyan couplers may be in the form of a dimer or a higher polymer through the bivalent group, or in the form of a homopolymer or a copolymer wherein the compound is bonded to a high-molecular weight chain. Typical examples of homopolymers or the copolymers wherein the compound is bonded to a high-molecular weight chain include homopolymers and copolymers of addition polymer type ethylenically unsaturated compounds having a residue of a cyan coupler of the general formula (I) or (II). The polymer may have at least one member of cyan color forming repeating units having the residues of the cyan couplers of general formula (I) or (II), or the polymer may be a copolymer having one or more non-color forming ethylenic monomer units as a copolymer component. The cyan color forming repeating units having the residues of cyan couplers of general formula (I) or (II) which can be advantageously used, can be represented by the following general formula (P).

(P)

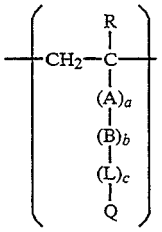

wherein R represents a hydrogen atom, an alkyl group having 1 to 4 carbon atoms or chlorine atom; A represents —CONH—, —COO— or a substituted or unsubstituted phenylene group; B represents a substituted or unsubstituted alkylene group, a substituted or- unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b and c each represents 0 or 1; and Q represents a cyan coupler residue formed by removing a hydrogen atom from $R_1$, $R_2$, $R_3$ or X of the compound of general formula (I) or (II).

Among the polymers, copolymers of cyan color forming monomers represented by coupler units of general formula (I) or (II) with non-color forming ethylenic monomers which do not couple with the oxidation products of aromatic primary amine developing agents are preferred.

Examples of non-color forming ethylenic monomers which do not couple with the oxidation products of the aromatic primary amine developing agents include acrylic acid, α-chloroacrylic acid, α-alkylacrylic acids (e.g., methacrylic acid), amides and esters derived from these acrylic acids (e.g., acrylamide, methacrylamide, n-butyl acrylamide, t-butyl acrylamide, diacetone acrylamide, methyl acrylate, etyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxymethyl methacrylate), vinyl esters (e.g., vinyl acetate, vinyl propionate, vinyl laurate) , acrylonitrile, methacrylonitrile, aromatic vinyl compounds (e.g., styrene and derivatives thereof such as vinyl toluene, divinylbenzene, vinyl acetophenone and sulfostyrene), itaconic acid, citraconic acid, crotonic acid, vinylidene chloride, vinyl alkyl ethers (e.g., vinyl ethyl ether), maleic esters, N-vinyl-2-pyrrolidone, N-vinylpyridine and 2- and 4-vinylpyridine.

Particularly preferred are acrylic esters, methacrylic esters and maleic esters. These non-color forming ing ethylenic monomers may be used as a combination of two or more thereof. For example, a combination of methyl acrylate and butyl acrylate, a combination of butyl acrylate and styrene, a combination of butyl methacrylate and methacrylic acid or a combination of methyl acrylate and diacetone acrylamide can be used.

The ethylenically unsaturated monomers to be copolymerized with the vinyl monomers corresponding to the compounds of general formula (I) or (II) are chosen so that the physical properties and/or chemical properties of the resulting copolymers provide good effects on solubility, compatibility thereof with a binder such as gelatin in photographic colloid compositions, flexibility, thermal stability, etc. as is well known to those skilled in the art.

It is preferred that the cyan couplers of the present invention are present in the red-sensitive silver halide emulsion layers of silver halide color photographic materials. Namely, a coupler-in-emulsion type system is preferred. Accordingly, it is preferred that at least one group of $R_1$, $R_2$, $R_3$ and X is a ballast group (preferably, the sum total of carbon atoms being at least 10). The sum total of carbon atoms is preferably 10 to 50.

In the present invention, the cyan couplers of general formula (I) are preferred from the standpoint of the effect of the present invention.

Typical examples of couplers of the present invention include, but are not limited to, the following compounds.

(C-1)

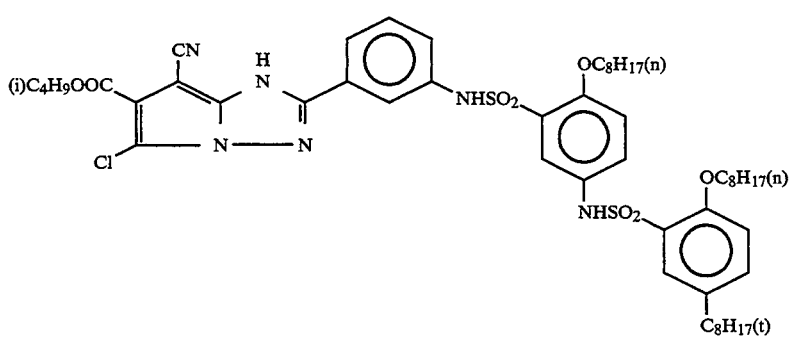

(C-2)

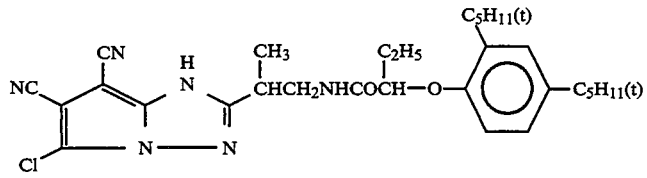

(C-3)

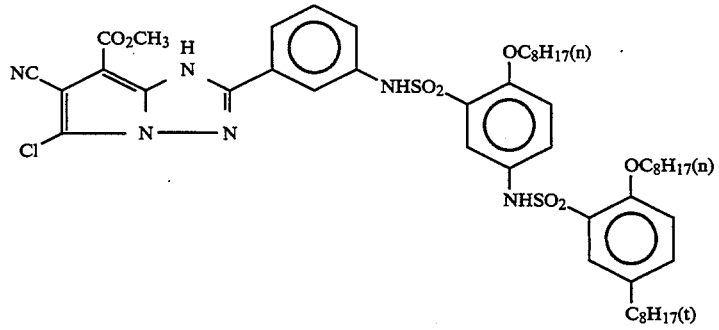

-continued
(C-4)
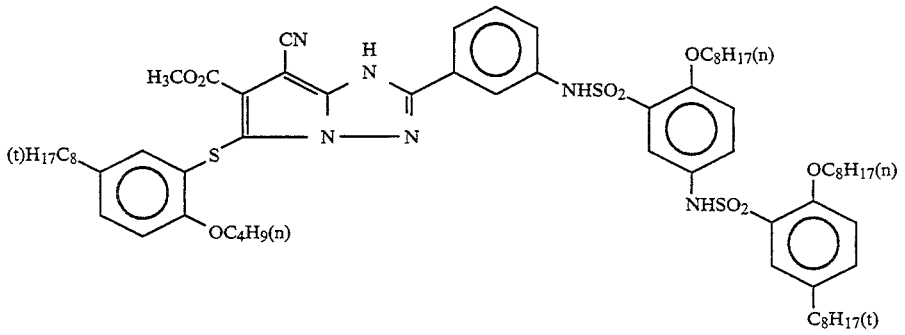
(C-5)
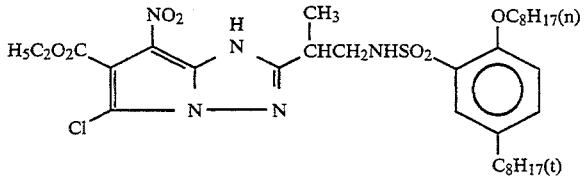
(C-6)
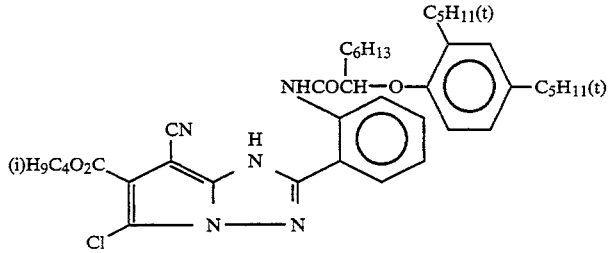
(C-7)
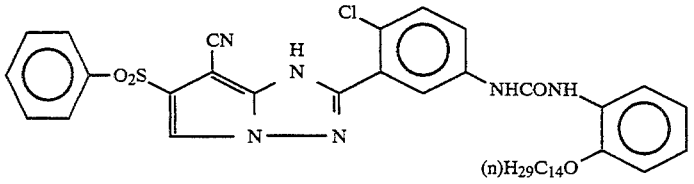
(C-8)
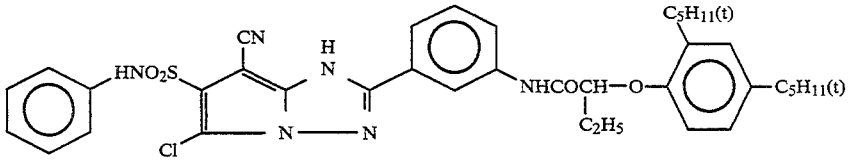
(C-9)
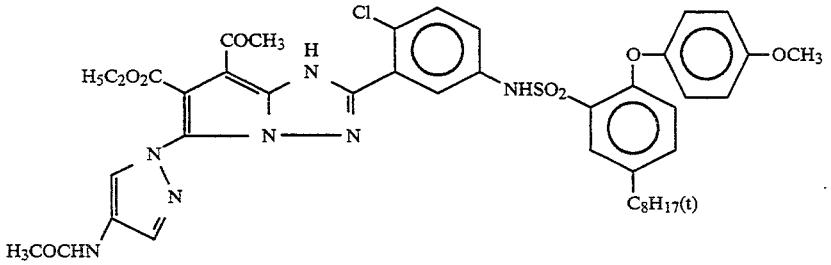
(C-10)
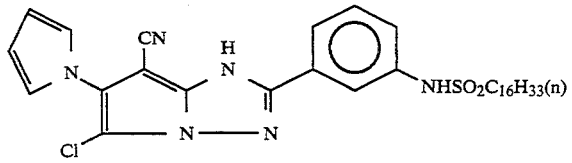

-continued
(C-11)
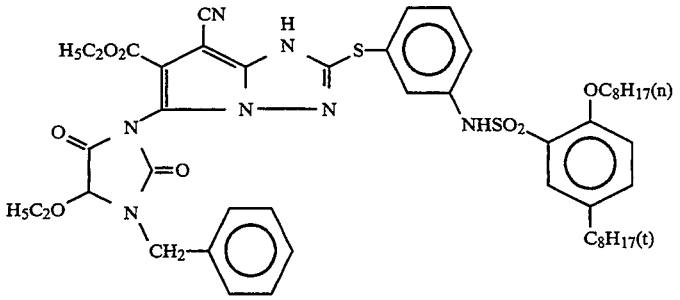
(C-12)
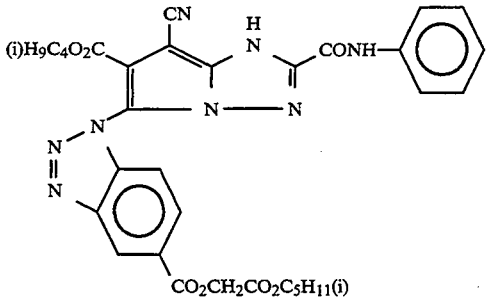
(C-13)
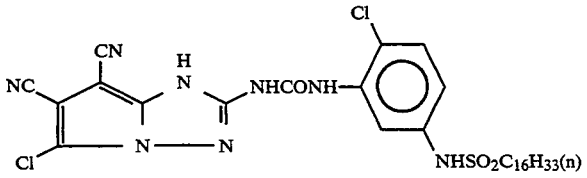
(C-14)
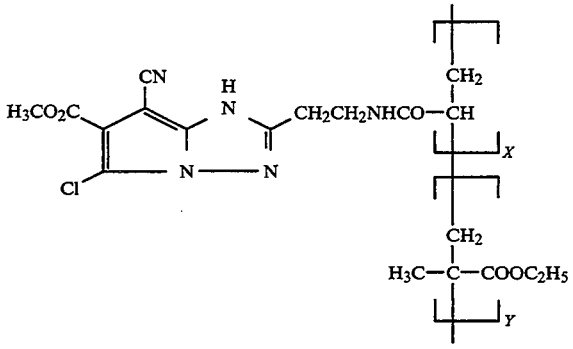
X:Y = 50:50
(C-15)
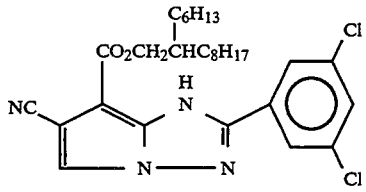

-continued
(C-16)
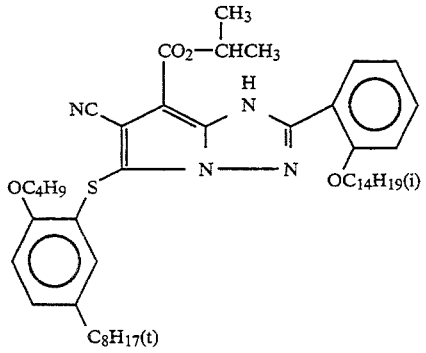
(C-17)
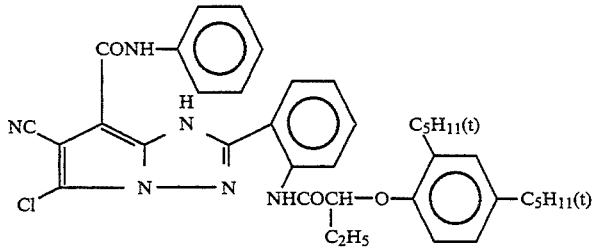
(C-18)
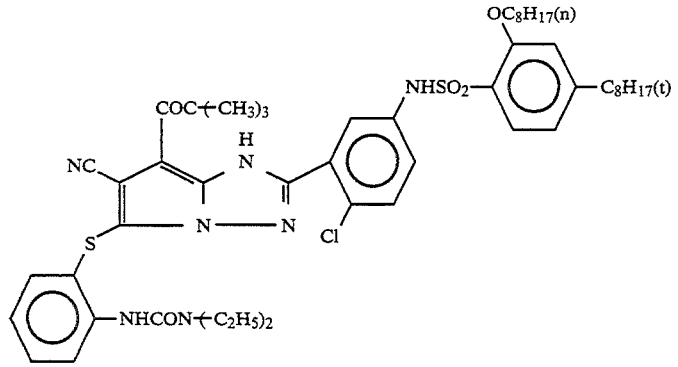
(C-19)
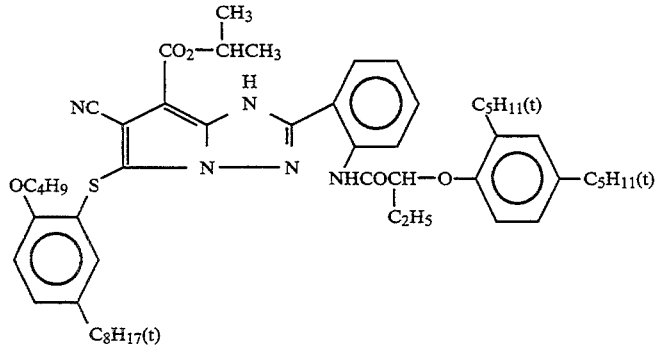
(C-20)
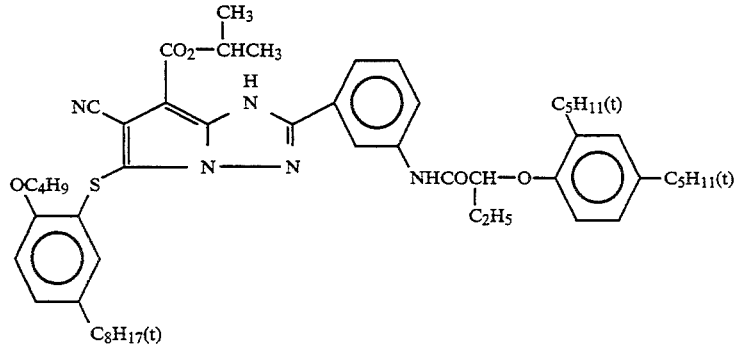

-continued
(C-21)
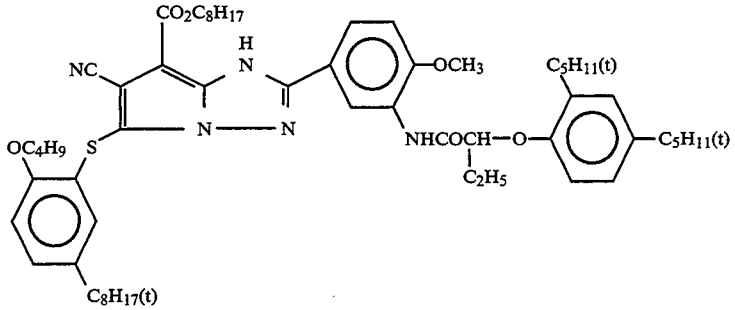
(C-22)
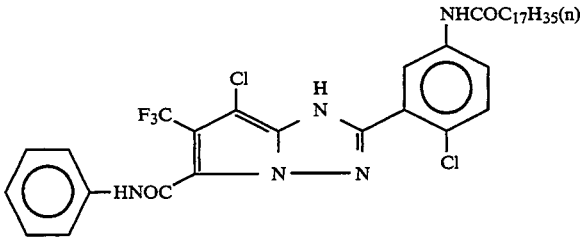
(C-23)
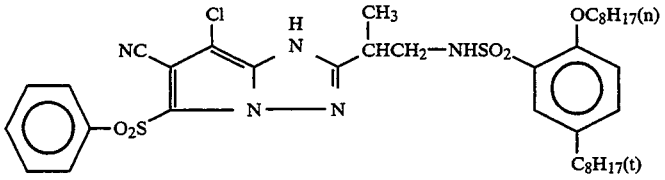
(C-24)
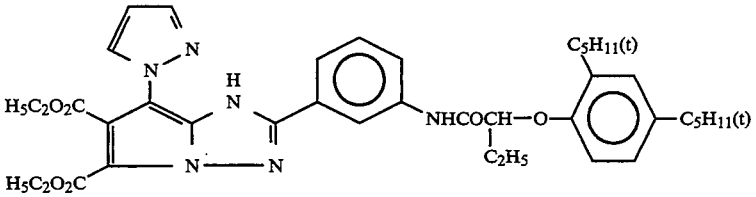
(C-25)
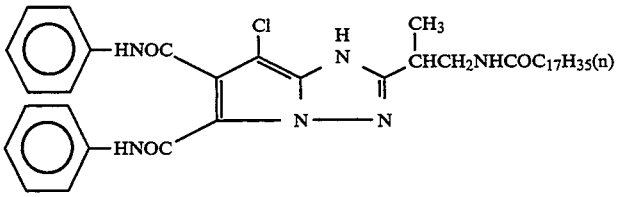
(C-26)
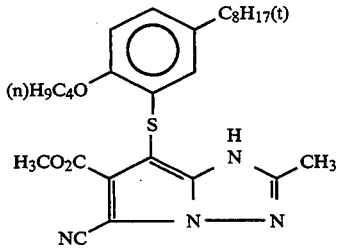

-continued
(C-27)
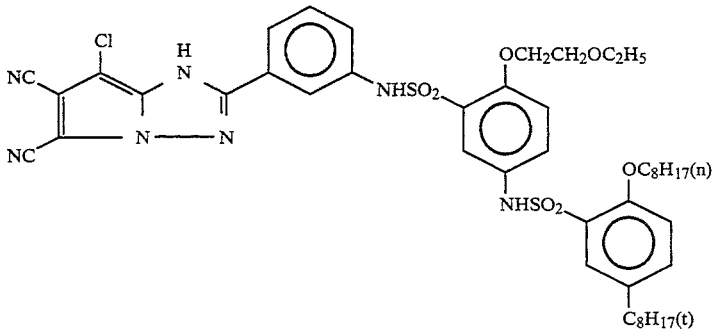
(C-28)
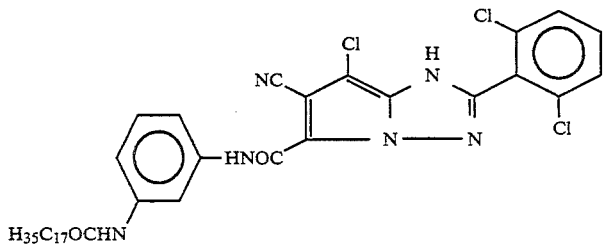
(C-29)
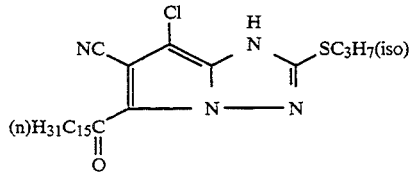
(C-30)
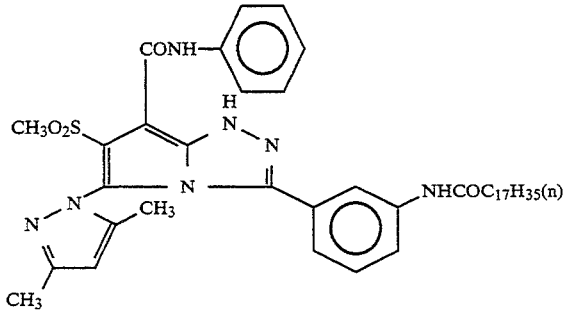
(C-31)
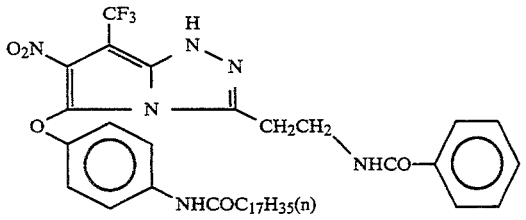
(C-32)
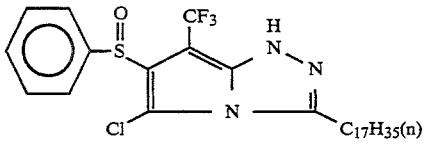

-continued
(C-33)
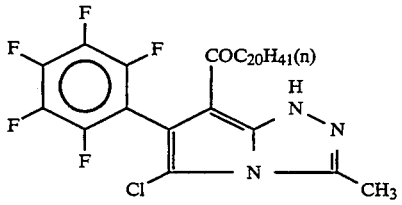
(C-34)
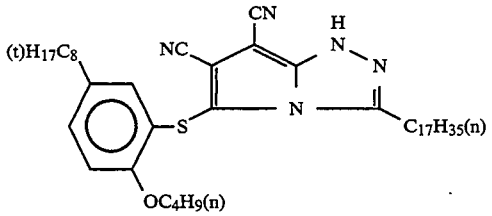
(C-35)
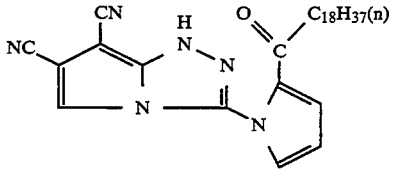
(C-36)
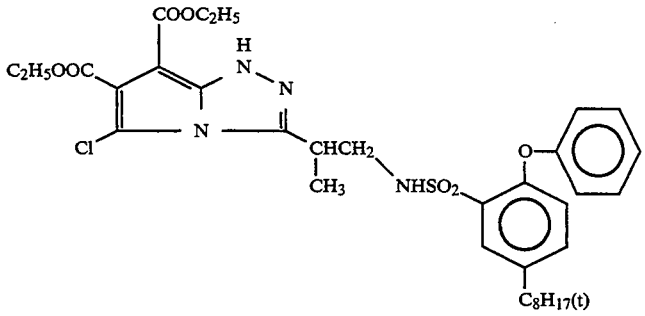
(C-37)
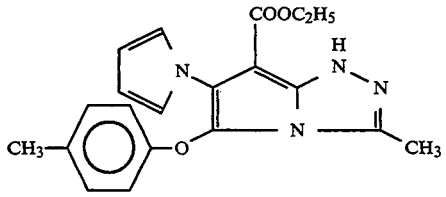
(C-38)
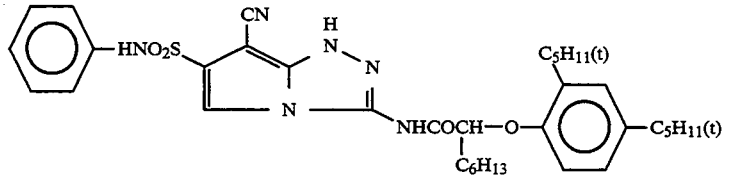
(C-39)
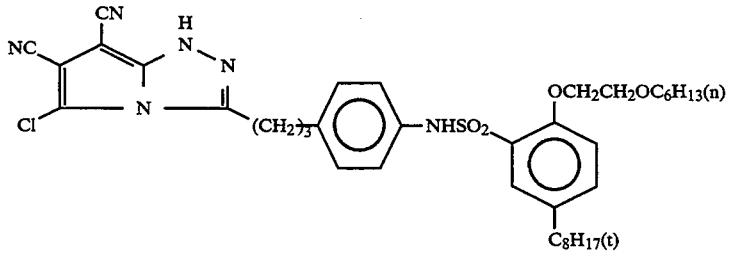

-continued
(C-40)
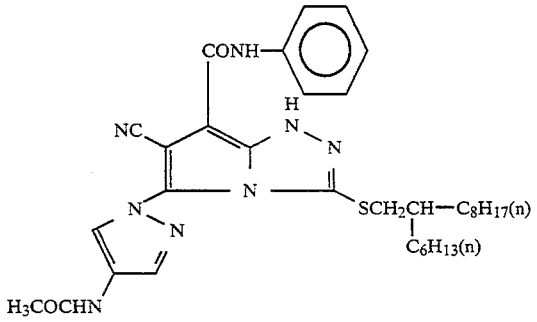
(C-41)
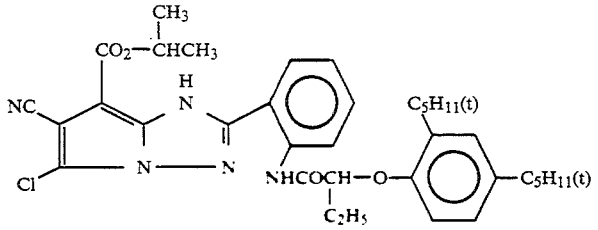
(C-42)
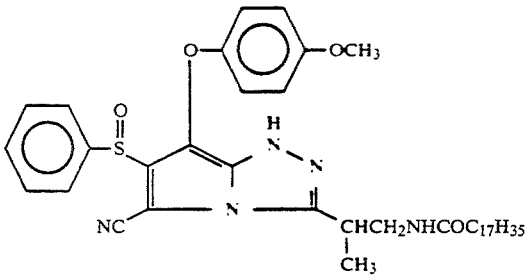
(C-43)
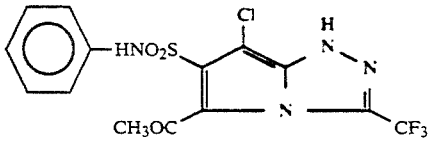
(C-44)
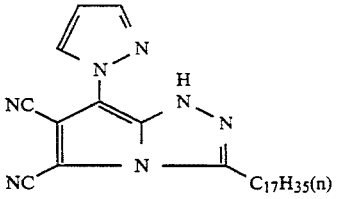
(C-45)
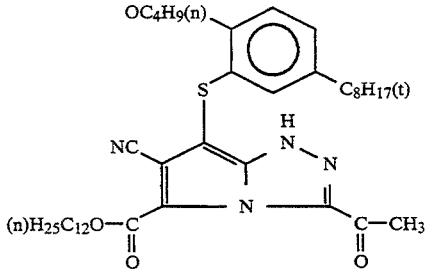

-continued
(C-46)
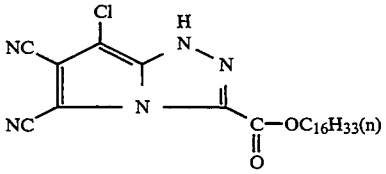
(C-47)
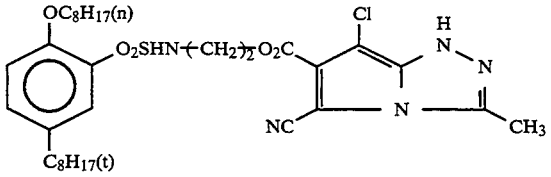
(C-48)
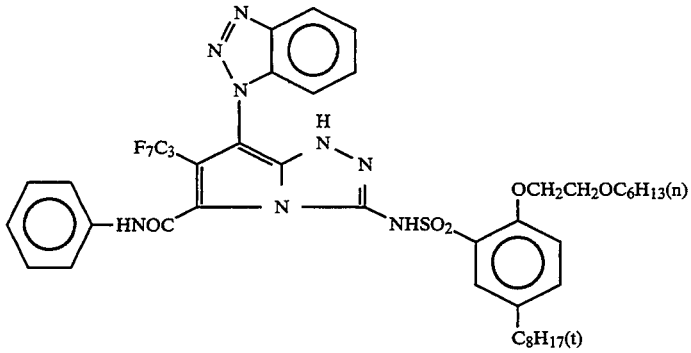
(C-49)
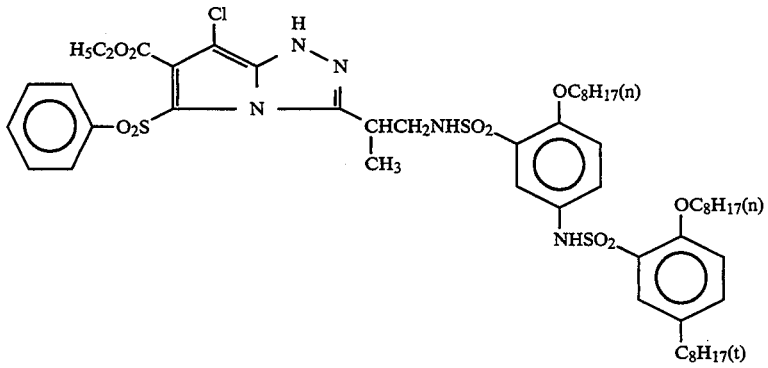
(C-50)
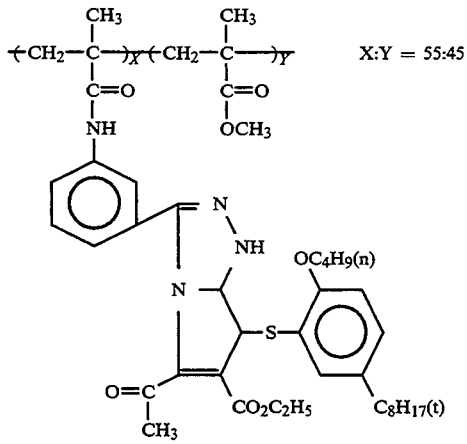
X:Y = 55:45

-continued
(C-51)
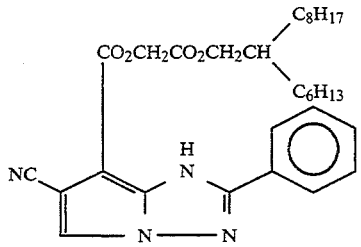
(C-52)
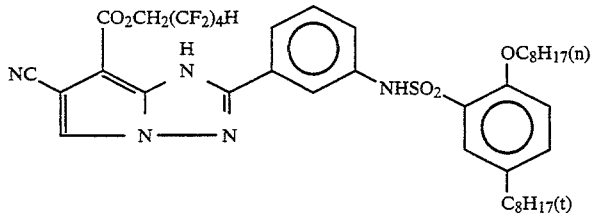
(C-53)
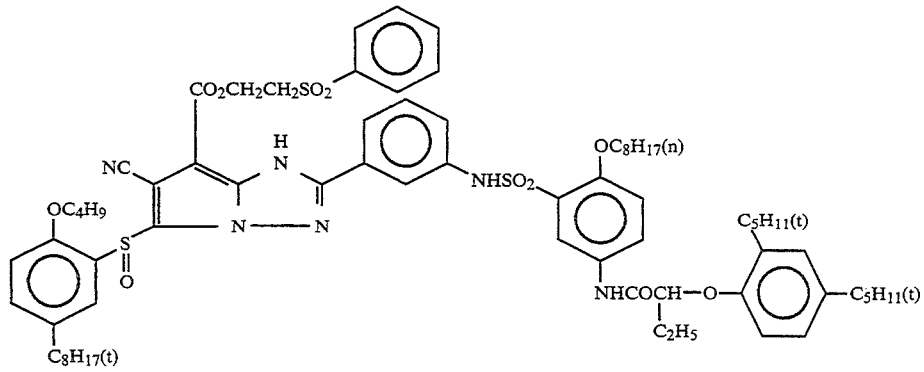
(C-54)
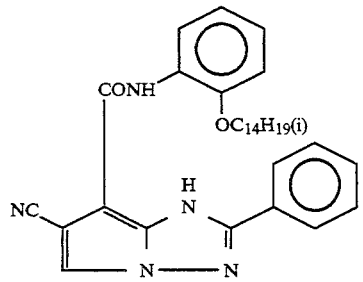
(C-55)
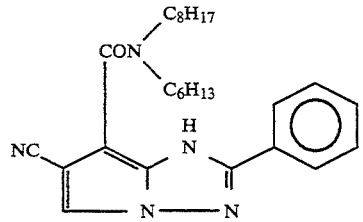
(C-56)
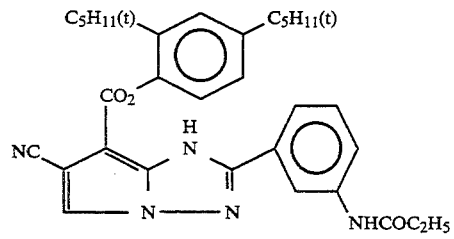

-continued
(C-57)
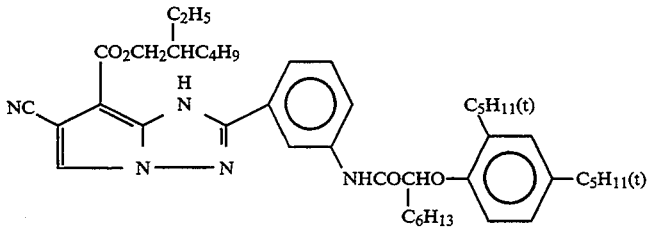
Of the cyan couplers of the present invention, coupler C-1, C-2, C-3, C-19, C-34, C-39, C-52 and C-53 are particularly preferred.
Synthesis examples of the cyan coupler of the present invention are illustrated below. Unless otherwise indicated herein, all parts, percents, ratios and the like are by weight.
SYNTHESIS EXAMPLE 1
Synthesis of Compound C-1
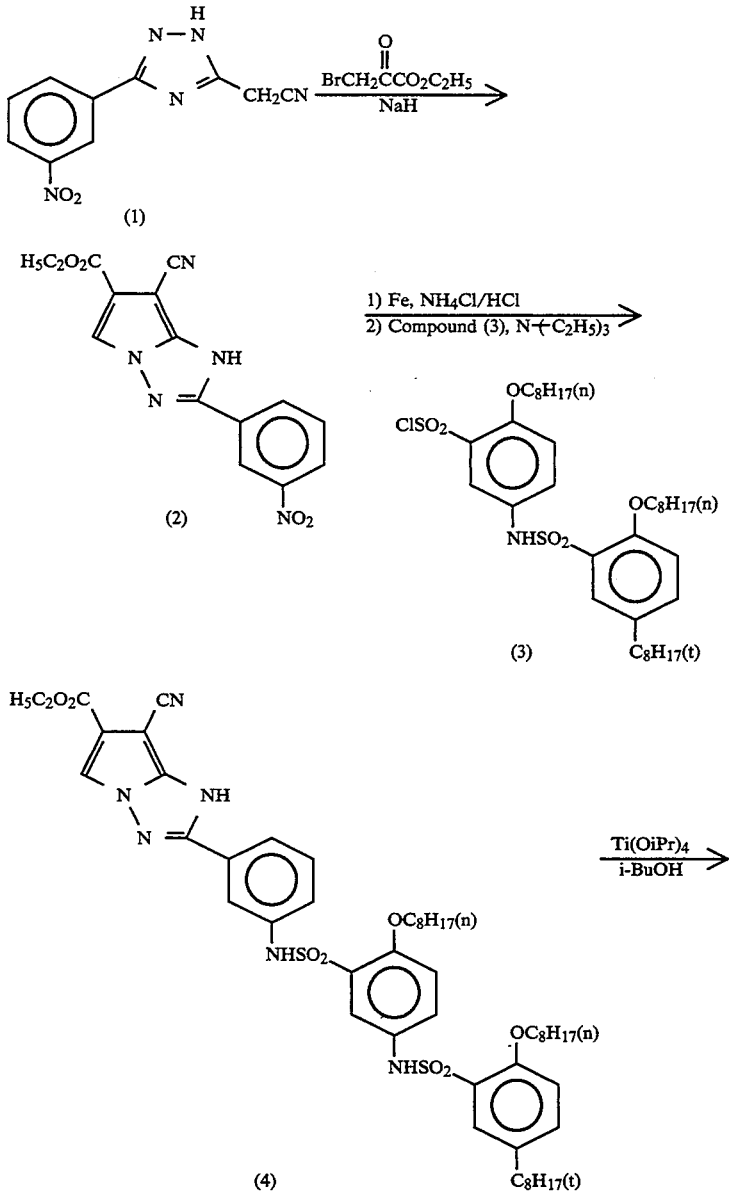

-continued

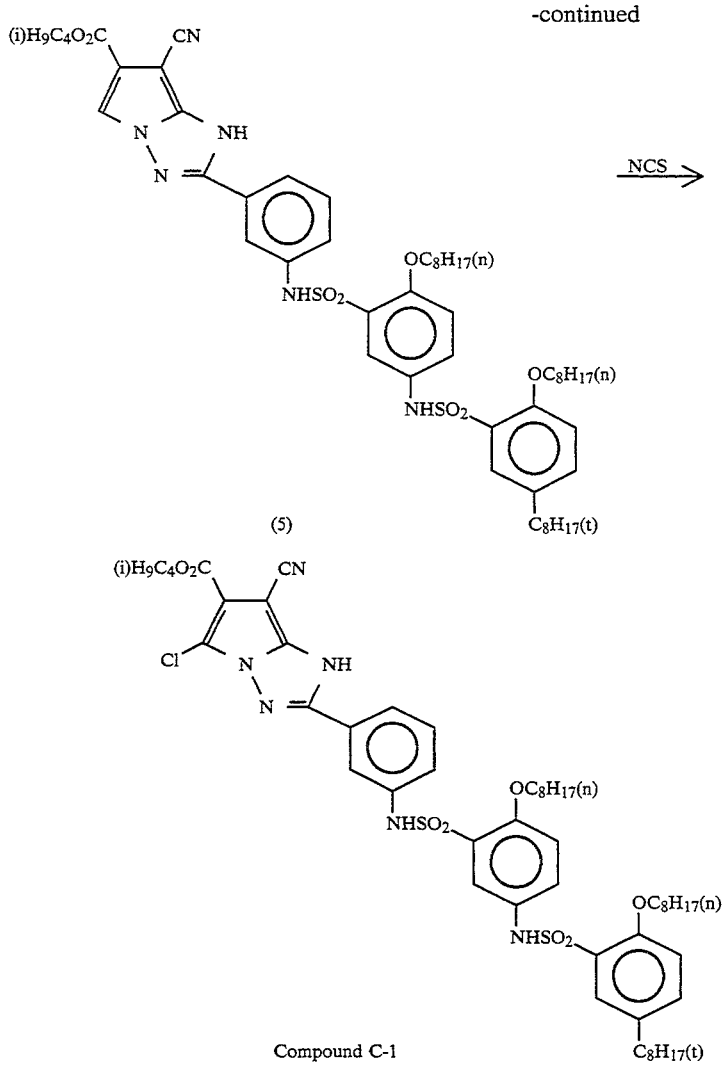

Compound C-1

In 150 ml of dimethylacetamide, there was dissolved 3-m-nitrophenyl-5-methylcyano-1,2,4-triazole (1) (20.0 g, 87.3 mmol). NaH (60% in oil) (7.3 g, 183 mmol) was added portionwise thereto, and the mixture was heated. To the mixture, 50 ml of a dimethylacetamide solution of ethyl ester of bromopyruvic acid (13.1 ml, 105 mmol) was added dropwise. Thirty minutes after completion of this dropwise addition, the mixture was stirred at 80° C. and then cooled to room temperature (about 20°–30° C.). The reaction mixture (solution) was acidified by adding 1N hydrochloric acid and then extracted with ethyl acetate. After the extract was dried over sodium sulfate, the solvent was distilled off under reduced pressure. The residue was purified by means of silica gel chromatography to obtain 10.79 g (38%) of Compound (2).

Reduced iron (9.26 g, 166 mmol) and ammonium chloride (0.89 g, 16.6 mmol) were suspended in 300 ml of isopropanol. Further, 30 ml of water and 2 ml of concentrated hydrochloric acid were added thereto, and the mixture was heated at reflux for 30 minutes. While the mixture was heated at reflux, Compound (2) (10.79 g, 33.2 mmol) was added portionwise thereto. Further, the mixture was at under reflux for 4 hours. Immediately thereafter, the mixture was filtered using diatomaceous earth ("Celite", produced by Johns Manville Sales Corp.) The filtrate was distilled under reduced pressure. The residue was dissolved in a mixed solution of 40 ml of dimethylacetamide and 60 ml of ethyl acetate. Compound (3) (25.6 g, 36.5 mmol) was added to the resulting solution. Further, triethylamine (23.1 ml, 166 mmol) was added thereto, and the mixture was heated at 70° C. for 5 hours. The reaction mixture (solution) was cooled to room temperature. Water was added thereto, and the mixture was extracted with ethyl acetate. The extract was washed with water and dried over sodium sulfate. The solvent was distilled off under reduced pressure. The residue was purified by means of silica gel chromatography to obtain 16.5 g (52%) of the Compound (4).

Compound (4) (7.0 g, 7.30 mmol) was dissolved in 14 ml of isobutanol. Tetraisopropyl orthotitanate (0.43 ml, 1.46 mmol) was added thereto. The mixture was heated at reflux for 6 hours. The reaction mixture was cooled to room temperature. Water was added thereto. The mixture was extracted with ethyl acetate. The extract was dried over sodium sulfate. The solvent was distilled off under reduced pressure. The residue was purified by means of silica gel chromatography to obtain 5.0 g (69%) of Compound (5).

Compound (5) (5.0 g, 5.04 mmol) was dissolved in 50 ml of tetrahydrofuran. While the resulting solution was cooled with water, $SO_2Cl_2$ (0.40 ml, 5.04 mmol) was added dropwise thereto. After dropwise addition, the mixture was stirred for 4 hours while cooling with water. Water was added to the reaction mixture. The mixture was extracted with ethyl acetate, and the extract was dried over sodium sulfate. The solvent was distilled off under reduced pressure. The residue was purified by means of silica gel chromatography to obtain 3.9 g (76%) of Compound C-1.

SYNTHESIS EXAMPLE 2

Synthesis of Compound C-39

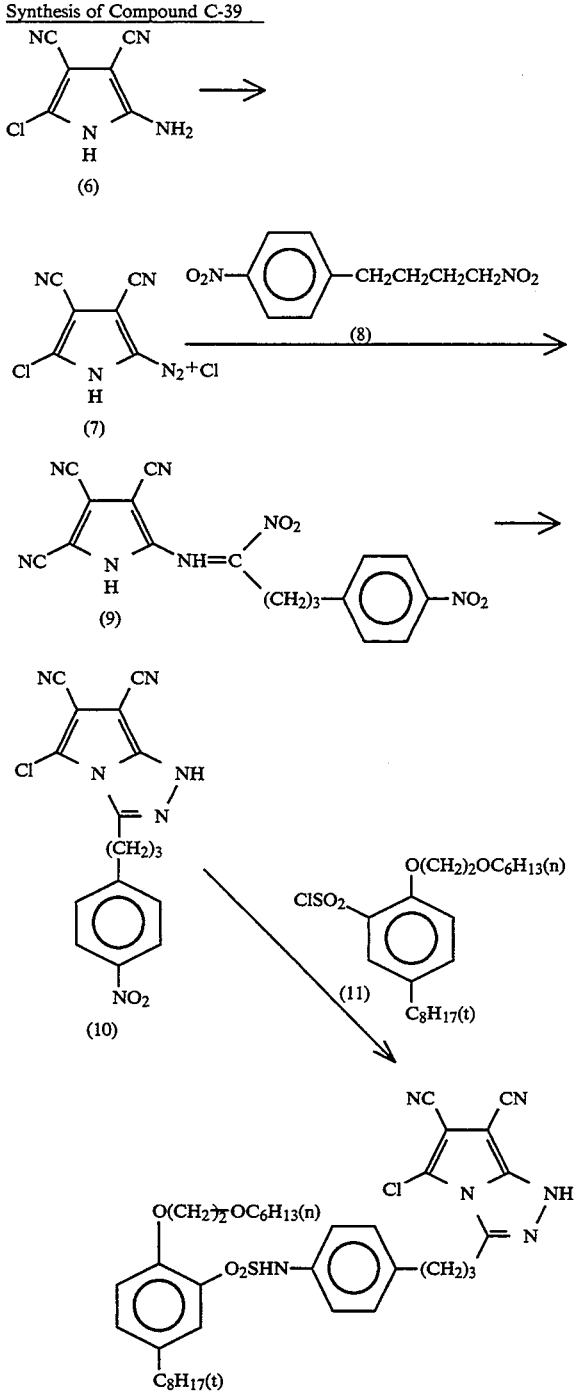

Compound C-39

To 2-amino-5-chloro-3,4-dicyanopyrrole (6) (6.78 g, 40.7 mmol), 38 ml of 36% hydrochloric acid was added. While the mixture was stirred under ice cooling, a solution of sodium nitrite (2.95 g, 42.7 mmol) in 5.9 ml of water was slowly added dropwise thereto. The mixture as such was stirred for 1.5 hours to produce Compound (7). To 177 ml of an ethanol solution of Compound (8) (9.58 g, 42.7 mmol) stirred under ice cooling, was added 102 ml of 28% sodium methylate. To the resulting solution, there was slowly added dropwise the solution of Compound (7) prepared above while stirring under ice cooling. After completion of the addition, stirring was continued for one hour. The reaction mixture was then heated at reflux with stirring. Ethanol was distilled off from the reaction mixture under reduced- pressure. The residue was dissolved in chloroform, washed with saturated sodium chloride and dried over sodium sulfate. Chloroform was distilled off under reduced pressure. The residue was purified by means of silica gel column chromatography to obtain 4.19 g of Compound (10). Yield: 29% based on Compound (6).

Compound (6) was synthesized by chlorinating 3,4-dicyanopyrrole, nitrating it and reducing the nitro compound in the presence of iron. Compound (8) was synthesized from Compound (a) (prepared from γ-lactone and benzene by conventional method) according to the method described in *Journal of the American Chemical Society*, 76, 3209 (1954).

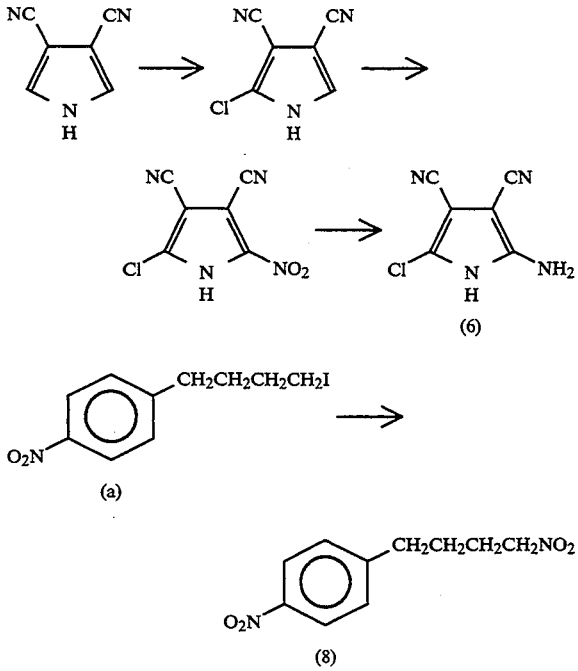

To reduced iron powder (3.3 g, 59.0 mmol), there were added 10 ml of water, ammonium chloride (0.3 g, 5.9 mmol) and acetic acid (0.34 ml, 5.9 mmol). The mixture was refluxed with stirring for 15 minutes, and 31 ml of isopropanol was added thereto. The mixture was refluxed with stirring for 20 minutes. Subsequently, 14 ml of an isopropanol solution of Compound (10) (4.1 g, 11.8 mmol) was added dropwise thereto. After the mixture was heated at reflux with stirring for 2 hours, the reaction mixture was filtered by using Celite as a filter aid. The residue was washed with ethyl acetate, and the solvent was distilled off under reduced pressure.

The residue was dissolved in a mixed solution of 16 ml of ethyl acetate and 24 ml of dimethylacetamide. Compound (11) (5.6 g, 13.0 mmol) was added to the resulting solution. Further, triethylamine (8.2 ml, 59.0 mmol) was added thereto, and the mixture was stirred at room temperature for 4 hours. Water was added thereto, and the mixture was extracted with ethyl acetate. The extract was washed with saturated sodium chloride and dried over sodium sulfate. The solvent was distilled off under reduced pressure. The residue was purified by means of silica gel chromatography to obtain 6.46 g (76%) of Compound C-39.

Fixing agents which can be used in the processing method of the present invention are illustrated below. The overall processing method is illustrated hereinafter.

Examples of suitable nitrogen-containing heterocyclic compounds having a sulfide group which can be used in the present invention include, but are not limited to, the following compounds.

A-1.

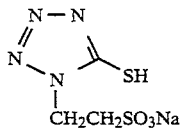

A-2.

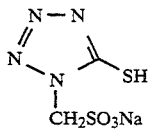

A-3.

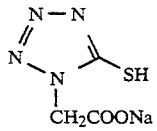

A-4.

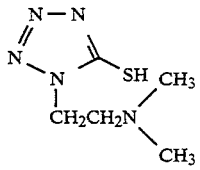

A-5.

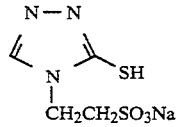

A-6.

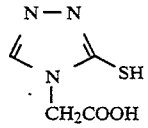

A-7.

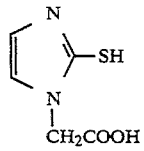

A-8.

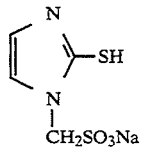

A-9.

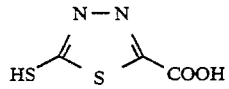

The nitrogen-containing heterocyclic compounds having a sulfide group which can be used in the present invention can be synthesized according to the methods described in *Berichte der Deutschen Chemischen Gesellschaft* 28, 77 (1895), JP-A-50-37436, JP-A-51-3231, U.S. Pat. Nos. 3,295,976 and 3,376,310, *Berichte der Deutschen Chemischen Gesellschaft* 22, 568 (1889), *J. Chem. Soc.* 1932, 1806, *J. Am. Chem. Soc.* 71, 4000 (1949), U.S. Pat. Nos. 2,585,388 and 2,541,924, *Advances in Heterocyclic Chemistry* 9, 165 (1968), *Organic Synthesis* IV, 569 (1963), *J. Am. Chem. Soc.*, 45, 2390 (1923), *Chemische Berichte* 9, 465 (1876), JP-B-40-28496 (the term "JP-B" as used herein means an "examined Japanese patent publication"), JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599 and 3,148,066, JP-B-43-4135, and U.S. Pat. Nos. 3,615,616, 3,420,664, 3,071,465, 2,444,605, 2,444,606, 2,444,607 and 2,935,404.

Examples of meso-ionic compounds which can be used in the present invention include, but are not limited to, the following compounds.

B-1.

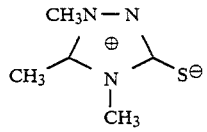

B-2.

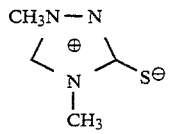

B-3.

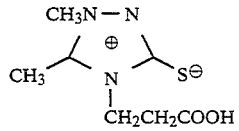

B-4.

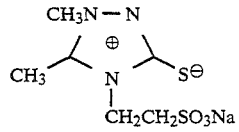

B-5.

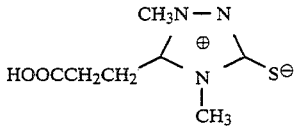

B-6.

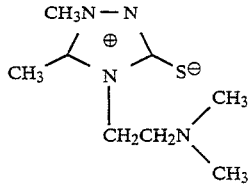

B-7.

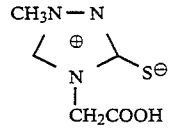

B-8.

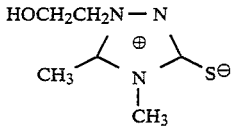

B-9.

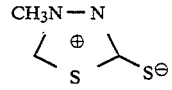

B-10.

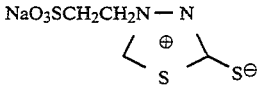

B-11.

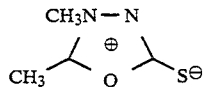

-continued

B-12.

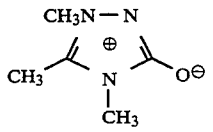

The above-described meso-ionic compounds used in the present invention can be synthesized according to the methods described in *J. Heterocyclic Chem.* 2, 105 (1965), *J. Org. Chem.*, 32, 2245 (1967), *J. Chem. Soc.* 3799 (1969), *J. Am. Chem. Soc.* 80, 1895 (1958), *Chem. Commun.* 1222 (1971), *Tetrahedron Letters* 2939 (1972), JP-A-60-87322, *Berichte der Deutschen Chemischen Gesellschaft* 38, 4049 (1905), *J. Chem. Soc. Chem. Commun.* 1224 (1971), JP-A-60-122936, JP-A-60-117240, *Advance in Heterocyclic Chemistry* 19, 1 (1976), *Tetrahedron Letters* 5881 (1968), *J. Heterocyclic Chem.* 5, 277 (1968), *J. Chem. Soc. Perkin Trans* I, 627 (1974), *Tetrahedron Letters* 1809 (1967), ibid., 1578 (1971), *J. Chem. Soc.* 899 (1935), ibid., 2865 (1959) and *J. Org. Chem.* 30, 567 (1965).

Examples of the thioether compounds which can be used in the present invention include, but are not limited to, the following compounds.

$NaO_3S(CH_2)_2S(CH_2)_2S(CH_2)_2SO_3Na$ E-1.

$NaO_3S(CH_2)_2(SCH_2CH_2)_2S(CH_2)_2SO_3Na$ E-2.

$NaO_3S(CH_2)_2(SCH_2CH_2)_3S(CH_2)_2SO_3Na$ E-3.

$NaO_3S(CH_2)_2(SCH_2CH_2)_4S(CH_2)_2SO_3Na$ E-4.

$NaO_3S(CH_2)_3S(CH_2)_2O(CH_2)_2S(CH_2)_3SO_3Na$ E-5.

$NaO_3S(CH_2)_2S(CH_2)_2N(CH_3)(CH_2)_2S(CH_2)_2SO_3Na$ E-6.

$KO_3S(CH_2)_2S(CH_2)_2N(CH_2)_2SO_3K)(CH_2)_2SO_3K$ E-7.

$Na_2O_3P(CH_2)_2S(CH_2)_2S(CH_2)_2PO_3Na_2$ E-8.

$Na_2O_3P(CH_2)_2(SCH_2CH_2)_2S(CH_2)_2PO_3Na_2$ E-9.

$Na_2O_3P(CH_2)_3(SCH_2CH_2)_3S(CH_2)_3PO_3Na_2$ E-10.

$(CH_3)_2N(CH_2)_2S(CH_2)_2S(CH_2)_2N(CH_3)_2$ E-11.

$H_2N(CH_2)_2S(CH_2)_2S(CH_2)_2NH_2$ E-12.

$H_2NO_2S(CH_2)_2S(CH_2)_2S(CH_2)_2NH_2$ E-13.

$CH_3SO_2N(CH_3)(CH_2)_2NH(CH_2)_2S(CH_2)_2CONH_2$ E-14.

$CH_3SO_2(CH_2)_3S(CH_2)_3S(CH_2)_2SO_3Na$ E-15.

The above thioether compounds used in the present invention can be easily synthesized by referring to the methods described in *J. Org. Chem.* 30, 2867 (1965), *ibid.* 27, 2848 (1962) and *J. Am. Chem. Soc.* 69, 2330 (1947).

It is preferred for the bleaching-fixing solutions to contain at least one metal chelate compounds represented by the following general formulas (III), (IV), (V), (VI) and (VII).

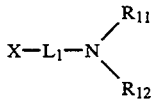

(III)

In formula (III), X represents —CO—N(OH)—$R_a$ (wherein $R_a$ is a hydrogen atom, an aliphatic group, an aromatic group or a heterocyclic group), —N(OH)—CO—$R_b$ (wherein $R_b$ is an aliphatic group, an aromatic group or a heterocyclic group), —$SO_2NR_c(R_d)$ or —$N(R_e)SO_2R_f$ (wherein $R_c$, $R_d$ and $R_e$ are each a hydrogen atom, an aliphatic group, an aromatic group or a heterocyclic group, and $R_f$ is an aliphatic group, an aromatic group or a heterocyclic group); $L_1$ represents an aliphatic group, an aromatic group, a heterocyclic group or a bivalent bonding group comprising a combination of these groups; and $R_{11}$ and $R_{12}$ may be the same or different and each represents a hydrogen atom, an aliphatic group, an aromatic group or a heterocyclic group.

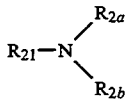

(IV)

In formula (IV), $R_{21}$ has the same meaning as $R_{11}$ in general formula (III); $R_{2a}$ and $R_{2b}$ may be the same or different and each represents —$Y_1$—C(=$X_1$)—N($R_h$)—$R_g$ or —$Y_2$— N($R_i$)—C(=$X_2$)—$R_j$; $Y_1$ and $Y_2$ have the same meaning as $L_1$ in general formula (III); $R_g$, $R_h$ and $R_i$ have the same meaning as $R_a$ in general formula (III); $R_j$ represents an aliphatic group, an aromatic group, a heterocyclic group, —$NR_k(R_l)$ (wherein $R_k$ and $R_l$ have the same meaning as $R_a$ in general formula (III)) or —$OR_m$ (wherein $R_m$ is an aliphatic group, an aromatic group or a heterocyclic group); and $X_1$ and $X_2$ each represents an oxygen atom or a sulfur atom.

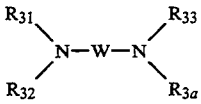

(V)

In formula (V), $R_{31}$, $R_{32}$ and $R_{33}$ have the same meaning as $R_{11}$ in general formula (III); $R_{3a}$ has the same meaning as $R_{2a}$ in general formula (IV); and W represents a bivalent bonding group.

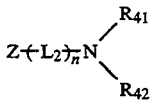

(VI)

wherein $R_{41}$ and $R_{42}$ have the same meaning as Rll in general formula (III); $L_2$ represents a bivalent bonding group; Z represents a heterocyclic group; and n represents 0 or 1.

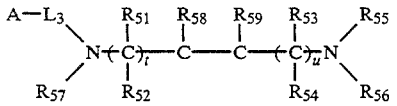

(VII)

In formula (VII), $L_3$ represents an aliphatic group, an aromatic group, a heterocyclic group or a bivalent bonding group comprising a combination of these groups; A represents a carboxyl group, a phosphono group, a sulfo group or a hydroxy group; $R_{51}$, $R_{52}$, $R_{53}$, $R_{54}$, $R_{55}$, $R_{56}$ and $R_{57}$ may be the same or different and each represents a hydrogen atom, an aliphatic group or a heterocyclic group; $R_{58}$ and $R_{59}$ may be the same or different and each represents a hydrogen atom, an aliphatic group, an aromatic group, a heterocyclic group, a halogen atom, a cyano group, a nitro group, an acyl group, a sulfamoyl group, a carbamoyl group, an alkoxycarbonyl group, an aryloxycarbonyl group, a sulfonyl group or a sulfinyl group, or $R_{58}$ and $R_{59}$ may combine together to form a ring; and t and u each represents 0 or 1.

In the present invention, rapid rinsing and/or stabilizing treatment can be achieved, and the light-sensitive materials can be rapidly conveyed through processing baths and can be processed by substantially in the absence of contact with the air. Processing can be satisfactorily made even when processing devices having a low opening ratio are used. Further, processing with a low replenishment rate can be conducted.

The term "opening ratio" as used herein refers to the value obtained by dividing the surface area of a processing bath by the volume of the processing bath. The opening ratio is often used as an index of the ease of oxidation of processing solutions in the processing baths.

In the present invention, the temperature of the rinsing bath and/or the stabilizing bath is preferably 30° C. or higher. It has been found that when the temperature is 40° C. or higher, the aforesaid materials which stain images can be rapidly removed. However, when the temperature is raised to 40° C. or higher, the amount of water which evaporates is increased, and hence it is preferred that the opening ratio is not higher than 0.001.

The present invention can be applied to processing methods for rapid simplified processing. The present invention can be preferably applied to light-sensitive materials which require alkali consumption of 3.0 mmol/$m^2$. The term "alkali consumption" as used herein refers to the amount of alkali required to increase the pH of crushed material obtained by crushing a light-sensitive material by using a support to a pH of 10 from a pH of 6 as described in JP-A-3-109539.

In the present invention, a bleaching-fixing composition generally refers to a bleaching-fixing solution, but sometimes includes the replenisher therefore and a supply kit (solution and thickener). The replenisher may be added portionwise, for example, by dividing it into two or more portions.

Specific examples of compounds of general formulas (III), (IV), (V), (VI) and/or (VII) and specific examples of the synthesis methods of these compounds are described in Japanese Patent Application Nos. 2-127479, 2-175026, 2-196972, 2-201846 and 2-258539.

Typical examples of the compounds of general formulas (III), (IV), (V), (VI) and/or (VII) include, but are not limited to, the following compounds.

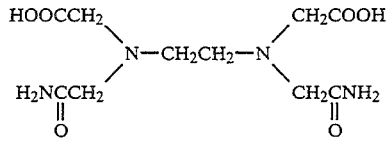

BL-1

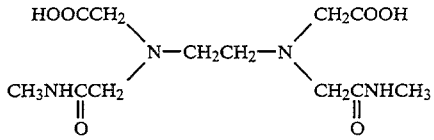

BL-2

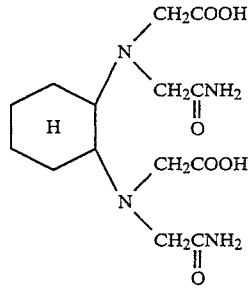

BL-3

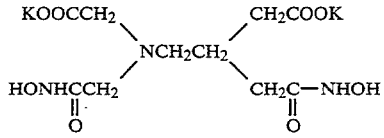

BL-4

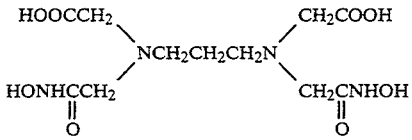

BL-5

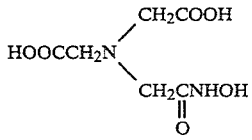

BL-6

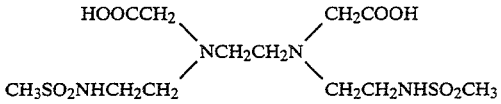

BL-7

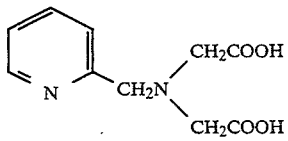

BL-8

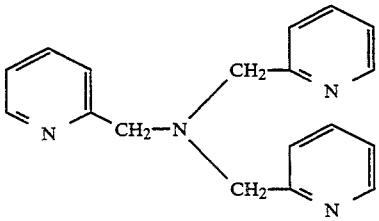

BL-9

-continued

BL-10

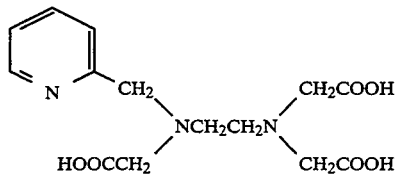

BL-11

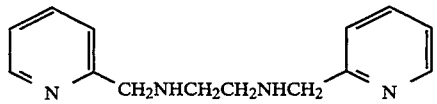

BL-12

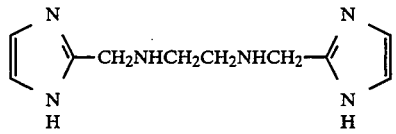

BL-13

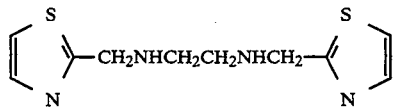

BL-14

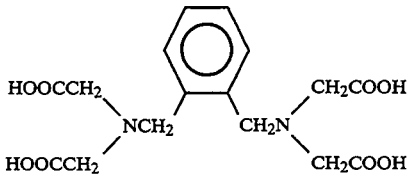

BL-15

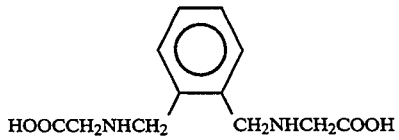

BL-16

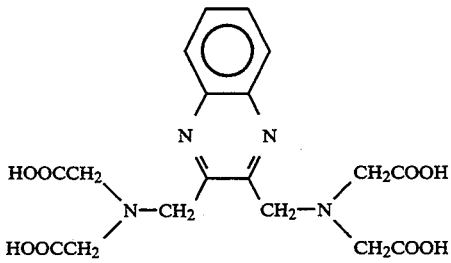

BL-17

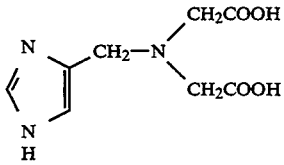

BL-18

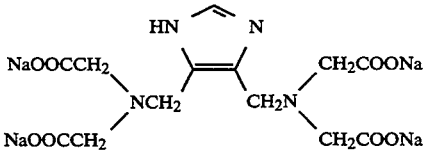

-continued

BL-19

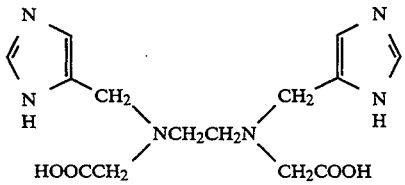

Examples of central metal atoms which can be used in the metal chelate compounds include Fe(III), Mn(III), Co(III), Rh(II), Rh(III), Au(III), Au(II) and Ce(IV).

The metal chelate compounds may be used by previously preparing the metal chelate compounds per se.

Alternatively, the compounds of general formulas (III), (IV), (V), (VI) and/or (VII) may be reacted with metal salts such as iron(III) sulfate, iron(III) chloride, iron(Ill) nitrate, ammonium ferric sulfate and iron(III) phosphate in the processing solution. The compounds of general formulas (III), (IV), (V), (VI) and/or (VII) are used in a ratio of the compound to the metal ion of at least 1.0 by mol. When the stability of the resulting metal chelate compound is low, a higher ratio is preferred. The ratio is usually in the range of from 1 to 30.

When the color photographic material of the present invention is a color photographic paper, the color photographic paper comprises a support having thereon at least one blue-sensitive silver halide emulsion layer, at least one green-sensitive silver halide emulsion layer and at least one red-sensitive silver halide emulsion layer. In general-purpose color photographic paper, the emulsion layers in this order are coated on the support. However, the emulsion layers may be coated in a different order from the above order.

The method for processing a light-sensitive material according to the present invention can be applied to the rapid processing of color prints conventionally used. However, when processing is to be more rapidly conducted, the processing method of the present invention can be applied to the processing of intelligent color hard copy.

In a preferred embodiment for intelligent color hard copy, scanning exposure is conducted by using high-density light beams such as laser beams (e.g., semiconductor laser beam) or light-emitting diode beam.

Many semiconductor lasers are highly sensitive to light in infrared region. Hence, light-sensitive materials can have an infrared-sensitive silver halide emulsion layer in place of at least one of the above-described emulsion layers. Color reproduction by subtractive color photography can be achieved by the presence of dyes having a relation of complementary colors to light which the silver halide emulsions are sensitive, that is, color couplers (yellow coupler sensitive to blue light, magenta coupler sensitive to green light and cyan coupler sensitive to red light) in these light-sensitive emulsion layers. The light-sensitive layers may not correspond to the hue of developed color as described above.

Color couplers may be two colors depending on image and quality required. In this case, the silver halide emulsion layers may comprise two layers corresponding to the colors. A full color image can not be formed, but an image can be formed more rapidly.

The Silver halide used in the silver halide emulsions of the present invention can be silver chloride or silver chlorobromide having a silver chloride content of at least 90 mol %. Grains present in an emulsion may have a different halogen composition from one another, or may have the same halogen composition. However, when grains having the same halogen composition are used, the uniform properties of the grains can be easily achieved. With regard to halogen composition distribution in the interior of the silver halide grain, the grains can be used by properly choosing them from among uniform structure type grains wherein the halogen composition is uniform throughout the grain; shell/core structure type grains wherein the core in the interior of the silver halide grain and the shell (composed of a single layer or two or more layers) of the grain have different halogen composition from each other, the core being surrounded by the shell; and grains wherein the grain has an area with a different halogen composition in the interior of the grain or in a non-laminar form on the surface thereof (when the area exists on the surface of the grain, the grain has a structure such that the area having a different halogen composition is joined to the edges, corners or plain of the grain). It is preferred that any one of the latter two types is used rather than a uniform type structure to obtain high sensitivity. The latter two types are preferred from the standpoint of pressure resistance. When the silver halide grains have a structure such as that described above, the boundary between the areas with different halogen compositions may be clear or may be made diffuse by a mixed crystal formed by a difference in halogen composition. The boundary may be continuously vary.

When the silver halide emulsion of the present invention is a high silver chloride emulsion having a silver chloride content of at least 90 mol %, it is preferred that uniform structure type grains with a narrow halogen composition distribution are used to prevent as much as possible a reduction in sensitivity when pressure is applied to the light-sensitive material.

It is also effective for the silver chloride content of the silver halide emulsion to be further increased to reduce the replenishment rates of the processing solutions. In this case, emulsions having a silver chloride content of 98 to 100 mol %, that is, emulsions comprising nearly pure silver chloride can be preferably used.

Silver halide grains present in the silver halide emulsions of the present invention have a mean grain size (the diameter of the grain is defined as the diameter of a circle having an area equal to the projected area of the grain, and the average of the diameters of the grains is referred to as the mean grain size) of preferably 0.1 to 2 μ.

Monodisperse emulsions having a coefficient of variation (the value obtained by dividing the standard deviation of the grain size distribution by the mean grain size) in grain size distribution of not higher than 20%, preferably not higher than 15% are preferred. A blend of two or more monodisperse emulsions may be coated in the same layer, or two or more monodisperse emulsions may be coated using multi-layer coating to obtain wide tolerance.

Silver halide grains present in the photographic emulsions may have a regular crystal form such as a cubic, tetradecahedral or octahedral form, an irregular crystal form such as a spherical or tabular form, or a composite form thereof. A mixture of grains with various crystal forms may be used. In the present invention, it is preferred that the grains have such a crystal form distribution that grains with a regular crystal form account for at least 50%, preferably at least 70%, more preferably at least 90%, of the entire grains.

In addition thereto, emulsions comprising grains having such a grain size distribution that tabular grains with an average aspect ratio (diameter in terms of a circle/thickness) of not lower than 5, preferably not lower than 8 account for more than 50% of the projected area of the entire grains can be preferably used .

The hydrophilic colloid layers of the light-sensitive materials of the present invention may contain dyes (particularly oxonol dyes) capable of being decolorized on processing as described in European Patent (EP) 0,337,490A2 in an amount so as to provide an optical reflection density of at least 0.70 at 680 nm, or at least 12 wt % (more preferably at least 14 wt %) of titanium oxide having a surface treated with a dihydric to tetrahydric alcohol (e.g., trimethylol ethane) may be present in the water-resistant layer of the support to improve image sharpness.

It is preferred that the light-sensitive materials of the present invention contain dye image storage-improving compounds as described in European Patent (EP) 0,277,589A together with the couplers present. It is particularly preferred that the dye image storage improving compounds are used together with pyrazoloazole couplers.

Namely, it is preferred that a compound (F) and/or a compound (G) are/is used together with the couplers, the compound (F) being chemically bonded to the aromatic amine developing agent left behind after color development to form a compound which is chemically inert and substantially colorless, and the compound (G) being chemically bonded to the oxidation product of the aromatic amine color developing agent left behind after color development to form a compound which is chemically inert and substantially colorless. For example, when these compounds are used either alone or in combination, stain can be prevented from being formed by the developed dye formed by reaction of couplers with the color developing agents or the oxidation product thereof left behind in the layers during storage after processing, and other side effects can be prevented from occurring.

Further, the photographic materials of the present invention may contain at least one yellow couplers represented by the following general formula (VIII) as an oil-soluble coupler.

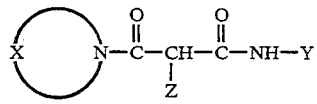

(VIII)

In the formula (VIII), X represents an organic residue required for forming a nitrogen-containing heterocyclic ring together with the nitrogen atom in the ring; Y represents an aromatic group or a heterocyclic group; and Z represents a group which is eliminated by the coupling reaction of the coupler with the oxidation product of a developing agent.

The end moiety of the coupler is abbreviated A in the following description for brevity's sake.

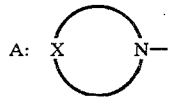

The nitrogen-containing heterocyclic group represented by A described above can be a saturated or unsaturated, monocyclic or fused-ring, substituted or unsubstituted nitrogen-containing heterocyclic group having at least one carbon atom, preferably 1 to 20 carbon atoms, particularly preferably 2 to 12 carbon atoms. The group may contain, in addition to the nitrogen atom, one or more of an oxygen atom, sulfur atom and a phosphorus atom as hetero-atoms and a member or members of the ring. Considering the number of members of the ring, the heterocyclic ring is a three-membered or higher-membered ring, preferably a three-membered to twelve-membered ring, particularly preferably a five-membered or six-membered ring.

Specific examples of heterocyclic groups represented by A include pyrrolidino, piperidino, morpholino, 1-imidazolidinyl, 1-pyrazolyl, 1-piperazinyl, 1-indolinyl, 1,2,3,4-tetrahydroquinoxaline-1-yl, 1-pyrrolinyl, pyrazolidine-1-yl, 2,3-dihydro-1-indazolyl, isoindoline-2-yl, 1-indolyl, 1-pyrrolyl, benzthiazine-4-yl, 4-thiazinyl, benzodiazine-1-yl, aziridine-1-yl, benzoxazine-4-yl, 2,3,4,5-tetrahydroquinolyl and phenoxazine-10-yl.

The aromatic group represented by Y in general formula (VIII) is a substituted or unsubstituted aromatic group having 6 or more carbon atoms, preferably 6 to 10 carbon atoms. A phenyl group and-napbthyl group are particularly preferred.

The heterocyclic group represented by Y in general formula (VIII) can be a saturated or unsaturated, substituted or unsubstituted heterocyclic group having at least one carbon atom, preferably 1 to 10 carbon atoms, particularly preferably 2 to 5 carbon atoms. The hetero-atoms are preferably nitrogen atoms, sulfur atoms and oxygen atoms. With regard to the number of members of the ring, the heterocyclic ring is preferably a five-membered or six-membered ring. However, a smaller-membered or larger-membered ring may be used. The ring may be monocyclic or a fused-ring. Specific examples of heterocyclic groups include 2-pyridyl, 4-pyrimidinyl, 5-pyrazolyl, 8-quinolyl, 2-furyl and 2-pyrrolyl.

The group represented by A and the group represent by Y may optionally have one or more substituents. Examples of substituents include a halogen atom (e.g., fluorine, chlorine), an alkoxycarbonyl group (having 2 to 30 carbon atoms, preferably 2 to 20 carbon atoms, e.g., methoxycarbonyl, dodecyloxycarbonyl, hexadecyloxycarbonyl), an acylamino group (having 2 to 30 carbon atoms, preferably 2 to 20 carbon atoms, e.g., acetamido, tetradecaneamido, 2-(2,4-di-tamylphenoxy)-butaneamido, benzamido), a sulfonamido group (having 1 to 30 carbon atoms, preferably 1 to 20 carbon atoms, e.g., methanesulfonamido, dodecanesulfonamido, hexadecanesulfonamido, benzenesulfonamido), a carbamoyl group (having 2 to 30 carbon atoms, preferably 2 to 20 carbon atoms, e.g., N-butylcarbamoyl , N,N-diethylcarbamoyl), a sulfamoyl group (having 1 to 30 carbon atoms, preferably 1 to 20 carbon atoms, e.g., N-butylsulfamoyl, N-dodecylsulfamoyl , N-hexadecylsulfamoyl, N-3-(2,4-di-t-amylphenoxy) butylsulfamoyl), an alkoxy group (having 1 to 30 carbon atoms, preferably 1 to 20 carbon atoms, e.g., methoxy, dodecyloxy), an N-acylsulfamoyl group (having 2 to 30 carbon atoms, preferably 2 to 20 carbon atoms, e.g., N-propanoylsulfamoyl, N-tetradecanoylsulfamoyl group), sulfonyl group (having 1 to 30 carbon atoms, preferably 1 to 20 carbon atoms, e.g., methanesulfonyl, octanesulfonyl, dodecanesulfonyl), an alkoxycarbonylamino group (having 1 to 30 carbon atoms, preferably 1 to 20 carbon atoms, e.g., methoxycarbonylamino, tetradecyloxycarbonylamino), a cyano group, a nitro group, a carboxyl group, an aryloxy group (having 6 to 20 carbon atoms, preferably 6 to 10 carbon atoms, e.g., phenoxy, 4-chlorophenoxy), an alkylthio group (having 1 to 30 carbon atoms, preferably 1 to 20 carbon atoms, e.g., methylthio, dodecylthio), ureido group (having 1 to 30 carbon atoms, preferably 1 to 20 carbon atoms, e.g., phenylureido), an aryl group (having the same meaning as when Y is an aromatic group), a heterocyclic group (having the same meaning when Y is a heterocyclic group), a sulfo group, an alkyl group (a straight-chain, branched or cyclic saturated or unsaturated, substituted or unsubstituted alkyl group having 1 to 30 carbon atoms, preferably 1 to 20 carbon atoms, e.g., methyl, ethyl, isopropyl, cyclopropyl, trifluoromethyl, cyclopentyl, dodecyl, 2-hexyloctyl), an acyl group (having 1 to 30 carbon atoms, preferably 2 to 20 carbon atoms, e.g., acetyl, benzoyl), an arylthio group (having 6 to 20 carbon atoms, preferably 6 to 10 carbon atoms, e.g., phenylthio), a sulfamoylamino group (having up to 30 carbon atoms, preferably up to 20 carbon atoms, e.g., N-butylsulfamoylamino, N-dodecylsulfamoylamino), an N-acylcarbamoyl group (having 2 to 30 carbon atoms, preferably 2 to 20 carbon atoms, e.g., N-dodecanoylcarbamoyl, an N-sulfonylcarbamoyl group (having 1 to 30 carbon atoms, preferably 2 to 20 carbon atoms, e.g., N-hexadecanesulfonylcarbamoyl, N-benzenesulfonylcarbamoyl, N-(2-octyloxy-5-t-octylbenzenesulfonyl)carbamoyl), an N-sulfamoylcarbamoyl group (having 1 to 30 carbon atoms, preferably 1 to 20 carbon atoms, e.g., N-(ethylsulfamoyl)carbamoyl, N-{3-(2,4-di-t-amylphenoxy)propylsulfamoyl}carbamoyl), an N-sulfonylsulfamoyl group (having up to 30 carbon atoms, preferably 1 to 20 carbon atoms, e.g., N-dodecanesulfonylsulfamoyl, N-benzenesulfonylsulfamoyl), an N-carbamoylsulfamoyl group (having 1 to 30 carbon atoms, preferably 1 to 20 carbon atoms, e.g., N-(ethylcarbamoyl)sulfamoyl, N-{3-(2,4-di-t-amylphenoxy)propylcarbamoyl}sulfamoyl), an N-(N-sulfonylcarbamoyl)sulfamoyl group (having 1 to 30 carbon atoms, preferably 1 to 20 carbon atoms, e.g., N-(dodecanesulfonylcarbamoyl)sulfamoyl, N-(2-octyloxy-5-t-octylbenzenesulfonylcarbamoyl)sulfamoyl), a 3-sulfonylureido group (having 1 to 30 carbon atoms, preferably 1 to 20 carbon atoms, e.g., 3-hexadecanesulfonylureido, 3-benzenesulfonylureido), a 3-acylureido group (having 2 to 30 carbon atoms, preferably 2 to 20 carbon atoms, e.g., 3-acetylureido, 3-benzoylureido), a 3-acylsulfamido group (having 1 to 30 carbon atoms, preferably 1 to 20 carbon atoms, e.g., 3-propionylsulfamido, 3-(2,4-dichlorobenzoyl)sulfamido), a 3-sulfonylsulfamido group (having up to 30 carbon atoms, preferably 1 to 20 carbon atoms, e.g., 3-methanesulfonylsulfamido, 3-(2-methoxyethoxy-5-t-octylbenzenesulfonyl) sulfamido), hydroxyl group, an acyloxy group (having 1 to 30 carbon atoms, preferably 1 to 20 carbon atoms, e.g., propanoyloxy, tetradecanoyloxy) and a sulfonyloxy group (having up to 30 carbon atoms, preferably up to 20 carbon atoms, e.g., dodecanesulfonyloxy, 2-octyloxy-5-t-octylbenzenesulfonyloxy).

Preferred examples of substituents for A include a halogen atom, an alkoxy group, an acylamino group, a carbamoyl group, an alkyl group, a sulfonamido group and a nitro group. Unsubstituted group A is also preferred.

Preferred examples of substituents for Y include a halogen atom, an alkoxycarbonyl group, a sulfamoyl group, a carbamoyl group, a sulfonyl group, a sulfonamido group, an acylamino group, an alkoxy group, an aryloxy group, an N-acylcarbamoyl group, an N-sulfonylcarbonyl group, an N-sulfamoylcarbamoyl group, an N-sulfonylsulfamoyl group, an N-acylsulfamoyl group, an N-carbamoylsulfamoyl group and an N-(N-sulfonylcarbamoyl)sulfamoyl group.

The group represented by Z in general formula (VIII) may be any of conventional groups which can be eliminated by the coupling reaction. Preferably, Z is a nitrogen-containing heterocyclic group which is bonded to the coupling site through a nitrogen atom, an aromatic oxy group, an aromatic thio group, a heterocyclic oxy group, a heterocyclic thio group, an acyloxy group, a carbamoyloxy group, an alkylthio group or a halogen atom. These eliminable groups may be photographically useful groups or precursors thereof (e.g., development inhibitor, development accelerator, desilverization accelerator, fogging agent, dye, hardening agent, coupler, scavenger for the oxidants of developing agents, fluorescent dye, developing agent, electron transfer agent) or non-photographically useful groups.

The nitrogen-containing heterocyclic group represented by Z can be a monocyclic or fused-ring, substituted or unsubstituted heterocyclic group. Examples of suitable heterocyclic groups include succinimido, maleinimido, phthalimido, diglycolimido, pyrrolino, pyrazolyl, imidazolyl, 1,2,4-triazole-2-yl (or 4-yl), 1-tetrazolyl, indolyl, benzpyrazolyl, benzimidazolyl, benztriazolyl, imidazolidine-2,4-dione-3-yl (or 1-yl), oxazolidine-2, 4-dione-3-yl, thiazolidine-2,4-dione-3-yl, imidazoline-2-one-1-yl, oxazolidine-2-one-3-yl, thiazoline-2-one-3-yl, benzoxazoline-2-one-3-yl, 1,2,4-triazolidine-3,5-dione-4-yl, 2-pyridone-1-yl, morpholine-3,5-dione-4-yl, 1,2,3-triazole-1-yl and 2-imidazoline-5-one.

These heterocyclic groups may be substituted. Examples of substituents include those already described above in the definition of the substituents for A.

The nitrogen-containing heterocyclic group represented by Z is preferably 1-pyrazolyl, imidazolyl, 1,2,3-triazole-1-yl, benztriazolyl, 1,2,4-triazole-1-yl, oxazolidine-2,4-dione-3-yl, 1,2,4-triazolidine-3,5-dione-4-yl or imidazolidine-2,4-dione-3-yl. These groups may be substituted.

The aromatic oxy group represented by Z is preferably a substituted or unsubstituted phenoxy group. Examples of substituent for the substituted phenoxy group include those already described above in the definition of the substituents for Y. In a preferred embodiment of substituted phenoxy group, at least one substituent is an electron attracting substituent. Examples thereof include a sulfonyl group, an alkoxycarbonyl group, a sulfamoyl group, a halogen atom, a carboxyl group, a carbamoyl group, an acyl group and a nitro group.

The aromatic thio group represented by Z is preferably a substituted or unsubstituted phenylthio group. Examples of substituents for the substituted phenylthio group include those already described above in the definition of the substituents for Y. In a preferred embodiment of the substituted phenylthio group, at least one substituent is an alkyl-group, an alkoxy group, a sulfonyl group, an alkoxycarbonyl group, a sulfamoyl group, a halogen atom, a carbamoyl group or a nitro group.

When Z represents a heterocyclic oxy group, the heterocyclic ring moiety has the same meaning as that in Y.

The heterocyclic thio group represented by Z is preferably a five-membered or six-membered unsaturated heterocyclic thio group. Examples thereof include tetrazolylthio group, 1,3,4-thiadiazolylthio group, 1,3,4-oxadiazolylthio group, 1,3,4-triazolylthio group, benzimidazolylthio group, benzthiazolylthio group and 2-pyridylthio group. These groups may be substituted. Examples of substituents include those already described above in the definition of the substituents for the case where Y is a substituted heterocyclic group. Preferred examples of the substituents include an aromatic group, an alkyl group, an alkylthio group, an acylamino group, an alkoxycarbonyl group and an aryloxycarbonyl group.

The acyloxy group represented by Z is an aromatic acyloxy group (having 7 to 11 carbon atoms, preferably a benzoyloxy group) or an aliphatic acyloxy group (having 2 to 20 carbon atoms, preferably 2 to 10). These groups may be substituted. Examples of substituents include those already described above in the definition of the substituents for the case where Y is a substituted aromatic group. In the case where the acyloxy group is substituted, at least one substituent is a halogen atom, a nitro group, an aryl group, an alkyl group or an alkoxy group.

The carbamoyloxy group represented by Z is an aliphatic, aromatic or heterocyclic carbamoyloxy group having 1 to 30 carbon atoms, preferably 1 to 20 carbon atoms or an unsubstituted carbamoyloxy group. Examples of the carbamoyloxy group include N,N-diethylcarbamoyloxy, N-phenylcarbamoylmorpholinocarbonyloxy, 1-imidazolylcarbonyloxy and N,N-dimethylcarbamoyloxy. The alkyl moiety, the aromatic moiety and the heterocyclic moiety have the same meaning as those described above in connection with Y.

The alkylthio group represented by Z is an alkylthio group having 1 to 30 carbon atoms, preferably 1 to 20 carbon atoms.

Preferably, Z in general formula (VIII) is a five-membered or six-membered nitrogen-containing heterocyclic group (which is bonded to the coupling site through a nitrogen atom), an aromatic oxy group, a five-membered to six-membered heterocyclic oxy group or a five-membered or six-membered heterocyclic thio group.

Preferably, Y in general formula (VIII) is an aromatic group. Particularly preferably, Y is a phenyl group having at least one substituent at the orthoposition. Examples of substituents include those already described above in the definition of the substituents for the case where Y is a substituted aromatic group.

In the case where Y in general formula (VIII) is a phenyl group having at least one substituent at the ortho-position, particularly preferred examples of substituents at the ortho-position include a halogen atom, an alkoxy group, an alkyl group and an aryloxy group.

Of the couplers of general formula (VIII), couplers represented by the following general formula (IX) are particularly preferred.

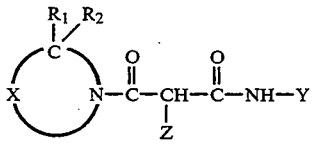

(IX)

In formula (IX), Y and Z are as defined above in general formula (VIII); $X_1$ represents an organic residue required for forming a nitrogen-containing heterocyclic ring together with $—C(R_1R_2)—N<$; and $R_1$ and $R_2$ each represents a hydrogen atom or a substituent.

The end moiety of the couplers of general formula (IX) is abbreviated to B in the following description for brevity's sake.

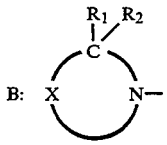

Preferred examples of Y and Z in general formula (IX) are the same as those described above in general formula (VIII).

Examples of heterocyclic groups represented by B and examples of substituents for B include those described above in the examples given for A. Preferred examples thereof are the same as those for A. Particularly preferred are cases where the nitrogen-containing heterocyclic group is a benzene-fused ring.

Of the couplers of general formula (IX), couplers represented by the following general formula (X) are even more preferred.

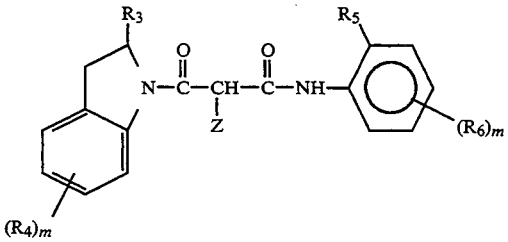

(X)

In the formula (X), $R_3$ represents a hydrogen atom or a substituent; $R_4$, $R_5$ and $R_6$ each represents a substituent; Z is as defined above in general formula (VIII); m and n each represents an integer of 0 to 4; and when m and n are each an integer of 2 or more, two or more $R_4$ or $R_6$ groups may be the same or different.

When $R_3$ and $R_4$ in general formula (X) are each a substituent, examples of substituents are the same as those described above for A. Preferred examples of $R_3$ include a hydrogen atom, an alkyl group and an aryl group. Preferred examples of $R_4$ include a halogen atom, an alkoxy group, an acylamino group, a carbamoyl group, an alkyl group, a sulfonamido group and a nitro group, and m is an integer of preferably 0 to 2, particularly preferably 0 or 1.

Examples of substituents represented by each of $R_5$ and $R_6$ in general formula (X) are the same as those for the case where Y is substituted in general formula (VIII). Preferably, $R_5$ is a halogen atom, an alkoxy group, an alkyl group or an aryloxy group. Preferred examples of $R_6$ are the same as those for the case where Y is substituted in general formula (VIII), and n is an integer of preferably 0 to 2, more preferably 1 or 2.

The couplers of general formulas (VIII), (IX) and (X) may be in the form of a dimer or a higher polymer through a bivalent or polyvalent group at the position of X, Y or Z. In this case, the number of carbon atoms may exceed the number of carbon atoms defined above in the substituent.

Examples of couplers of general formula (VIII) include, but are not limited to, the following compounds.

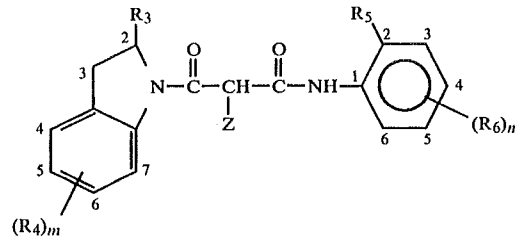

| No. | $R_3$ | m | $R_4$ | $R_5$ | n | $R_6$ | Z |
|---|---|---|---|---|---|---|---|
| 1 | H | O | — | $-OCH_3$ | 1 | $-5-SO_2NHCO\underset{\vert}{C}HC_9H_{19}$ (with $C_7H_{15}$) | 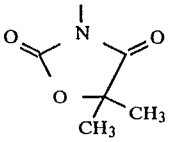 |
| 2 | " | " | — | $-OC_{18}H_{37}(n)$ | 1 | $-5-SO_2NHCO\underset{\vert}{C}HC_4H_9$ (with $C_2H_5$) | " |
| 3 | " | " | — | $-OC_{12}H_{25}(n)$ | 1 | $-5-SO_2NHCONHC_3H_7$ | " |
| 4 | " | " | — | $-OCH_2\underset{\vert}{C}H-C_8H_{17}(n)$ (with $C_6H_{13}(n)$) | 1 | $-5-SO_2NHCO\underset{\vert}{C}HC_4H_9$ (with $C_2H_5$) | " |
| 5 | " | " | — | $-O-\underset{\vert}{C}HCOOC_{12}H_{25}(n)$ (with $Ch_3$) | 1 | $-5-SO_2NHCONHC_2H_5$ | " |
| 6 | " | " | — | $-OCH_2\underset{\vert}{C}H$ (with $CH(CH_3)CH_2C(CH_3)_3$; $(CH_2)_2CH(CH_3)CH_2C(CH_3)_3$) | 1 | $-5-SO_2NHCONHC_2H_5$ | " |
| 7 | " | " | — | $-OCH_2COOCH_2\underset{\vert}{C}HC_8H_{17}$ (with $C_{10}H_{21}$) | 1 | $-5-SO_2NHCOCH_3$ | " |
| 8 | " | " | — | 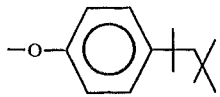 | 1 | $-5-SO_2NHCO\underset{\vert}{C}HC_4H_9$ (with $C_2H_5$) | " |

-continued
| | | | | | | | |
|---|---|---|---|---|---|---|---|
| 9 | " | " | — | 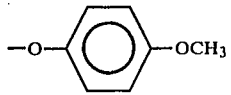 | 1 | -5-$SO_2NHCOCH(C_7H_9)-C_9H_{19}$ | " |
| 10 | " | " | — | " | 1 | -5-$CONHSO_2C_{12}H_{25}$ | " |
| 11 | " | " | — | 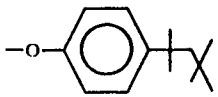 | 1 | -4-$SO_2NHCOC_9H_{19}$ | " |
| 12 | " | " | — | " | 1 | -4-Cl-5-$CONHSO_2C_{16}H_{33}$(n) | " |
| 13 | " | " | — | " | 1 | -3-Cl-5-$CONHCOC_{11}H_{23}$ | " |
| 14 | " | " | — | —$OCH_3$ | 1 | -3-Cl-5-$CONHSO_2C_{12}H_{25}$(n) | " |
| 15 | " | 0 | — | —$OC_{16}H_{33}$(n) | 1 | 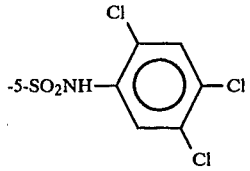 | 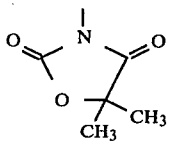 |
| 16 | " | " | — | —$OCH_2CH(C_6H_{13})C_8H_{17}$ | 1 | 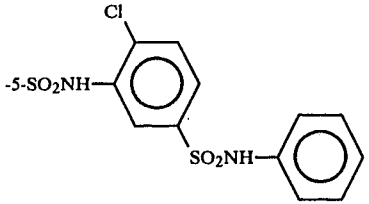 | " |
| 17 | " | " | — | —$OCH(CH_3)_2$ | 1 | 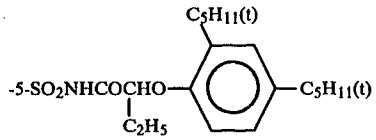 | " |
| 18 | " | " | — | —$OC_{18}H_{37}$(n) | 1 | -5-$SO_2NHSO_2CH_3$ | " |

-continued
| | | | | | | | |
|---|---|---|---|---|---|---|---|
| 19 | " | " | — | 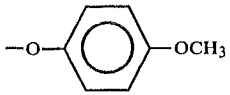 | 1 | 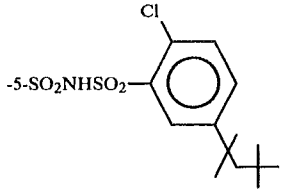 | " |
| 20 | " | " | — | $-OC_2H_5$ | 1 | " | 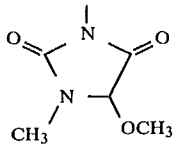 |
| 21 | " | " | — | $-OC_{18}H_{37}(n)$ | 2 | $-4-Cl-50CONHSO_2C_{12}H_{25}$ | 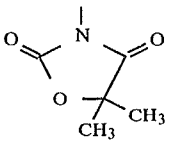 |
| 22 | " | " | — | " | 1 | 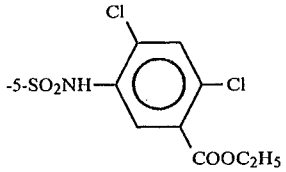 | " |
| 23 | " | " | — | 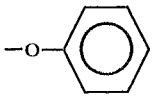 | 1 | 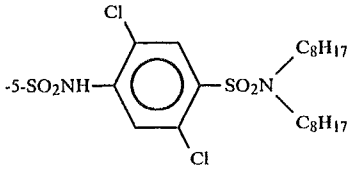 | " |

-continued
| | | | | | | | |
|---|---|---|---|---|---|---|---|
| 24 | " | " | — | $-OCH(CH_3)_2$ | 1 | 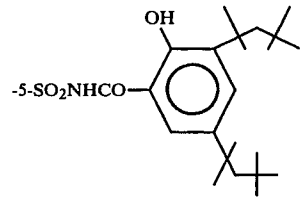 | " |
| 25 | $CH_3$ | " | — | $-OC_2H_5$ | | $-5-SO_2NHCOCH(C_7H_{15})C_9H_{19}$ | " |
| 26 | H | 0 | — | $-OC_{18}H_{37}(n)$ | 1 | 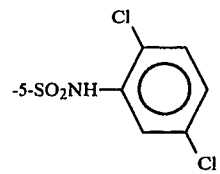 | 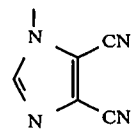 |
| 27 | " | " | — | 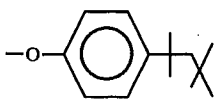 | 1 | " | 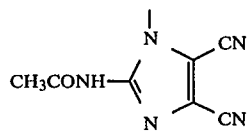 |
| 28 | " | " | — | $-OC_{16}H_{33}(n)$ | 1 | $-5-SO_2NHCOC_2H_5$ | 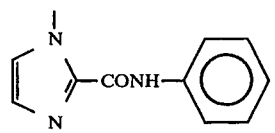 |
| 29 | " | " | — | $-Cl$ | 1 | $-5-CONHSO_2-C_{16}H_{33}(n)$ | 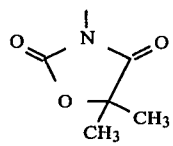 |

-continued
| | | | | | | | |
|---|---|---|---|---|---|---|---|
| 30 | " | " | — | " | 1 | -5-NHCOCH(CH$_3$)CH$_2$SO$_2$C$_{12}$H$_{25}$ | 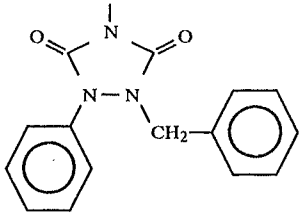 |
| 31 | " | " | — | " | 1 | 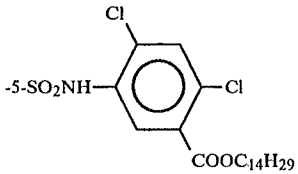 | " |
| 32 | " | " | — | " | 2 | -4-Cl-5-COOC$_{12}$H$_{25}$ | 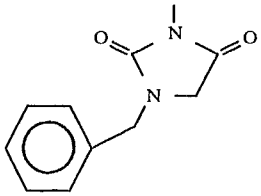 |
| 33 | " | " | — | " | 2 | 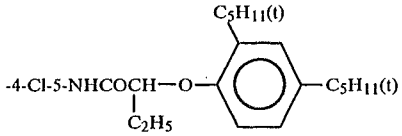 | 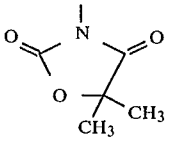 |
| 34 | " | " | — | " | 1 | -5-SO$_2$NHC$_{12}$H$_{25}$ | " |
| 35 | " | " | — | " | 1 | -5-SO$_2$NHSO$_2$C$_{16}$H$_{33}$(n) | 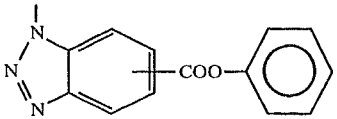 |

-continued
| | | | | | | | |
|---|---|---|---|---|---|---|---|
| 36 | " | 1 | 5-$NO_2$ | " | 1 | 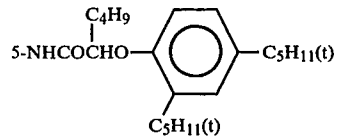 | 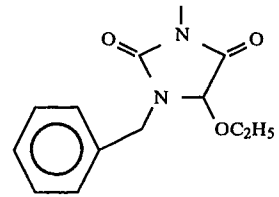 |
| 37 | H | 2 | 5,7-Br | " | 1 | -5-$NHSO_2C_{16}H_{33}$(n) | " |
| 38 | " | " | — | —$OC_{18}H_{37}$(n) | 1 | 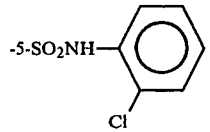 | 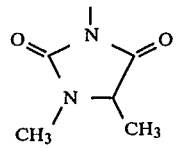 |
| 39 | " | " | — | " | 1 | " | 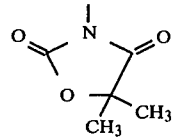 |
| 40 | " | " | — | —$OCH_2CH(C_8H_{17})C_{10}H_{21}$ | 1 | 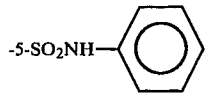 | " |
| 41 | H | 1 | 5-Cl | —Cl | 1 | -5-$SO_2C_{16}H_{33}$ | 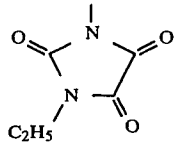 |
| 42 | 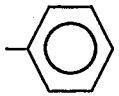 | " | 5-$NO_2$ | —$OC_{14}H_{29}$ | 1 | 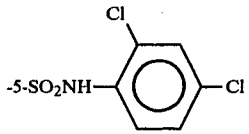 | 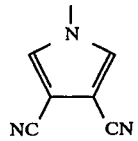 |

-continued
| | | | | | | | |
|---|---|---|---|---|---|---|---|
| 43 | H | " | 5-Br | —Cl | 1 | -5-COOCH(CH$_3$)—COOC$_{12}$H$_{25}$ | 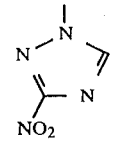 |
| 44 | " | " | " | " | 1 | " | 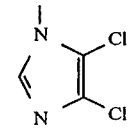 |
| 45 | " | " | 5-Cl | " | 1 | -5-NHSO$_2$C$_{12}$H$_{25}$ | 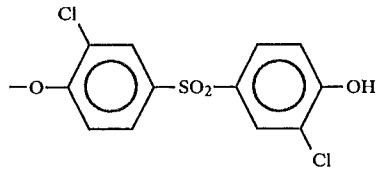 |
| 46 | " | " | 5-NO$_2$ | " | 1 | " | 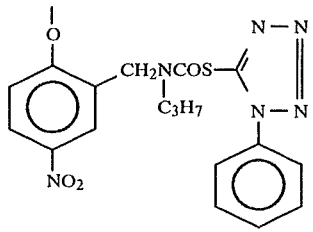 |
| 47 | H | 0 | — | " | 1 | 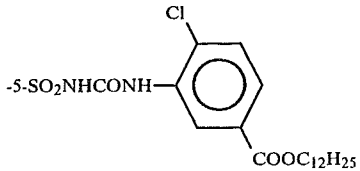 | 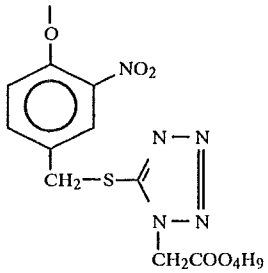 |

-continued
| | | | | | | | |
|---|---|---|---|---|---|---|---|
| 48 | " | 1 | 5-$OCH_3$ | " | 2 | -4-Cl-5-$COOC_{12}H_{25}$ | 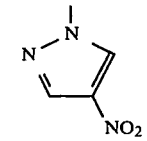 |
| 49 | " | " | 5-$NO_2$ | —$CF_3$ | 1 | 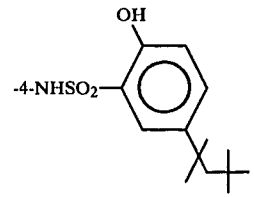 | 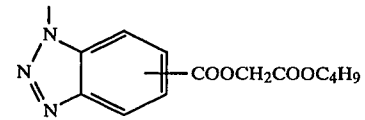 |
| 50 | " | " | — | —$OC_2H_5$ | | -5-$SO_2C_{12}H_{25}$ | 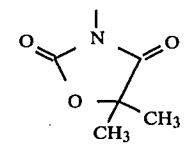 |
| 51 | " | " | — | —Cl | | 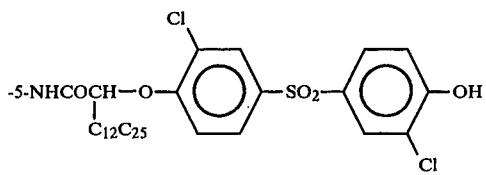 | " |
| 52 | $C_2H_5$ | " | — | " | 1 | 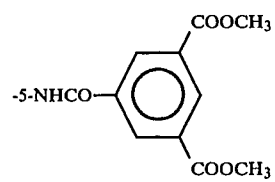 | 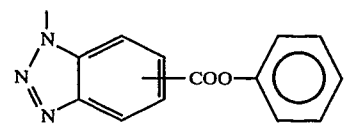 |

-continued
| | | | | | | | |
|---|---|---|---|---|---|---|---|
| 53 | H | " | — | " | 1 | 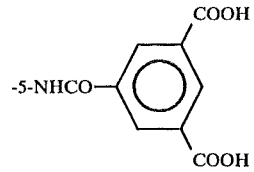 | 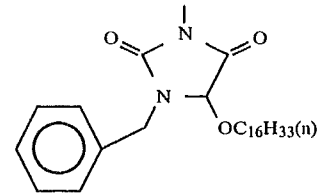 |
| 54 | " | " | — | Cl | 1 | $-5-SO_2NHCOC_{11}H_{23}$ | 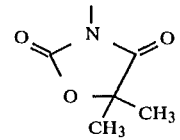 |
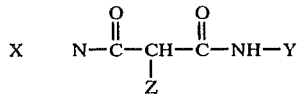
| No. | X | N— | Y | Z |
|---|---|---|---|---|
| 55 | 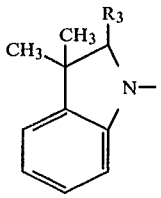 | | 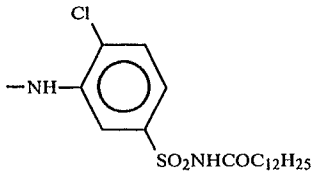 | 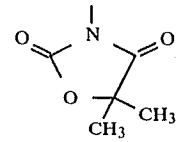 |
| 56 | 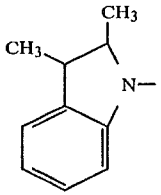 | | 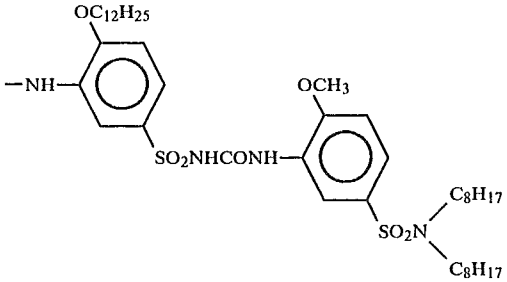 | " |

-continued
| | | | |
|---|---|---|---|
| 57 | 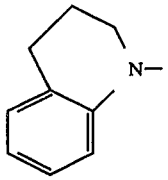 | 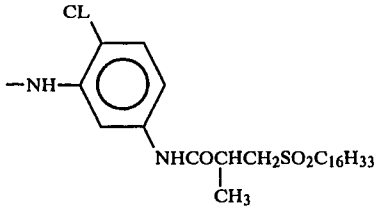 | 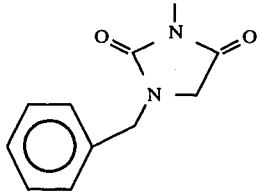 |
| 58 | 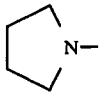 | 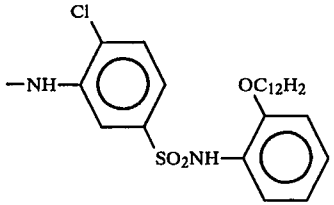 | 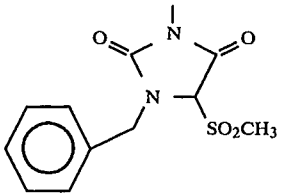 |
| 59 | 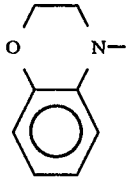 | 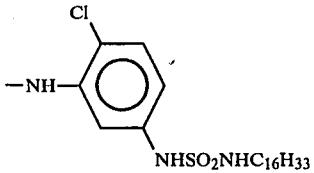 | 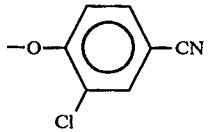 |
| 60 | 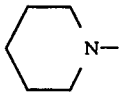 | 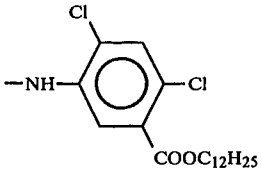 | 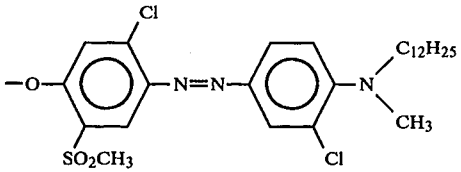 |
| 61 | 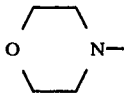 | 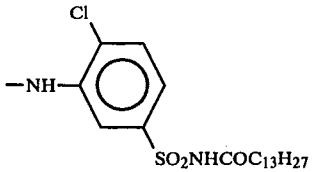 | 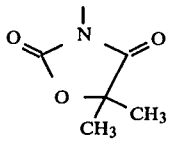 |

-continued
| | | | |
|---|---|---|---|
| 62 | 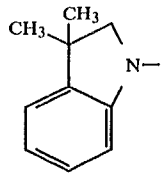 | 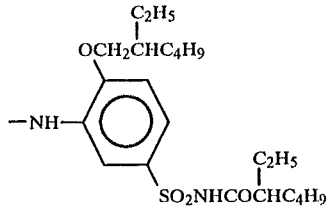 | $SCH_3COOH$ |
| 63 | 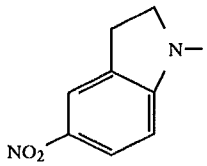 | " | 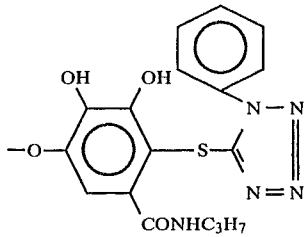 |
| 64 | " | " | 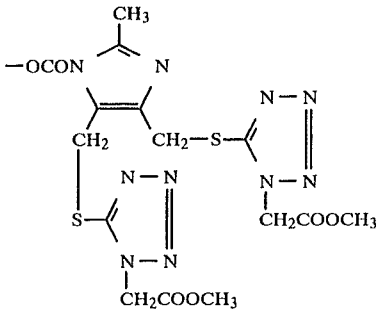 |
| 65 | 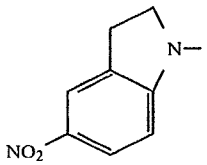 | 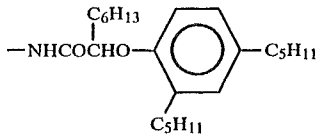 | 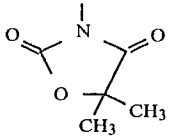 |

-continued
66
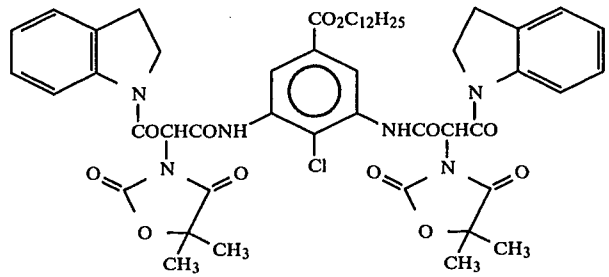
67
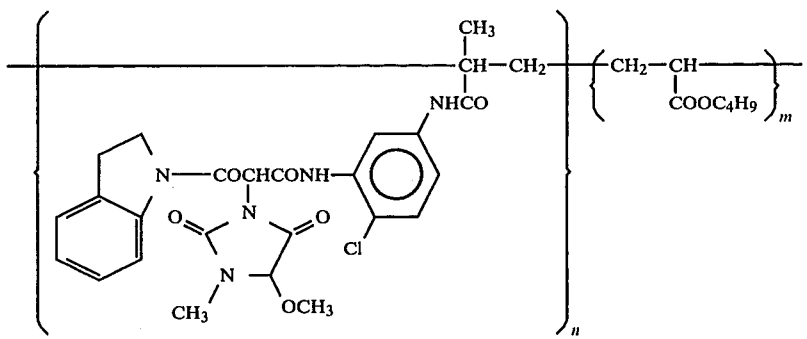
n/m = 50/50 (by weight)
Average MW 25,000

Particularly preferred yellow couplers are Compounds (1), (2), (8), (16), (25), (37) and (64) for use in the present invention.

The amount of the yellow couplers present in the light-sensitive materials can vary depending on the performance required, but is generally in the range of preferably $1.0\times10^{-4}$ to $1.0\times10^{-2}$ mol/m$^2$, more preferably $3.0\times10^{-4}$ to $5.0\times10^{-3}$ mol/m$^2$.

The yellow couplers used in the present invention can be synthesized by conventional methods or similar methods thereto.

For example, the yellow couplers of general formula (VIII) can be synthesized according to the following synthesis route.

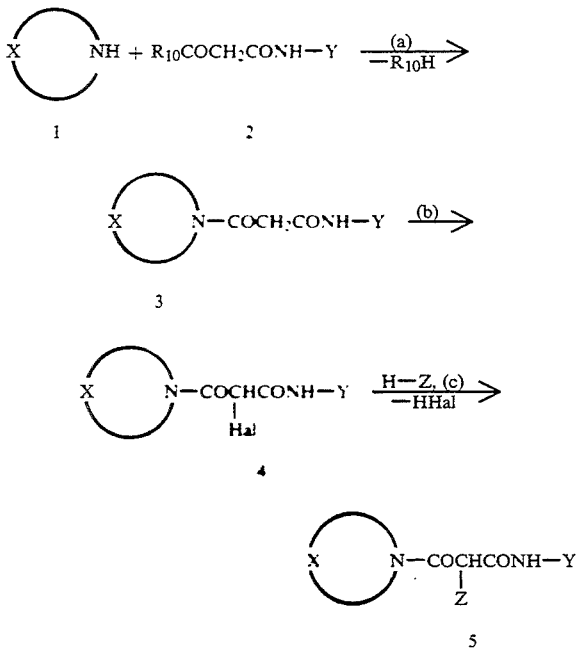

Compound of Formula (VIII)

wherein X, Y and Z are as defined above in general formula (VIII); $R_{10}$ represents a halogen atom (e.g., chlorine atom), —OH, an alkoxy group (e.g., methoxy, ethoxy) or a phenoxy group (e.g., phenoxy, 4-nitrophenoxy); and Hal represents a halogen atom. The reaction in the step (a) is carried out under reaction conditions such that when $R_{10}$ is OH, the reaction is carried out in the presence of a dehydration condensing agent (e.g., N,N-dicyclohexylcarbodiimide, N,N-diisopropylcarbodiimide) and that when $R_{10}$ is a halogen atom, the reaction is carried out in the presence of a dehydrohalogenation agent, Examples of dehydrohalogenation agents include organic bases (e.g., triethylamine, diisopropylethylamine, pyridine, guanidine, butoxypotassium) and inorganic bases (e.g., sodium hydroxide, potassium hydroxide, sodium hydride, potassium carbonate). In the reaction (b) of 3→4, a halogenating agent is used. Examples of halogenating agents include bromine, chlorine, N-bromosuccinimide and N-chlorosuccinimide. In the reaction (c) of 4→ the final product, a dehydrohalogenation agent is generally used. Examples of dehydrohalogenation agents include the above-described organic and inorganic bases. These reactions are generally carried out in a solvent. Examples of suitable solvents include chlorine-containing solvents (e.g., dichloromethylene), aromatic solvents (e.g., benzene, chlorobenzene, toluene), amide solvents (e.g., N,N-dimethylformamide, N,N-dimethylacetamide, N-methylpyrrolidone), nitrile solvents (e.g., acetonitrile, propionitrile), ether solvents (e.g., tetrahydrofuran, ethylene glycol diethyl ether), sulfone solvents (e.g., dimethylsulfone, sulfolane) and hydrocarbon solvents (e.g., cyclohexane, n-hexane).

The yellow couplers used in the present invention can be synthesized by other routes such as the method described in *J. Org. Chem.*, 29, 2932 (1964) in addition to the above-described synthesis route. If desired, the product 5 is subjected to a functional group exchange reaction to obtain another desired product. The modification of the synthesis route or an additional reaction can be appropriately made by those skilled in the art.

The synthesis method used the yellow coupler of the present invention will be illustrated below. However, it should be understood that other yellow couplers can be synthesized in a similar manner to that described below.

SYNTHESIS EXAMPLE 3

Synthesis of Compound No. 53 used in the Invention

Compound No. 53 was prepared by the following synthesis route.

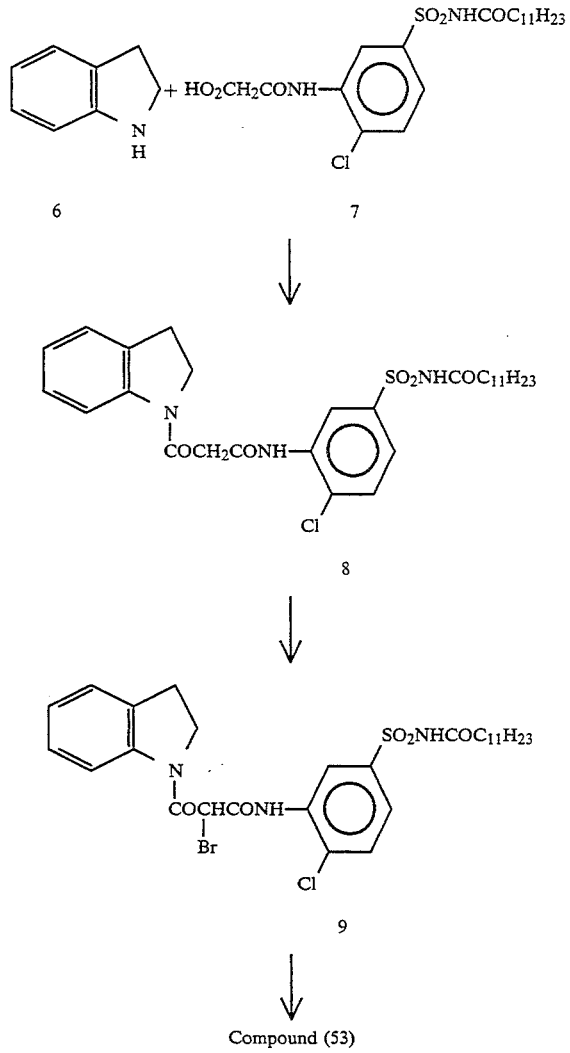

Compound (53)

In 100 ml of N,N-dimethylformamide and 100 ml of acetonitrile were dissolved 3.5 g of Compound (6) and 14 g of Compound (7). To the resulting solution, there was added dropwise 40 ml of an acetonitrile solution of 6 g of N,N'-dicyclohexylcarbodiimide at room temperature. The mixture was reacted for 2 hours, and the precipitated N,N'-dicyclohexylurea was separated by filtration. The resulting filtrate was poured into 500 ml of water and then extracted with 500 ml of ethyl acetate. The oily layer was recovered by using a separatory funnel, washed with water and dried over sodium sulfate. The solvent was distilled off under reduced pressure. The residue was crystallized from hexane to obtain 17.2 g of Compound (8).

16 g of Compound (8) was mixed with 160 ml of dichioromethane. A solution of 4.8 g of bromine in 10 ml of dichloromethane was added dropwise to the mixture while cooling with ice (5° to 10° C.). The mixture was reacted for 10 minutes. The reaction mixture was then transferred to a separatory funnel and washed with water. The oily layer (a solution containing Compound (9)) was removed and as such was used in the subsequent stage.

To 160 ml of N,N-dimethylformamide, there were added 8.1 g of 5,5-dimethyl-2,4-dioxo-1,3-oxazoline and 8.8 ml of triethylamine. To the resulting solution, there was added dropwise the dichloromethane solution of Compound (9) obtained above at room temperature. After the mixture was reacted for one hour, 500 ml of ethyl acetate was added thereto. The mixture was transferred to a separatory funnel, washed with water, neutralized with dilute hydrochloric acid and again washed with water. The oily layer was separated. The solvent was distilled off under reduced pressure. The residue was purified by means of silica gel column chromatography, eluting with ethyl acetate/hexane (1/1) by volume. Fractions containing the desired Compound (53) was collected, and the solvent was distilled off. 15.2 g of the desired Compound (53) was obtained as a waxy material.

SYNTHESIS EXAMPLE 4

Synthesis of Compound (2) Used in the Invention

The procedure of Synthesis Example 3 was repeated except that an equimolar amount of the following Compound (10) was used in place of Compound (7),

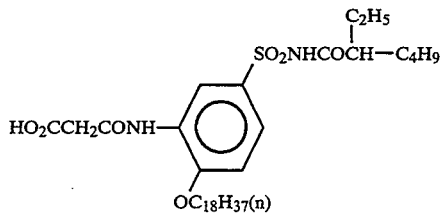

The final product was purified by means of column chromatography. 18.3 g of the desired Compound (2) was obtained as a waxy material.

The hydrophilic colloid layers of the light-sensitive materials of the present invention preferably contain antifungal agents as described in JP-A-63-271247 to prevent images from being deteriorated by the growth of mold and bacteria.

Supports for display which can be used in the light-sensitive materials of the present invention include white polyester supports and supports provided with a white pigment-containing layer on the silver halide emulsion layer side thereof. It is preferred that an anti-halation layer is present on the silver halide emulsion-coated side of the support or on the back side thereof to improve sharpness. It is particularly preferred for the transmission density of the support to be in the range of 0.35 to 0.8.

The light-sensitive materials of the present invention may be exposed to visible light or infrared light. Any of low-illumination exposure and high-illumination short-time exposure may be used as exposure method. In the latter case in particular, laser scanning exposure system wherein the exposure time per pixel is shorter than $10^{-4}$ seconds is preferred.

It is also preferred that a band stop filter described in U.S. Pat. No. 4,880,726 is used in carrying out exposure, whereby color mixing of light can be eliminated and color reproducibility can be greatly improved.

The exposed light-sensitive materials are then subjected to color development. It is preferred that after color development, bleaching-fixing is carried out to effect rapid processing. Particularly, when the above-mentioned high silver chloride emulsions are used, the pH of the bleaching-fixing solution is preferably not higher than about 6.5, more preferably not higher than about 6.0 to accelerate desilverizationo Silver halide emulsions, other materials (e.g., additives), photographic layers (e.g., the arrangement of the layers), methods for processing light-sensitive materials and processing additives are described in the following patent specifications, particularly European Patent EP0,355,660A2 (JP-A-2-139544) and these can be advantageously applied to the light-sensitive materials of the present invention.

| Photographic Element, etc. | JP-A-62-215272 | JP-A-2-33144 | EP0,355,660A2 |
|---|---|---|---|
| Silver Halide Emulsion | Line 6 of right upper column of page 10 to line 5 of left lower column of page 12; and the 4th line from the bottom of right lower column of page 12 to line 17 of left upper column of page 13 | Line 16 of right upper column of page 28 to line 11 of right lower column of page 29; and line 2 to line 5 of light upper column of page 30 | Line 53 of page 46 to line 3 of page 47; ana line 20 to line 22 of page 47 |
| Solvent for Silver Halide | Line 6 to line 14 of left lower column of page 12; and the third line from | — | — |

-continued

| Photographic Element, etc. | JP-A-62-215272 | JP-A-2-33144 | EP0,355,660A2 |
|---|---|---|---|
| | the bottom of left upper column of page 13 to the bottom of left lower column of page 18 | | |
| Chemical Sensitizing Agent | The third line from the bottom of left lower column of page 12 to the 5th line from the bottom of right lower column of page 12; and line 1 of right lower column of page 18 to the 9th line from the bottom of right upper column of page 22 | Line 12 to the bottom of right lower column of page 29 | Line 4 to line 9 of page 47 |
| Spectral Sensitizing Agent (spectral sensitization method) | The 8th line from the bottom of right upper column of page 22 to the bottom of page 38 | Line 1 to line 13 of left upper column of page 30 | Line 10 to line 15 of page 47 |
| Emulsion Stabilizer | Line 1 of left upper column of page 39 to the bottom of right upper column of page 72 | Line 14 of left upper column to line 1 of right upper column of page 30 | Line 16 to line 19 of page 47 |
| Development Accelerator | Line 1 of left lower column of page 72 to line 3 of right upper column of page 91 | — | — |
| Color Coupler (cyan, magenta and yellow couplers) | Line 4 of right upper column of page 91 to line 6 of left upper column of page 121 | Line 14 of right upper column of page 3 to the bottom of left upper column of page 18; and line 6 of right upper column of page 30 to line 11 of right lower column of page 35 | Line 15 to line 27 of page 4; line 30 of page 5 to the bottom of page 28; line 29 to line 31 of page 45; and line 23 of page 47 to line 50 of page 63 |
| Supersensitizing Agent | Line 7 of left upper column of page 121 to line 1 of right upper column of page 125 | — | — |
| Ultraviolet Light Absorber | Line 2 of right upper column of page 125 to the bottom of left lower column of page 127 | Line 14 of right lower column of page 37 to line 11 of left upper column of page 38 | Line 22 to line 31 of page 65 |
| Anti-Fading Agent (image stal)ilizer) | Line 1 of right lower column of page 127 to line 8 of left lower column of page 137 | Line 12 of right upper column of page 36 to line 19 of left upper column of page 37 | Line 30 of page 4 to line 23 of page 5; line 1 of page 29 to line 25 of page 45; line 33 to line 40 of page 45; and line 2 to line 21 of page 65 |
| High-Boiling and/or Low-Boiling organic Solvent | Line 9 of left lower column of page 137 to the bottom of right upper column of page 144 | Line 14 of right lower column of page 35 to the 4th line from the bottom of left upper column of page 36 | Line 1 to line 51 of page 64 |
| Dispersion method for Photographic Additive | Line 1 of left lower column of page 144 to line 7 of right upper column of page 146 | Line 10 of right lower column of page 27 to the bottom of left upper column of page 28; and line 12 of right lower column of page 35 to line 7 of right upper column of page 36 | Line 51 of page 63 to line 56 of page 64 |
| Hardening Agent | Line 8 of right upper column of page 146 to line 4 of left lower column of page 155 | — | — |
| Developing Agent Precursor | Line 5 of left lower column of page 155 to line 2 of right lower column of page 155 | — | — |
| Development-inhibitor Releasing Compound | Line 3 to line 6 of right lower column of page 155 | — | — |
| Support | Line 19 of right lower column of page 155 to line 14 of left upper column of page 156 | Line 18 of right upper column of page 38 to line 3 of left upper column of page 39 | Line 29 of page 66 to line 13 of page 67 |
| Structure of Light-Sensitive Material | Line 15 of left upper column of page 156 to line 14 of right lower column of page 156 | Line 1 to line 15 of right upper column of page 28 | Line 41 to line 52 of page 45 |
| Dye | Line 15 of right lower | Line 12 of left upper | Line 18 to line 22 of |

-continued

| Photographic Element, etc. | JP-A-62-215272 | JP-A-2-33144 | EP0,355,660A2 |
|---|---|---|---|
| | column of page 156 to the bottom of right lower column of page 184 | column to line 7 of right upper column of page 38 | page 66 |
| Color Mixing Inhibitor | Line 1 of left upper column of page 185 to line 3 of right lower column of page 188 | Line 8 to line 11 of right upper column of page 36 | Line 57 of page 64 to line 1 of page 65 |
| Gradation Controller | Line 4 to line 8 of right lower column of page 188 | — | — |
| Stain Inhibitor | Line 9 of right lower column of page 188 to line 10 of right lower column of page 193 | The bottom of left upper column of page 37 to line 13 of right lower column of page 37 | Line 32 of page 65 to line 17 of page 66 |
| Surfactant | Line 1 of left lower column of page 201 to the bottom of right upper column of page 210 | Line 1 of right upper column of page 18 to the bottom of right lower column of page 24; and the 10th line from the bottom of left lower column to line 9 of right lower column of page 27 | — |
| Fluorine-Containing Compound (antistatic agent, coating aid, lubricant, anti-sticking agent, etc.) | Line 1 of left lower column of page 210 to line 5 of left lower column of page 222 | Line 1 of left upper column of page 25 to line 9 of right lower column of page 27 | — |
| Binder (hydrophilic colloid) | Line 6 of left lower column of page 222 to the bottom of left upper column of page 225 | Line 8 to line 18 of right upper column of page 38 | Line 23 to line 28 of page 66 |
| Thickener | Line 1 of right upper column of page 225 to line 2 of right upper column of page 227 | — | — |
| Antistatic Agent | Line 3 of right upper column of page 227 to line 1 of left upper column of page 230 | — | — |
| Polymer Latex | Line 2 of left upper column of page 230 to the bottom of page 239 | — | |
| Matting Agent | Line 1 of left upper column of page 240 to the bottom of right upper column of page 240 | — | — |
| Photographic Processing Method (processing stage, additive, etc.) | Line 7 of right upper column of page 3 to line 5 of right upper column of page 10 | Line 4 of left upper column of page 39 to the bottom of left upper column of page 42 | Line 14 of page 67 to line 28 of page 69 |

Note:
The references to JP-A-62-215272 include the amendment dated March 16, 1987, attached to the end of publication.
Among the above color couplers, short wave type yellow couplers described in JP-A-63-231451, JP-A-63-123047, JP-A-63-241547, JP-A-1-173499, JP-A-1-213648 and JP-A-1-250944 can be advantageously used as yellow couplers.

It is preferred for the color photographic materials of the present invention to be subjected to color development, bleaching-fixing and rinsing (or stabilization). Bleaching and fixing may be separately carried out or by conducting them using one bath as described above.

Conventional color developing agents can be used in the present invention. Typical examples thereof include, but are not limited to, the following compounds.

D-1 4-Amino-N-ethyl-N-(B-hydroxyethyl)-3-methylaniline D-2 4-Amino-N-ethyl-N-(B-hydroxypropyl)-3-methylaniline D-3 4-Amino-N-ethyl-N-(B-hydroxybutyl)-3-methylaniline D-4 4-Amino-N-ethyl-N-(B-methanesulfonamidoethyl)-3-methylaniline D-5 4-Amino-N-(3-carbamoylpropyl-N-n-propyl)-3-methylaniline Of them, Compounds D-3 and D-4 are particularly preferred. Such developing agents are effective in carrying out a replenishment system as in the present invention. These p-phenylenediamine derivatives may be used in the form of a salt such as the sulfate, hydrochloride, sulfite, naphthalenedisulfonate or p-toluenesulfonate. The aromatic primary amine developing agents are used in an amount of preferably 0.002 to 0.2 mol, more preferably 0.005 to 0.1 mol per liter of the developing solution as the tank solution.

In the practice of the present invention, it is preferred for the developing solutions to contain substantially no benzyl alcohol. The term "containing substantially no benzyl alcohol" as used herein means the concentration of the benzyl alcohol is preferably not higher than 2 ml/l, more preferably not higher than 0.5 ml/l. Most preferably, the developing solutions are completely free of benzyl alcohol.

It is more preferred that the developing solutions or replenishers thereof which are used in the present invention to contain substantially no sulfite ion. Sulfite ion a functions as a preservative for the developing agents and has an effect of dissolving silver halide and an effect of reacting with the oxidation product of the developing agents and reducing a dye-forming efficiency. It is believed that these effects causes an increase in the fluctuation of photographic characteristics in continuous processing. The term "contain substantially no sulfite ion" as used herein means that the concentration of the sulfite ion is preferably not higher than 0.10 mol per mol of the developing agent. Most preferably, the developing solutions or the replenishers are completely free of sulfite ion. A very small amount of sulfite ion is present in a processing agent kit containing a concentrated developing agent before the preparation of a working solution to prevent the processing agent from being oxidized. Such a very small amount of sulfite ion is excluded from the above-described amount of sulfite ion.

It is more preferred that the developing solutions of the present invention contain substantially no hydroxylamine in addition to the developing solutions containing substantially no sulfite ion. This is because it is believed that hydroxylamine functions as a preservative for the developing solutions, hydroxylamine itself has silver development activity and photographic characteristics are greatly affected by the change of the concentration of hydroxylamine. The term "contains substantially no hydroxylamine" as used herein means that the concentration of hydroxylamine is preferably not higher than $5.0\times10^{-3}$ mol/l. Most preferably, the developing solutions are completely free of hydroxylamine.

It is preferred for the color developing solutions of the present invention and the replenishers thereof to contain organic preservatives in place of hydroxylamine and sulfite ion.

The term "organic preservative" as used herein refers to those organic compounds capable .of reducing the deterioration rate of the aromatic primary amine color developing agents when added to the processing solutions for the color photographic materials. Namely, organic preservatives are organic compounds capable of preventing the color developing agents from being oxidized by air, etc. Among them, particularly effective organic preservatives include hydroxylamine derivatives (excluding hydroxylamine; the same applies herein below), hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamide compounds and condensed cyclic amines. These compounds are described in JP-A-63-4235, JP-A-63-30845, JP-A-63-21647, JP-A-63-44655, JP-A-63-53551, JP-A-63-43140, JP- A-63-56654, JP-A-63-58346, JP-A-63-43138, JP-A-63-146041, JP-A-63-44657, JP-A-63-44655, U.S. Pat. Nos. 3,615,503 and 2,494,903. JP-A-52-143020 and JP-B-48-30496.

Examples of other preservatives which can be optionally used in the present invention include metals described in JP-A-57-44148 and JP-A-57-53749; salicylic acid compounds described in JP-A-59-180588; alkanolamines described in JP-A-54-3532; polyethyleneimines described in JP-A-56-94349; and aromatic polyhydroxy compounds described in U.S. Pat. No. 3,746,544. Particularly preferred are alkanolamines such as triethanolamine, dialkylhydroxylamines such as diethylhydroxylamine, hydrazine derivatives, and aromatic polyhydroxy compounds.

Of these organic preservatives, hydroxylamine derivatives and hydrazine derivatives (hydrazines and hydrazides) are particularly preferred. The details of these compounds are described in JP-A-1-97953, JP-A-1-186930, JP-A-1-186940 and JP-A-1-187557.

It is preferred from the viewpoint of improving the stability of the color developing solutions and in turn improving stability during continuous processing for the hydroxylamine derivatives or the hydrazine derivatives to be used in combination with amines.

Examples of suitable amines include cyclic amines described in JP-A-63-239447, amines described in JP-A-63-128340 and amines described in JP-A-1-186939 and JP-A-1-187557.

The hydroxylamine derivatives which can be advantageously used in the present invention are compounds represented by the following general formula (XI).

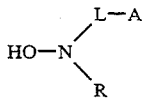

(XI)

In the formula (XI), L represents an alkylene group which may be substituted; A represents a carboxyl group, a sulfo group, a phosphono group, a phosphino group, a hydroxyl group, an amino group which may be substituted by one or more alkyl groups, an ammonio group which may be substituted by one or more alkyl groups, a carbamoyl group which may be substituted by one or more alkyl groups, a sulfamoyl group which may be substituted by one or more alkyl groups or an alkylsulfonyl group which may be substituted; and R represents a hydrogen atom or an alkyl group which may be substituted.

Specific examples of hydroxylamine derivatives which can be used in the present invention include, but are not limited to, the following compounds.

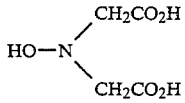

(XI-1)

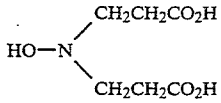

(XI-2)

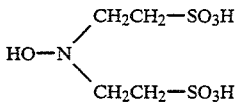

(XI-3)

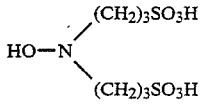

(XI-4)

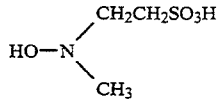

(XI-5)

Examples of the sulfinic acids and salts thereof which can be used in the present invention include the following compounds.

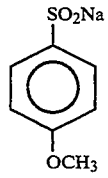

(S-1)

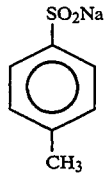

(S-2)

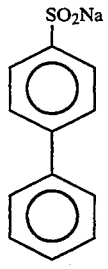

(S-3)

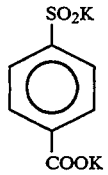

(S-4)

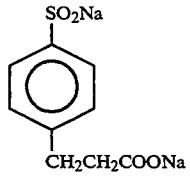

(S-5)

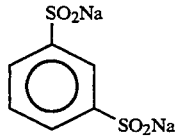

(S-6)

These compounds may be used either alone or as a mixture of two or more of them.

The above-described sulfinic acids can be synthesized using the method described in JP-A-62-143048 or by referring to this method.

The sulfinic acids are used in an amount of 0.001 to 1.0 mol/l, preferably 0.002 to 0.2 mol/l.

It is preferred that the color developing solutions of the present invention contain chloride ion in an amount of $3.5\times10^{-3}$ to $3.0\times10^{-1}$ mol/l, particularly preferably $1\times10^{-2}$ to $2\times10^{-1}$ mol/l. When the concentration of chloride ion is higher than $3.0\times10^{-1}$ mol/l, there is a disadvantage that development is retarded, and rapid processing and high maximum density which are the objects of present invention can not be achieved, while when the concentration is lower than $3.5\times10^{-3}$ mol/l, fogging tends to occur.

Further, it is preferred for the color developing solutions of the present invention to contain bromide ion in an amount of $0.5\times10^{-5}$ to $1.0\times10^{-3}$ mol/l, more preferably $3.0\times10^{-5}$ to $5\times10^{-4}$ mol/l. When the concentration of bromide ion is higher than $1\times10^{-3}$ mol/l, development is retarded, and maximum density and sensitivity are lowered, while if the concentration is lower than $0.5\times10^{-5}$ mol/l, fogging can not be sufficiently prevented.

Chloride ion and bromide ion may be directly added to the developing solutions, or may be dissolved out from the light-sensitive materials into the developing solutions during the course of development.

When chloride ion is directly added to the color developing solutions, examples of chloride ion supply materials include sodium chloride, potassium chloride, ammonium chloride, lithium chloride, nickel chloride, magnesium chloride, manganese chloride, calcium chloride and cadmium chloride. Among them, sodium chloride and potassium chloride are preferred.

Chloride ion may be fed from fluorescent brighteners present in the developing solutions.

Examples of bromide ion supply materials include sodium bromide, potassium bromide, ammonium bromide, lithium bromide, calcium bromide, magnesium bromide, manganese bromide, nickel bromide, cadmium bromide, cerium bromide and thallium bromide. Of these compounds, potassium bromide and sodium bromide are preferred.

When chloride ion and bromide ion are to be dissolved out from the light-sensitive materials during the course of development, both chloride ion and bromide ion may be supplied from the emulsions or other sources.

The color developing solutions used in the present invention have a pH of preferably 9 to 12, more preferably 9 to 11.0. The color developing solutions of the present invention may contain other compounds which are present in conventional developing solutions.

It is preferred for buffering agents, to be used to keep the above pH value. Examples of suitable buffering agents include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrate salts, 2-amino-2-methyl-1,3-propanediol salts, valine salts, proline salts, trishydoxyaminomethane salts and lysine salts. Of them, there are particularly preferred carbonates, phosphates, tetraborates and hydroxybenzoates because they have excellent solubility and buffer capacity in a high pH region of not lower than 9.0 and do not adversely effect (e.g., fog) photographic performance when added to the color developing solutions. In addition, they have advantage that they are inexpensive.

Specific examples of buffering agents include, but are not limited to, sodium carbonate, potassium carbonate, sodium bicarbonate, potassium bicarbonate, trisodium phosphate, tripotassium phosphate, disodium hydrogenphosphate, dipotassium hydrogenphosphate, sodium borate, potassium borate, sodium tetraborate (borax), potassium tetraborate, sodium o-hydroxybenzoate (sodium salicylate), potassium o-hydroxybenzoate, sodium sulfo-2-hydroxybenzoate (sodium 5-sulfosalicylate) and potassium 5-sulfo-2-hydroxybenzoate (potassium sulfosalicylate).

The amount of buffering agent to present in the color developing solution or the replenisher thereof is preferably not more than 0.1 mol/l, particularly preferably 0.1 to 0.4 mol/l.

The color developing solution may contain various chelating agents as suspending agents for calcium or magnesium or to improve the stability of the color developing agents. Examples of suitable chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethytenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,1-hydroxybenzene-4,6-disulfonic acid.

These chelating agents may be used alone or as a combination of two or more thereof. These chelating agents may be used in an amount sufficient to sequester metal ions in the color developing solutions. The chelating agents are generally used in an amount of 0.1 to 10 g per liter of the color developing solution.

The color developing solutions may optionally contain development accelerators. Examples of suitable development accelerators include thioether compounds described in JP-B-37-16088, JP-B-37-5987, JP-B-38-7826, JP-B-44-12380, JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; and 1-phenyl-3-pyrazolidones, imidazoles and ascorbic acid.

Anti-fogging agents may optionally be added to the replenishers. Anti-fogging agents include alkali metal halides such as sodium chloride, potassium bromide and potassium iodide and organic anti-fogging agents. Typical examples of organic anti-fogging agents include nitrogen-containing heterocyclic compounds such as benztriazole, 6-nitrobenzimidazole, 5-nitroisoimidazole, 5-methylbenztriazole, 5-nitrobenztriazole, 5-chlorobenztriazole, 2-thiazolyl-benzimidazole, 2-thiazolylmethylbenzimidazole, indazole, hydroxyazaindolizine and adenine.

It is preferred for the color developing solutions of the present invention to contain fluorescent brighteners. Preferred examples of fluorescent brighteners include 4,4'-diamino-2,2'-disulfostilbene compounds. The fluorescent brighteners are used in an amount of 0 to 5 g/l, preferably 0.1 to 4 g/l.

If desired, conventional water-soluble polymers such as polyvinyl alcohol, polyacrylic acid, polystyrenesulfonic acid, polyvinyl pyrrolidone or copolymers thereof or surfactants such as alkylsulfonic acids, arylsulfonic acids, aliphatic carboxylic acids, aromatic carboxylic acids and polyethylene oxide may be optionally added.

The processing temperature of the color development is 20° to 50° C., preferably 30° to 45° C. The processing time is 5 to 120 seconds, preferably 10 to 60 seconds. A low replenishment rate is preferable. The replenishment rate is usually 20 to 60 ml, preferably not more than 120 ml per $m^2$ of the light-sensitive material. The replenishment rate of 60 ml per $m^2$ of the light-sensitive material is more preferred from the standpoint of obtaining the effect of the present invention.

In the color development of the present invention, a lower solution opening ratio (contact area ($cm^2$) with air/volume ($cm^3$) of solution) results in a more excellent performance. A solution opening ratio of 0 to 0.1 $cm^{-1}$ is preferred from the viewpoint of color developing solution stability. In continuous processing, the solution opening ratio is practically in the range of preferably 0.001 to 0.05 $cm^{-1}$, more preferably 0.002 to 0.03 $cm^{-1}$.

The desilvering stage of the present invention is illustrated below.

Generally, any of the bleaching stage-fixing stage; fixing stage-bleaching-fixing stage; bleaching stage-bleaching-fixing stage; and bleaching-fixing stage may be used in the desilvering stage.

Bleaching solutions, bleaching-fixing solutions and fixing solutions which can be used in the present invention are illustrated below.

Any of the conventional bleaching agents can be used in the bleaching solutions and in the bleaching-fixing solutions. Particularly, organic complex salts of iron (III) (e.g., iron(III) complex salts of aminopolycarboxylic acids such as ethylenediaminetetraacetic acid and diethylenetriaminepentaacetic acid, aminopolyphosphonic acids, phosphonocarboxylic acids and organic phosphonic acids), organic acids such as citric acid, tartaric acid and malic acid; persulfates; and hydrogen peroxide are preferred.

Of them, organic complex salts of iron(III) are particularly preferred from the standpoints of rapid processing and prevention of environmental pollution. Examples of useful aminopolycarboxylic acids, aminopolyphosphonic acids, organic phosphonic acids and salts thereof which can be used in the formation of the organic complex salts of iron(III) include ethylenediaminetetraacetic acid, diethylenetriaminepentaacetic acid, 1,3-diaminopropanetetraacetic acid, propanediaminetetraacetic acid, nitrilotriacetic acid, cyclohexanediaminetetraacetic acid, methyliminodiacetic acid and glycol ether diaminetetraacetic acid. These compounds may be in the form of a salt such as the sodium, potassium, lithium or ammonium salt. Of these compounds, iron(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred from the standpoint of high bleaching power. The iron(III) complex salts of these compounds may be used in the form of a complex salt itself. Alternatively, the chelating agents such as the aminopolycarboxylic acids, the aminopolyphosphonic acids or the phosphonocarboxylic acids may be reacted with a ferric salt such as ferric sulfate, ferric chloride, ferric nitrate, ammonium ferric sulfate or ferric phosphate in solution to form an iron(III) complex salt. An excess amount of the chelating agent may be used. It is more preferred for at least one member of the metal chelate compounds derived from the compounds of general formulas (III), (IV), (V), (VI) and (VII) to be present. The metal chelate compounds are used in an amount of 0.01 to 1.0 mol/l, preferably 0.05 to 0.50 mol/l.

The bleaching solutions, the bleaching-fixing solutions and/or the prebath thereof may contain various compounds as bleaching accelerators. Examples of compounds include compounds having a mercapto group or a disulfide bond described in U.S. Pat. No. 3,893,858, German Patent 1,290,812, JP-A-53-95630 and

*Research Disclosure* No. 17129 (July 1978); thiourea compounds described in JP-B-45-8506, JP-A-52-20832, JP-A-53-32735 and U.S. Pat. No. 3,706,561; and halides such as bromides and iodides. These compounds are preferred from the standpoint of excellent bleaching power.

Further, the bleaching solutions and the bleaching-fixing solutions may contain rehalogenating agents such as bromides (e.g., potassium bromide, sodium bromide, ammonium bromide), chlorides (e.g., potassium chloride, sodium chloride, ammonium chloride) or iodides (e.g., ammonium iodide). If desired, at least one inorganic or organic acid having a pH buffering effect such as borax, sodium metaborate, acetic acid, sodium acetate, sodium carbonate, potassium carbonate, phosphorous acid, phosphoric acid, sodium phosphate, citric acid, sodium citrate or tartaric acid or alkali metal salt thereof or ammonium salt thereof or corrosion inhibitor such as ammonium nitrate or guanidine may be added.

Fixing agents which can be used in the bleaching-fixing solutions and in the fixing solutions are solvents for silver halide, such as the above-described nitrogen-containing heterocyclic compounds having a sulfide group, the meso-ionic compounds or the thioether compounds. These compounds may be used either alone or as a mixture of two or more thereof. The fixing agents are used in an amount of preferably at least 0.1 mol, more preferably 0.3 to 2.0 mol per liter of the fixing solution. The bleaching-fixing solutions or the fixing solutions have a pH of preferably 2 to 8, more preferably 3 to 5. Thiosulfates conventionally used may be used in such an amount that the object of the present invention is not adversely affected thereby. It is preferred that the bleaching-fixing solutions or the fixing solutions are substantially free from thiosulfates. The amount of thiosulfates is $10^{-2}$ mol/l or less, preferably $10^{-3}$ mol/l or less, if it is present.

The bleaching-fixing solutions may contain fluorescent brighteners, anti-foaming agents, surfactants and organic solvents such as polyvinyl pyrrolidone or methanol. It is preferred for the bleaching-fixing solutions and the fixing solutions to contain sulfite ion-releasing compounds such as sulfites (e.g., sodium sulfite, potassium sulfite, ammonium sulfite), bisulfites (e.g., ammonium bisulfite, sodium bisulfite, potassium bisulfite) or metabisulfites (e.g., potassium metabisulfite, sodium metabisulfite, ammonium metabisulfite). These compounds are used in an amount (in terms of sulfite ion) of preferably 0.02 to 0.05 mol/l, more preferably 0.04 to 0.40 mol/l.

In addition thereto, ascorbic acid, sulfinic acids, carbonyl bisulfite adducts or carbonyl compounds may be added. Further, buffering agents, fluorescent brighteners, chelating agents, anti-foaming agents, antifungal agents, etc. may be optionally added, The processing time in the bleaching-fixing stage of the present invention is preferably 5 to 120 seconds, more preferably 10 to 60 seconds. The processing temperature is 25° to 60° C., preferably 30° to 50° C. The replenishment rate is 20 to 250 ml, preferably 30 to 100 ml per $m^2$ of the light-sensitive material.

After desilverization such as fixing or bleaching-fixing, the rinsing stage and/or the stabilization stage are/is generally carried out.

The amount of rinsing water in the rinsing stage widely varies depending on the characteristics of the light-sensitive materials (e.g., depending on materials such as couplers) present, use, the temperature of rinsing water, the number of rinsing tanks (the number of stages), replenishment system (countercurrent or direct flow) and other conditions. The number of stages in the multi-stage countercurrent system is preferably 2 to 6, particularly preferably 2 to 5.

In the multi-stage countercurrent system, the amount of rinsing water can be greatly reduced. For example, the amount of rinsing water is only 0.5 to 1 liter per $m^2$ of the light-sensitive material. The effect of the present invention is remarkable. However, the residence time of water in the tank is prolonged, and a problem occurs that bacteria grow and suspended matters formed are deposited on the light-sensitive materials. As a means for solving the problem, a method wherein calcium and magnesium ions are reduced as described in JP-A-62-288838 can be effectively used. Further, isothiazolone compounds and thiabenzazoles described in JP-A-57-8542, chlorine-containing germicides such as sodium chlorinated isocyanurate described in JP-A-61-120145 and germicides such as benztriazole and copper ion described in JP-A-61-267761 can be used.

Further, rinsing water may contain surfactants as draining agents and chelating agents such as typically EDTA as a water softener.

The light-sensitive materials may be treated with stabilizing solutions after the rinsing stage, or can be directly treated with the stabilizing solutions via the rinsing stage. Compounds capable of stabilizing images are added to the stabilizing solutions. Examples of such compounds include aldehyde compounds such as typically formalidehyde, buffering agents for adjusting the pH of the layers to a value suited to stabilize dye and ammonium compounds. Further, germicides and antifungal agents can be added to the stabilizing solutions to prevent bacteria from growing in the layers and to impart antifungal properties to the light-sensitive materials after processing.

Further, surfactants, fluorescent brighteners and hardening agents can be added thereto.

When stabilizing treatment is directly carried out via the rinsing stage in the processing of the light-sensitive materials in the present invention, all of conventional methods described in JP-A-57-8543, JP-A-58-14843 and JP-A-60-220345 can be used.

Rinsing water and/or stabilizing solution treated through a reverse osmosis membrane may be used in the present invention. Materials which can be used in the preparation of the reverse osmosis membrane include cellulose acetate, crosslinked polyamides, polyethers, polysulfone, polyacrylic acid and polyvinylene carbonate. Crosslinked polyamide composite membrane and polysulfone composite membrane are particularly preferred because the amount of transmitted water is scarcely reduced.

A low-pressure reverse osmosis membrane which can be used under a low liquid transmission pressure of 2 to 15 kg/$cm^2$ is preferred from the standpoints of keeping initial costs down, running costs down, miniaturization and the prevention of pump noise. With regard to the structure of the membrane, a rolled membrane obtained by rolling a flat membrane called a spiral type membrane is preferred because the amount of transmitted water is scarcely reduced.

The liquid transmission pressure in the use of the membrane is in the range described above, but is more preferably 2 to 10 kg/$cm^2$, particularly preferably 3 to 7 kg/$cm^2$ from the standpoints of preventing stain from being formed and preventing the amount of transmitted. water from being reduced.

It is preferred for the rinsing stage and/or the stabilizing stage to be conducted using a multi-stage countercurrent system wherein a plurality of baths are used. The use of 2 to 5 tanks is particularly preferred.

It is preferred for water in the second and subsequent tanks of the multi-stage countercurrent rinsing and/or stabilizing system to be treated through the reverse osmosis membrane. Specifically, in the case of a two tank system, water in the second tank is treated through the reverse osmosis membrane. In the case of a three tank system, water in the second or third tank is treated through the reverse osmosis membrane. In the case of a four tank system, water in the third or fourth tank is treated though the reverse osmosis membrane. Transmitted water is returned to the same tank (the tank from which water is recovered to treat it through the reverse osmosis membrane; hereinafter referred to as recovering tank) or the next rinsing and/or stabilizing tanks. In one embodiment, the concentrated rinsing and/or stabilizing solutions are returned to the bleaching-fixing bath positioned on the upstream side of the recovering tank.

The rinsing bath used in the present invention may contain chelating agents.

Examples of suitable chelating agents include aminopolycarboxylic acids, aminopolyphosphonic acids, phosphonocarboxylic acids, alkylidene-diphosphonic acids, metaphosphoric acid, pyrophosphoric acid, organic phosphonic acids or salts thereof and polyphosphoric acid. It is particularly preferred for organic phosphonic compounds described in JP-A-2-40940 to be present in the rinsing bath.

The amounts of these organic phosphonic acids and/or salts thereof present in the rinsing bath or the stabilizing bath can be determined by the amounts of iron(III) salt of ethylenediaminetetraacetic acid present in the light-sensitive material, but preferably 2.9 to 290 mmol, more preferably 14.6 to 146 mmol per one liter of the rinsing or stabilizing bath are used. When the amount present is too large, there is a possibility that the surface becomes sticky, while when the amount is too small, an effect of improving stain can not be obtained.

It is preferred for magnesium or bismuth compounds to be used. It is also preferred that chelating agents such as. 1-hydroxyethylidene-1,1-diphosphonic acid and ethylenediaminetetramethylenephosphonic acid and magnesium and bismuth compounds are used.

Then rinsing solution can be similarly used as the water washing solution or the stabilizing solution used after desilvering.

The pH in the rinsing stage or in the stabilizing stage is preferably 4 to 10, more preferably 5 to 8. The temperature varies depending on the use and characteristics of the light-sensitive materials, but is generally 30° to 60° C., preferably 35° to 50° C. The time can be arbitrarily set. However, a shorter time is preferred from the standpoint of shortening the processing time. The time is preferably 5 to 45 seconds, more preferably 10 to 35 seconds. A low replenishment rate is preferred from the standpoints of running cost, the reduction of discharged amount and handling.

Specifically, the replenishment rate per unit area of the light-sensitive material is preferably 0.5 to 50 times, more preferably 2 to 15 times the amount brought over from the prebath, or the replenishment rate is not more than 300 ml, preferably not more than 150 ml, per $m^2$ of the light-sensitive material. The replenishment may be conducted continuously or intermittently.

The solution used in the rinsing stage and/or in the stabilizing stage can be introduced into a prestage. For example, the solution is reduced by a multistage countercurrent system, and the overflow solution of the rinsing water is allowed to flow into the prebath, that is, the bleaching-fixing bath, and a concentrated solution is fed to the bleaching-fixing solution, whereby the amount of waste water can be reduced.

In the present invention, rinsing water and/or the stabilizing solution and other processing solution can be used as a jet stream. A jet stream can be formed by sucking processing solution from a processing bath by means of a pump and jetting the solution through nozzles or slits against the surface of the emulsion layer of the light-sensitive material, with the nozzles or slits being provided at a position opposite the surface of the emulsion layer. More specifically, a method wherein a solution pressure-fed by means of a pump is ejected through slits or nozzles provided opposite the surface of the emulsion layer as described in the Example of JP-A-62-183460 (right lower column of page 3 to right lower column of page 4) can be used.

The processing time of the present invention is defined as the time reduced until the drying stage is completed after the light-sensitive material is brought into contact with the color developing solution. The effect of the present invention is remarkable with rapid processing where the processing time is not longer than 3 minutes, preferably not longer than 2 minutes.

The drying stage which can be used in the present invention is illustrated below.

A drying time of 20 to 40 seconds is desirable to finish the formation of an image by the ultra-rapid processing used in the present invention.

Means for shortening the drying time includes means for improving the drying of the light-sensitive materials wherein the amount of hydrophilic colloid such as gelatin is reduced, whereby the amount of water carried over from the processing solution into the layers can be reduced and drying can be expedited. From the standpoint of reducing the amount of water brought over from the processing solution, water is removed by means of squeeze rollers or a cloth immediately after the light-sensitive materials leave the rinsing bath, whereby drying can be expedited. Means for shortening the drying time includes means for improving drying by driers wherein the drying temperature is elevated, or drying air is intensified, whereby drying can be expedited. Further, drying can be expedited by controlling the angle of drying air blown against the light-sensitive materials or controlling the removal of discharged air.

A processing apparatus (processor) suitable for use in carrying out the processing method of the present invention is illustrated in the accompanying drawings.

FIG. 1 shows schematically an embodiment of a silver salt photographic color paper processor suitable for use in carrying out the method of the present invention. In this processor, exposed web-form color paper (positive original) is developed, bleach-fixed, rinsed and then dried to form an image on a color paper.

The main body 10 of the processor is provided continuously with a development bath 12, a bleaching-fixing bath 15, rinsing baths **16*a* to 16*c*, a draining part 17 and a drying part 18. After exposure, a light-sensitive material 20 is developed, bleach-fixed, rinsed, dried in the drying part 18 and then removed from the main body 10**.

Each of the development bath 12, the bleaching-fixing bath 15, the rinsing baths 16*a* to 16*c*, the draining part 17 and the drying part 18 is provided with a pair or pairs of conveying rollers 21, through which the light-sensitive materials are conveyed while they are held between a pair of conveying rollers. The conveying rollers 21 provided in the draining part 17 and in the drying part 18 serve as water removal rollers having the function of removing water droplets on the light-sensitive materials 20 by squeezing or absorption. While the light-sensitive materials 20 are held between the pairs of the conveying rollers 21, they are conveyed in such a way that the emulsion layer side thereof is positioned downward and immersed in the processing solutions for a given period of time to thereby effect color development and other processing desired.

Three baths of the rinsing baths 16*a* to 16*c* are arranged in a cascade arrangement. The degree of cleaning of the rinsing water is reduced from the final stage bath 16*c* toward the first stage bath 16*a* in turn. The rinsing bath is provided with a reverse osmosis membrane (RO membrane) device 26. Water in the second rinsing tank 16*b* is pressure-fed to the reverse osmosis membrane device 26 by means of a pump 25. Clean water transmitted through the reverse osmosis membrane device 26 is fed to the final stage rinsing bath (the third rinsing tank) 16*c*, and concentrated water which is not transmitted through the reverse osmosis membrane device 26 is fed to the second rinsing tank 16*b*.

In the structure of the processor schematically shown in FIG. 1, a member 22 for jetting a processing solution is provided at the lower part of each bath. Processing solutions are jetted at a high speed against the light-sensitive materials 20 so as to form a jet stream of each processing solution on the surface of the light-sensitive material. The jetting member 22 is constructed from a pipe having jetting ports with a diameter of 0.5 mm provided along the axial direction of the roller at intervals of 5 mm, and is spaced by 10 mm from a jetting nozzle. The jetting amount is represented by the value obtained by dividing the jetting amount per min (10 l) by the width (20 cm) of the light-sensitive layer for convenience sake. The value is 0.5 l/cm.min. When a jet stream of a processing solution is produced on the surfaces of the light-sensitive materials 20, a film of a fresh processing solution is always formed on the surfaces of the light-sensitive materials 20, and rapid good processing can be carried out.

A fan for blowing warm air is provided at the lower part of the drying part 18. Warm air produced by the fan is passed through slits 24 and fed to the drying part 18. Warm air is then blown at a speed of 5 to 20 m/sec through nozzles against the light-sensitive materials 20 to dry them, with the nozzles being spaced by one cm from the light-sensitive materials 20 and provided at intervals of one cm in the width direction.

Figure 2:
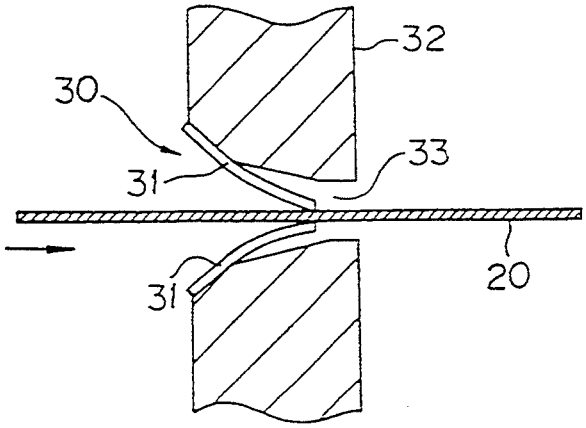
FIG. 2 shows diagrammatically one embodiment of a blade to be provided on the wall of the bath of the processor of FIG. 1.
Figure 3:
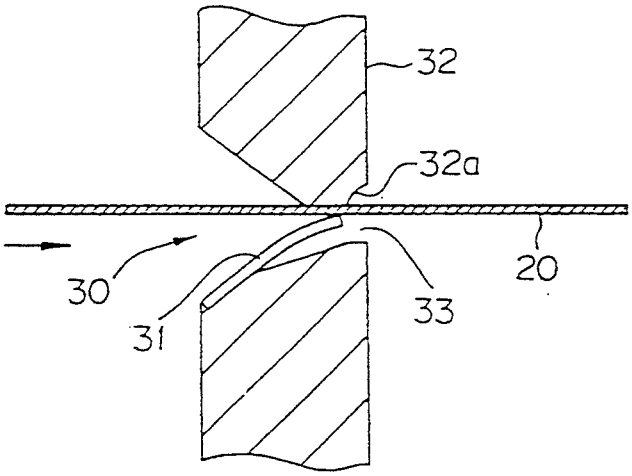
FIG. 3 shows diagrammatically another embodiment of a blade to be provided on the wall of the bath of the processor of FIG. 1.

As shown in FIG. 2 and FIG. 3, a slit 33 for passing the light-sensitive materials 20 therethrough is provided on the wall of each bath. The slit 33 is provided with a shutter means 30 for preventing each processing solution from being transferred by the deposition of the processing solution on the light-sensitive materials 20. A blade 31 is provided as an embodiment of the shutter means 30. The blade 31 may be provided on both sides of the slit 33 as shown in FIG. 2. Alternatively, the blade is provided on one side of the slit 33 so that the shutter means 30 is formed by the blade 31 and the edge 32*a* of the wall 32 of the slit 33 as shown in FIG. 3.

In the present invention, a color photographic material having at least one layer containing at least one member of cyan couplers of general formula (I) or (II) as an oil-soluble coupler is processed with a bath having a fixing ability and containing at least one compound, as a fixing agent, selected from the group consisting of nitrogen-containing heterocyclic compounds having sulfide group, meso-ionic compounds and thioether compounds after color development, whereby stain can be prevented from being formed even when the total processing time is shortened. In addition, color reproducibility can be achieved without any turbidity even when the processing is greatly shortened, and hence the present invention enables the light-sensitive materials to be rapidly processed.

The present invention is now illustrated in greater detail by reference to the following examples which, however, are not to be construed as limiting the present invention in any way.

EXAMPLE 1

Preparation of Standard Light-Sensitive Material

Both sides of a paper support were laminated with polyethylene. The polyethylene surface of the resulting support was subjected to a corona discharge treatment. A gelatin undercoat layer containing sodium dodecylbenzenesulfonate was coated thereon. Further, various photographic layers were coated thereon to prepare a multi-layer color photographic paper having the following layers (standard light-sensitive material) as Sample 100. The coating solutions were prepared in the following manner.

Preparation of Coating Solution for First Layer 153.0 g of yellow coupler (ExY), 15.0 g of dye image stabilizer (Cpd-1), 7.5 g of dye image stabilizer (Cpd-2) and 16.0 g of dye image stabilizer (Cpd-3) were dissolved in 25 g of solvent (Solv-1), 25 g of solvent (Solv-2) and 180 cc of ethyl acetate. The resulting solution was emulsified and dispersed in 1000 g of a 10% aqueous solution of gelatin containing 60 cc of 10% sodium dodecylbenzenesulfonate and 10 g of citric acid to prepare an Emulsified Dispersion A. Separately, there was prepared a silver chlorobromide Emulsion A (cubic; a 3:7 (by mol of silver) mixture of a larger-size Emulsion A having a mean grain size of 0.88 μm and a smaller-size Emulsion A having a mean grain size of 0.70 μm; a coefficient of variation in grain size distribution: 0.08 and 0.10, respectively; 0.3 mol % of silver bromide being localized on a part of the surface of the grain in each emulsion). The following blue-sensitive sensitizing dyes A and B were added to the emulsion ($2.0\times10^{-4}$ mol of each of these dyes was added to the larger-size Emulsion A, and $2.5\times10^{-4}$ mol of each of these dyes was added to the smaller-size Emulsion A, each amount being per mol of silver). Chemical ripening of the emulsion was carried out by adding sulfur sensitizing agent and gold sensitizing agent. The above Emulsified Dispersion A and the silver chlorobromide Emulsion A were mixed and dissolved. A coating solution for the first layer was prepared to have the following composition.

Coating solutions for the second layer through the seventh layer were prepared in the same manner as in the preparation of the coating solution for the first layer. The sodium salt of 1-oxy-3,5-dichloro-s-triazine was used as a hardening agent for gelatin in each layer.

Cpd-14 and Cpd-15 were added to each layer in such an amount as to give the total amounts of 25.0 mg/m$^2$ and 50 mg/m$^2$, respectively.

The following spectral sensitizing dyes were used in the silver chlorobromide emulsion of each light-sensitive emulsion layer.

Blue-Sensitive Emulsion Layer

Sensitizing Dye A

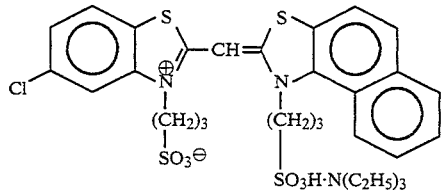

Sensitizing Dye B

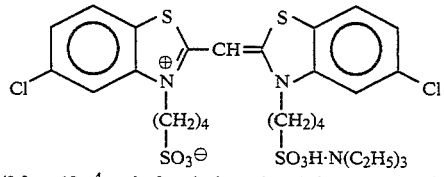

($2.0 \times 10^{-4}$ mol of each these dyes being added to the larger-size emulsion, and $2.5 \times 10^{-4}$ mol of each of these dyes being added to the smaller-size emulsion, each amount being mol of silver halide)

Green-Sensitive Emulsion Layer

Sensitizing Dye C

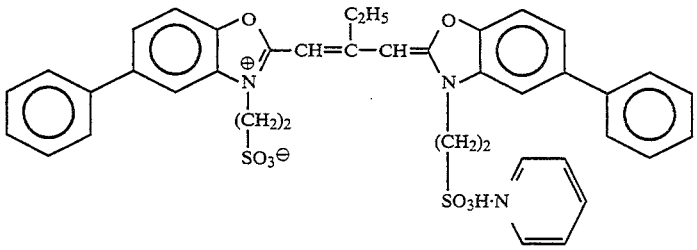

($4.0 \times 10^{-4}$ mol being added to the larger-size emulsion, and $5.6 \times 10^{-4}$ mol being added to the smaller-size emulsion, each amount being per mol of silver halide)

Sensitizing Dye D

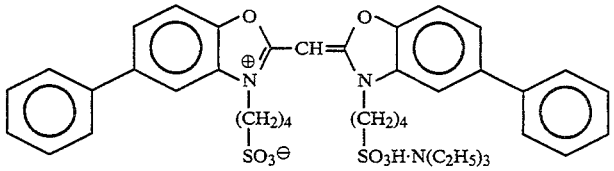

($7.0 \times 10^{-5}$ mol being added to the larger-size emulsion, and $1.0 \times 10^{-5}$ mol being added to the smaller-size emulsion, each amount being per mol of silver halide)

Red-Sensitive Emulsion Layer

Sensitizing Dye E

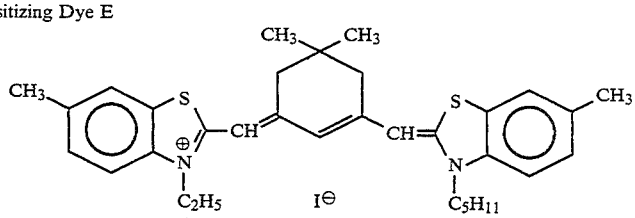

($0.9 \times 10^{-4}$ mol being added to the larger-size emulsion, and $1.1 \times 10^{-4}$ mol being added to the smaller-size emulsion, each amount being per mol of silver halide)

Further, $2.6 \times 10^{-3}$ mol of the following compound per mol of silver halide was added.

respectively, each amount being per mol of silver halide.

The following dyes were added to the emulsion layers to prevent irradiation (the numerals in parentheses represent coating weights).

(10 mg/m²)

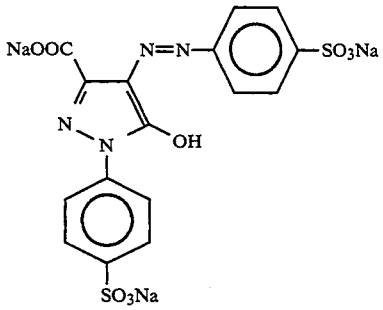

(10 mg/m²)

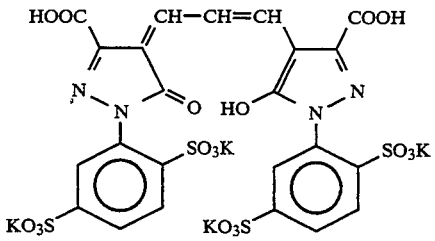

(40 mg/m²)

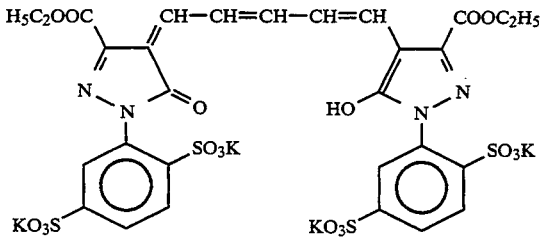

(20 mg/m²)

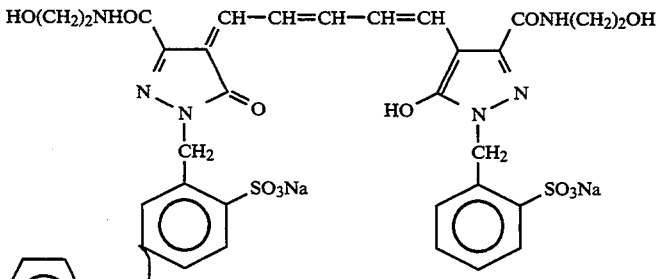

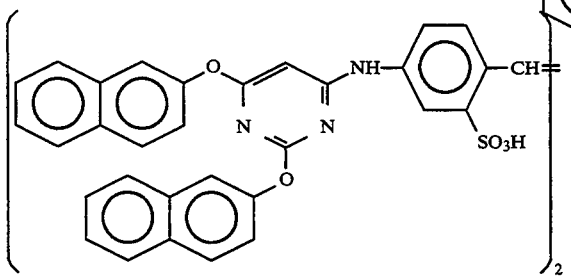

$8.5\times10^{-5}$ mol, $7.7\times10^{-4}$ mol and $2.5\times10^{-4}$ mol of 1-(5-methylureidophenyl)-5-mercaptotetrazole were added to blue-sensitive emulsion layer, green-sensitive emulsion layer and red-sensitive emulsion layer, respectively, each amount being per mol of silver halide.

Further, $1\times10^{-4}$ mol and $2\times10^{-4}$ mol of 4-hydroxy-6-methyl-1,3,3a,7-tetrazaindene were added to blue-sensitive emulsion layer and green-sensitive emulsion layer,

PHOTOGRAPHIC LAYERS

Support

Polyethylene-laminated paper

[Polyethylene on the first layer side contained white pigment ($TiO_2$) and bluish dye (ultra-marine)]

Layer Structure

Each layer had the following composition. Numerical amounts represent coating weights (g/m²). The amounts of emulsions are represented as coating weights in terms of silver.

| First Layer (blue-sensitive emulsion layer) | |
|---|---|
| Silver Chlorobromide Emulsion A | 0.27 |
| Gelatin | 1.36 |
| Yellow coupler (ExY) | 0.79 |

-continued

| | |
|---|---|
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second Layer (color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Third Layer (green-sensitive emulsion layer) | |
| Silver Chlorobromide Emulsion (cubic; a 1:3 (by Ag mol) mixture of a larger-size emulsion B having a mean grain size of 0.55 μm and a smaller-size emulsion B having a mean grain size of 0.39 μm, a coefficient of variation in grain size distribution: 0.10 and 0.08, respectively; 0.8 mol % of AgBr being localized on a part of the surface of the grain in each size emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |

-continued

| | |
|---|---|
| Fifth Layer (red-sensitive emulsion layer) | |
| Silver chlorobromide emulsion (cubic; a 1:4 (by Ag mol) mixture of a larger-size emulsion C having a mean grain size of 0.50 μm and a smaller-size emulsion having a mean grain size of 0.41 μm; a coefficient of variation in grain size distribution: 0.09 and 0.11, respectively; 0.8 mol % of AgBr being localized on a part of the surface of the grain in each size emulsion) | 0.18 |
| Gelatin | 0.80 |
| Cyan coupler (ExC) | 0.33 |
| Dye image stabilizer (Cpd-1) | 0.35 |
| Ultraviolet light absorber (UV-2) | 0.18 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Sixth Layer (ultraviolet light absorbing layer) | |
| Gelatin | 0.55 |
| Ultraviolet light absorber (UV-1) | 0.38 |
| Dye image stabilizer (Cpd-12) | 0.15 |
| Dye image stabilizer (Cpd-5) | 0.02 |
| Seventh Layer (protective layer) | |
| Gelatin | 1.13 |
| Acrylic-modified copolymer of polyvinyl alcohol (a degree of modification: 17%) | 0.05 |
| Liquid paraffin | 0.02 |
| Dye image stabilizer (Cpd-13) | 0.01 |

The compounds used in the above layers are described below.

(ExY) Yellow Coupler

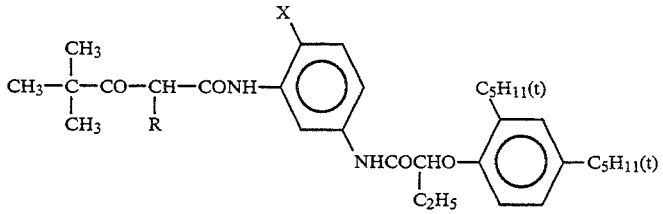

R = 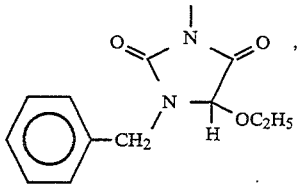 , X = Cl and

R = 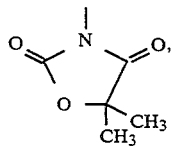 X = $OCH_3$

1:1 mixture (by mol)

(ExM) Magenta Coupler

-continued
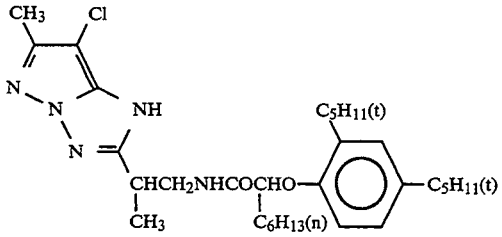
(ExC) Cyan Coupler
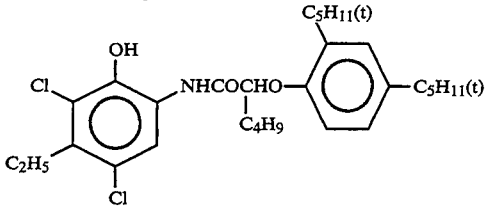
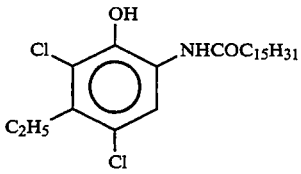
3:7 mixture (by mol)
(Cpd-1) Dye Image Stabilizer
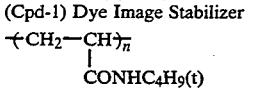
Average MW 60,000
(Cpd-2) Dye Image Stabilizer
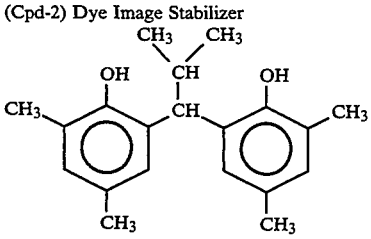
(Cpd-3) Dye Image Stabilizer
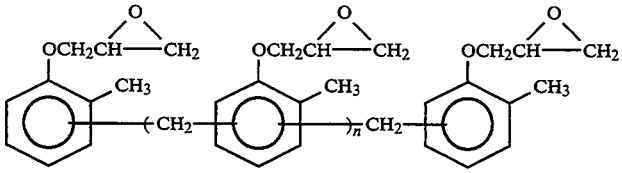
n = 7~8 (mean value)
(Cpd-4) Color Mixing Inhibitor
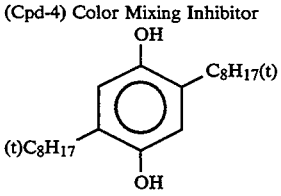
(Cpd-5) Dye Image Stabilizer
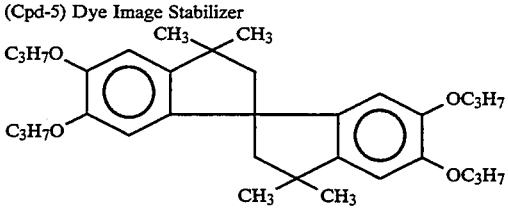

-continued
(Cpd-6)
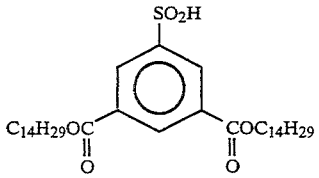
(Cpd-7)
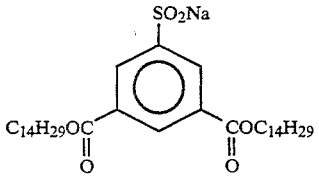
(Cpd-8) Dye Image Stabilizer
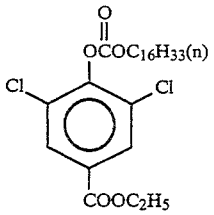
(Cpd-9) Dye Image Stabilizer
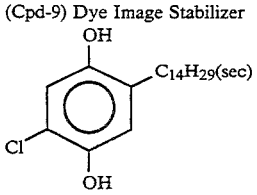
(Cpd-10) Dye Image Stabilizer
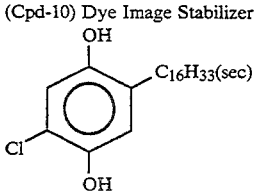
(Cpd-11)
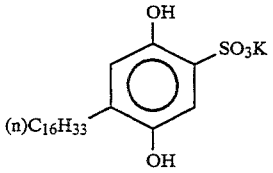
(Cpd-12)
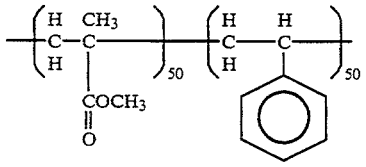
Average MW 60,000
(Cpd-13)
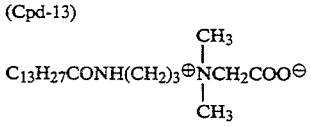
(Cpd-14) Antiseptic -continued
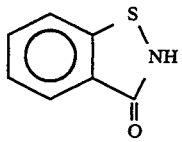
(Cpd-15) Antiseptic
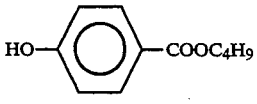
(UV-1) Ultraviolet Light Absorber
(i)
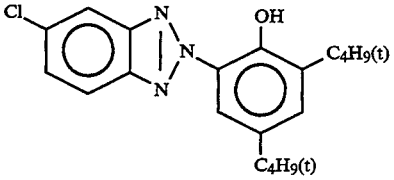
(ii)
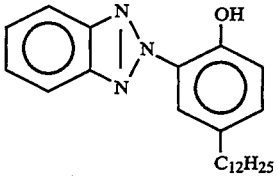
(iii)
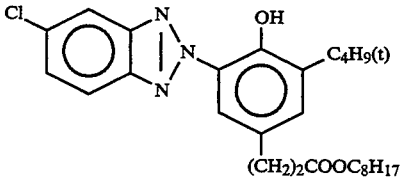
(iv)
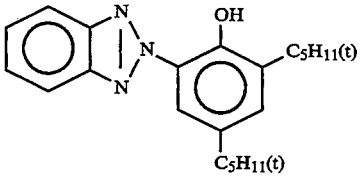
10:5:1:5 mixture (by weight)
(UV-2) Ultraviolet Light Absorber
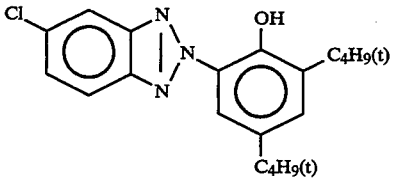
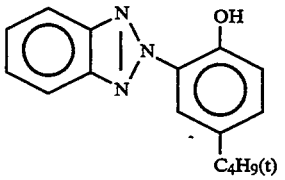

-continued

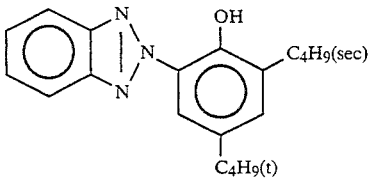

1:2:2 mixture (by weight)

(Solv-1) Solvent $C_8H_{17}CHCH(CH_2)_7COOC_8H_{17}$
$\backslash\ /$
$O$ (Solv-2) Solvent

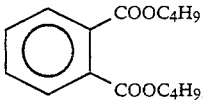

(Solv-3) Solvent

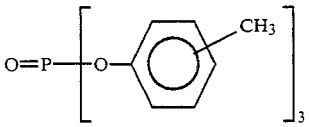

(Solv-4) Solvent

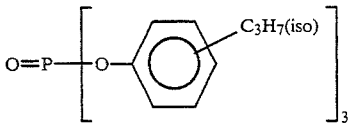

(Solv-5) Solvent $O{=}P{-}(OCH_2\overset{C_2H_5}{\overset{|}{C}}HC_4H_9(n))_3$ (Solv-6) Solvent

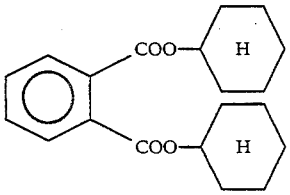

(Solv-7) Solvent

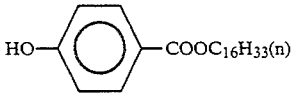

Preparation of Light-Sensitive Material According to the Present Invention

A light-sensitive material (Sample 101) was prepared in the same manner as in the preparation of the standard light-sensitive material except that Compound C-3 (the coupler of the present invention) was used in place of cyan coupler ExC).

Exposure and Processing of Light-Sensitive Material

Each sample of the above light-sensitive materials was exposed and processed in the following manner.

A sensitometer (FW type manufactured by Fuji Photo Film Co., Ltd.; color temperature of light source: 3200° K.) was used, and each sample was subjected to gradation exposure through three-color separation filter for sensitometry. The exposure time was 0.1 second and exposure was carried out for an exposure amount of 250 CMS.

After completion of the exposure, the samples were subjected to continuous processing (running test) in the following processing stages by using the following processing solutions having the following compositions until the replenishment rate reached twice the tank capacity of the color developing solution.

| Processing Stage | Temperature (°C.) | Time (sec) | Replenisher* (ml) | Tank Capacity (l) |
|---|---|---|---|---|
| Color development | 38 | 45 | 109 | 15 |
| Bleaching-fixing | 35 | 45 | 60 | 15 |
| Rinse (1) | 35 | 20 | — | 5 |

-continued

| Processing Stage | Temperature (°C.) | Time (sec) | Replenisher* (ml) | Tank Capacity (l) |
|---|---|---|---|---|
| Rinse (2) | 35 | 20 | — | 5 |
| Rinse (3) | 35 | 20 | 364 | 5 |
| Drying | 70–80 | 60 | | |

*Replenishment rate per $m^2$ of the light-sensitive material.

(Three tank countercurrent system of rinse (3) to (1) was used.)

Each processing solution had the following composition (hereinafter referred to as Processing Formulation 10A (invention)).

| | Tank Solution | Replenisher |
|---|---|---|
| Color Developing Solution | | |
| Water | 700 ml | 700 ml |
| Sodium triisopropyl-naphthalene(β)-sulfonate | 0.1 g | 0.1 g |
| Ethylenediaminetetraacetic acid | 1.5 g | 3.0 g |
| Disodium salt of 1,2-dihydroxybenzene-4,6-disulfonic acid | 0.3 g | 0.5 g |
| Triethanolamine | 6.0 g | 10.0 g |
| Potassium chloride | 6.5 g | — |
| Potassium bromide | 0.03 g | — |
| Potassium carbonate | 21.0 g | 27.0 g |
| Fluorescent brightener (UVITEX-CK manufactured by Ciba-Geigy) | 1.6 g | 3.2 g |
| Sodium sulfite | 0.2 g | 0.3 g |
| Disodium N,N-bis(sulfonatoethyl)hydroxylamine | 10.0 g | 13.0 g |
| N-Ethyl-N-(β-methanesulfonamidoethyl)-3-methyl-4-aminoaniline sulfate | 5.8 g | 11.5 g |
| Water to make | 1000 ml | 1000 ml |
| pH (25° C.) | 9.97 | 11.00 |
| Bleaching-Fixing Solution A | | |
| Water | 400 ml | 400 ml |
| Compound A-4 (invention) | 70 g | 140 g |
| Ammonium sulfite | 20 g | 60 g |
| Ammonium ethylenediaminetetraacetato ferrate dehydrate | 73 g | 183 g |
| Ethylenediaminetetraacetic acid | 3.4 g | 8.5 g |
| Ammonium bromide | 20 g | 50 g |
| Nitric acid (67% aq. solu.) | 9.6 g | 24 g |
| Water to make | 1000 ml | 1000 ml |
| pH (25° C.) | 5.0 | 4.0 |

Rinsing Solution

Tank solution and replenisher being the same.

Ion-exchanged water (the concentration of each of calcium and magnesium ions was reduced to 3 ppm or less).

Processing (hereinafter referred to as Processing Formulation 10Z (Comparative Example)) was carried out in the same manner as described above except that the following Bleaching-Fixing Solution B was used in place of the Bleaching-Fixing Solution A.

| Bleaching-Fixing Solution B | Tank Solution | Replenisher |
|---|---|---|
| Water | 400 ml | 400 ml |
| Ammonium thiosulfate (70% aq. solu.) | 110 ml | 220 ml |
| Ethylenediaminetetraacetic acid | 1.5 g | 3.0 g |
| Ammonium sulfite monohydrate | 19.4 g | 38.80 g |
| Ammonium bromide | 25 g | 50 g |
| Acetic acid (90%) | 6.57 g | 13.13 g |
| Ammonium ethylenediaminetetraacetato ferrate dihydrate | 143 g | 286 g |
| Nitric acid (67% aq. solu.) | 18.29 g | 36.58 g |
| Water to make | 1000 ml | 1000 ml |
| pH (25° C.) | 5.00 | 5.10 |

Sample 100 was processed with each of-Processing Formulations 10A and 10Z. Sample 101 was processed with each of Processing Formulations 10A and 10Z.

After continuous processing was completed, the samples were left to sand at 80° C. and 70% RH for 2 weeks, and a change in minimum density before and after the lapse of time was measured by using a spectrophotometer (U3410 manufactured by Hitachi Ltd.) provided with an 150 mm integrating sphere. Wavelengths used in this measurement were 430 nm, 530 nm and 620 nm.

The results are shown in Table 1 below.

TABLE 1

| Sample | Processing | Density (before and after lapse of time) 430 nm | 540 nm | 650 nm |
|---|---|---|---|---|
| 101 | 10A (invention) | 0.064→0.105 | 0.062→0.075 | 0.055→0.065 |
| 101 | 10Z (Comp. Ex.) | 0.065→0.125 | 0.062→0.075 | 0.055→0.065 |
| 100 | 10A (Comp. Ex.) | 0.082→0.131 | 0.063→0.074 | 0.055→0.067 |
| 100 | 10Z (Comp. Ex.) | 0.080→0.162 | 0.061→0.075 | 0.055→0.068 |

It can be seen from the results in Table 1 that a large change in the density of blue color in the comparative sample occurred in comparison with the sample of the present invention. Further, when the samples were evaluated, it was found that the comparative sample showed an increase in yellowing after the lapse of time while the sample of the present invention showed favorable results.

Further, processing (Processing Formulation 10Y) was carried out in the same manner as described above except that Bleaching-Fixing Solution C was used in place of Bleaching-Fixing Solution A. Bleaching-Fixing Solution C had a composition such that ammonium thiosulfate (70% aq. solu.) was used in place of Compound A-4 in such an amount that 100 g thereof was added to the tank solution and 250 g was added to the replenisher. The results showed that yellowing due to an increase of stain was remarkable as in the results shown in Table 1.

Further, Processing 10A did not cause staining of the conveying rollers and was superior to Processing 10Z. Furthermore, when Processing Formulations 10Y and 10Z were used, precipitates formed in the bleaching-fixing bath and in the rinsing baths after running processing, while when Processing Formulation 10A of the present invention was used, no precipitate was formed.

EXAMPLE 2

Light-Sensitive Materials 201 to 208 were prepared in the same manner as in Example 1 except that cyan couplers shown in Table 2 were used in place of the cyan coupler used in the light-sensitive material of Example 1. These samples were processed using Processing Formulation 10A and evaluated in the same manner as in Example 1.

The results obtained are shown in Table 2 below.

TABLE 2

| Sample | Cyan Coupler | Change of Optical Density at 430 nm |
|---|---|---|
| 201 | Compound C-1 | 0.064→0.103 |
| 202 | Compound C-2 | 0.063→0.107 |
| 203 | Compound C-19 | 0.066→0.105 |
| 204 | Compound C-34 | 0.064→0.106 |
| 205 | Compound C-36 | 0.062→0.104 |
| 206 | Compound C-39 | 0.062→0.105 |
| 207 | Compound C-52 | 0.067→0.104 |
| 208 | Compound C-53 | 0.065→0.102 |
| 100 (Comp. Ex.) | Comparative cyan coupler (ExC) | 0.080→0.162 |

It can be seen from Table 2 that when Samples 201 to 208 were used, a similar effect to that of Example 1 can be obtained, high quality can be maintained on standing, and hence the effect of the present invention is marked.

EXAMPLE 3

The following bleaching-fixing solution was prepared.

| Bleaching-Fixing Solution<br>Mother solution and replenisher were the same. | |
|---|---|
| Compound A-4 | 0.9 mol |
| Bleaching agent indicated below | 0.18 mol |
| Chelating agent (the same kind of bleaching agent) | 0.01 mol |
| Ammonium nitrate | 10 g |
| Sodium p-toluenesulfinate | 20 g |
| 5-Mercapto-1,3,4-triazole | 0.5 g |
| Water to make | 1000 ml |
| pH (25° C.) (adjusted with acetic acid or ammonia) | 6.20 |

Sample 101 was processed in the same manner as in Example 1 except that the above bleaching-fixing solution was used. In this example, each of (1,3-diaminopropanetetraacetato)iron(III) complex and compounds BL-1, BL-12 and BL-17 was used as the bleaching agent contained in the above bleaching-fixing solution. In this example, an increase in yellowing was scarcely deserved, and the method of the present invention showed excellent performance. Further, processing was carried out in the same manner as in Example 1 except that Compound 1 was used as the bleaching agent in the bleaching-fixing solution and Compound A-2, A-3, A-8, B-1, B-3, B-4, E-1 or E-2 as the fixing agent in the bleaching-fixing solution was used in place of Compound A-4. It was found that a change to yellowing scarcely occurred under high temperature and humidity conditions by using any of these solutions, and hence the effect of the present invention was remarkable. Further, it was found that no precipitate was formed in the processing solutions and stable processing could be carried out.

EXAMPLE 4

A processor having the same structure of that of the processor of FIG. 1 for carrying out the processing method of the present invention was used except that five rinsing baths were used in place of three baths. The traveling speed of the light-sensitive material was adjusted to 0.9 cm/sec.

| Processing Stage | Temperature (°C.) | Time (sec) | Replenisher* (ml) | Tank Capacity (l) |
|---|---|---|---|---|
| Color development | 45 | 30 | 73 | 3.0 |
| Bleaching-fixing | 40 | 20 | 60 | 3.0 |
| Rinse (1) | 40 | 5 | — | 1.7 |
| Rinse (2) | 40 | 5 | — | 1.7 |
| Rinse (3) | 40 | 5 | — | 1.7 |
| Rinse (4) | 40 | 5 | — | 1.7 |
| Rinse (5) | 40 | 5 | 60 | 1.7 |
| Drying | 70–80 | 20 | | |

*Replenishment rate was per $m^2$ of the light-sensitive material.

Jet stirring wherein a jet stream was perpendicularly jetted against the surface of the emulsion layer was used in each bath, and a five tank countercurrent system of rinse (5) to (1) was used.

A reverse osmosis membrane device as shown in FIG. 1 was used. Water in the 4th rinse bath was pressure-fed to the reverse osmosis membrane device by means of a pump under conditions such that the solution feed pressure was 6 kg/$cm^2$ and the solution was fed at a flow rate of 1.5 l/min, transmitted water was fed to the 5th rinse bath, and concentrated water was returned to the 4th rinse bath. The amount of water transmitted to the 5th rinse bath was 180 to 340 ml/min.

The reverse osmosis membrane used was a spiral type RO module element DRA-80 (effective membrane area: 1.1 $m^2$, polysulfone composite membrane manufactured by Daicel Chemical Industries Ltd.). This membrane was charged into plastic pressure vessel PV-0321 type.

Each processing solution had the following composition.

| | Tank Solution | Replenisher |
|---|---|---|
| Color Developing Solution | | |
| Water | 700 ml | 700 ml |
| Sodium triisopropylnaphthalene(β)sulfonate | 0.1 g | 0.1 g |
| Ethylenediaminetetraacetic acid | 3.0 g | 3.0 g |
| Disodium salt of 1,2-dihydroxybenzene-4,6-disulfonic acid | 0.5 g | 0.5 g |
| Triethanol amine | 12.0 g | 12.0 g |
| Potassium chloride | 6.5 g | — |
| Potassium bromide | 0.03 g | — |
| Potassium carbonate | 27.0 g | 27.0 g |
| Fluorescent brightener (WHITEX 4KB manufactured by Sumitomo Chemical Co., Ltd.) | 1.3 g | 3.9 g |
| Sodium sulfite | 0.1 g | 0.1 g |
| Disodium N,N-bis(sulfonatoethyl)hydroxylamine | 10.0 g | 13.0 g |
| N-Ethyl-N-(β-methanesulfonamidoethyl)-3-methyl-4-aminoaniline sulfate | 5.6 g | 13.0 g |
| Water to make | 1000 ml | 1000 ml |
| pH (25° C.) | 10.15 | 11.00 |
| Bleaching-Fixing Solution | | |
| Water | 400 ml | 400 ml |

-continued

| | Tank Solution | Replenisher |
|---|---|---|
| Compound A-4 (invention) | 70 g | 140 g |
| Ammonium sulfite | 20 g | 60 g |
| Ammonium ethylenediamine-tetraacetato ferrate dehydrate | 73 g | 183 g |
| Ethylenediaminetetraacetic acid | 3.4 g | 8.5 g |
| Ammonium bromide | 20 g | 50 g |
| Nitric acid (67%) | 9.6 g | 24 g |
| Water to make | 1000 ml | 1000 ml |
| pH (25° C.) | 5.0 | 4.0 |

Rinsing Solution

Tank solution and replenisher were the same.

Ion-exchanged water (the concentration of each of calcium and magnesium ions was reduced to 3 ppm or less).

Processing of 40 $m^2$ of the light-sensitive material per day was carried out. The temperature of each bath was regulated for 10 hours per day, and neither heat insulation nor cooling were made for the remaining period of time. The amount of water was corrected daily by adding water in an amount corresponding to the evaporating loss previously measured. Processing was continued for 30 days. Light-Sensitive Materials 101 and 201 were used. Further, Comparative Sample 100 was also processed. Evaluation was made in the same manner as in Example 1. The results obtained are shown in Table 3 below.

TABLE 3

| Sample | Density (before and after the lapse of time) 430 nm | 540 nm | 650 nm |
|---|---|---|---|
| 101 | 0.067→0.112 | 0.068→0.077 | 0.061→0.070 |
| 201 | 0.068→0.123 | 0.069→0.078 | 0.062→0.069 |
| 100 (Comp. Ex.) | 0.089→0.141 | 0.071→0.080 | 0.061→0.069 |

It can be seen from the results in Table 3 that the samples of the present invention can keep good photographic performance with high image quality even under high temperature and humidity conditions.

EXAMPLE 5

The same test as in Example 1 was conducted except that Light-Sensitive Material 501 prepared below was used in place of Light-Sensitive Material 101 used in Example 1.

Preparation of Emulsion a

To a 3% aqueous solution lime-processed gelatin, there was added 3.3 g of sodium chloride. Subsequently, 3.2 ml of N,N'-dimethylimidazolidine (2% aqueous solution) was added thereto. To the resulting aqueous solution, there were added an aqueous solution containing 0.2 mol of silver nitrate and an aqueous solution containing 0.2 mol of sodium chloride and 15 μg of rhodium trichloride with vigorous stirring at 56° C. Subsequently, an aqueous solution containing 0.780 mol of silver nitrate and an aqueous solution containing 0.780 mol of sodium chloride and 4.2 mg of potassium ferrocyanide were added thereto with vigorous stirring at 56° C. Five minutes after the addition of the aqueous solution of silver nitrate and the aqueous solution of the alkali metal halide, an aqueous solution containing 0.020 mol of silver nitrate and an aqueous solution containing 0.015 mol of potassium bromide, 0.005 mol of sodium chloride and 0.8 mg of potassium hexachloroiridate(IV) were added thereto with vigorous stirring at 40° C. Subsequently, a copolymer of isobutene and monosodium maleate was added thereto, and desalting was carried out by precipitation. Further, 90.0 g of lime-processed gelatin was added thereto. The pH of the resulting emulsion was adjusted to 6.2, and the pAg thereof was adjusted to 6.5. Subsequently, $1\times10^{-5}$mol of sulfur sensitizing agent (triethylthiourea), $1\times10^{-5}$ mol of chloroauric acid and 0.2 g of nucleic acid were added to the emulsion, each amount being per mol of Ag. Chemical sensitization was carried out to achieve optimal sensitization.

The resulting silver chlorobromide emulsion (a) was examined, and the form, grain size and grain size distribution of the resulting grains were determined from an electron micrograph. All of these silver halide grains were cubic, and the grains had a grain size of 0.52 μm and a coefficient of variation of 0.08. The grain size is represented by the mean value when the diameter of the grain is defined as the diameter of a circle having an area equal to the projected area of the grain and the average of the diameters of the grains is referred to as the grain size. The coefficient of variation is the value obtained by dividing the standard deviation of the grain size by the mean grain size.

The halogen composition of the emulsion grains was determined from the silver halide crystals by X-ray diffraction. Monochromatic Cuk s-rays were used as a radiation source, and the angles of diffraction from the face (200) were fully measured. The diffraction pattern of a crystal having a uniform halogen composition gives a single peak, while the diffraction pattern of a crystal having a localized phase having a different halogen composition from that of the substrate crystal gives a plurality of peaks corresponding to the halogen compositions. The halogen composition of the silver halide of the crystal can be determined by calculating the lattice constants from the angle of diffraction of the peaks measured. The measured results of the silver chlorobromide emulsion (a) showed that in addition to the main peak of 100% silver chloride, a broad diffraction pattern was observed wherein the center of the curve was 70% silver chloride (30% silver bromide) and the base of the curve extended to an area of nearly 60% silver chloride (40% silver bromide).

Preparation of Light-Sensitive Material 501 (Sample 501)

Sample 501 was prepared in the same manner as in the preparation of Sample 101 except for the following.

The first layer was a red-sensitive yellow color forming layer, the third layer was an infrared-sensitive magenta color forming layer, and the fifth layer was an infrared-sensitive cyan color forming layer. The following spectral sensitizing dyes for these layers were used.

First Layer (red-sensitive yellow color forming layer)

(Dye-1)

-continued

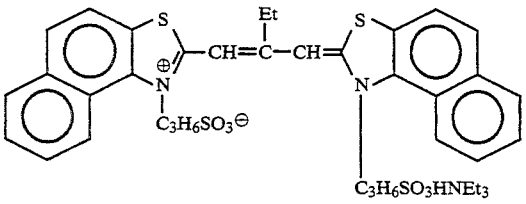

$1.0 \times 10^{-4}$ mol per mol of silver halide

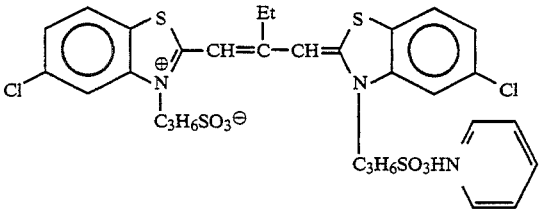

$1.0 \times 10^{-4}$ mol per mol of silver halide

Third Layer (infrared-sensitive magenta color forming layer)

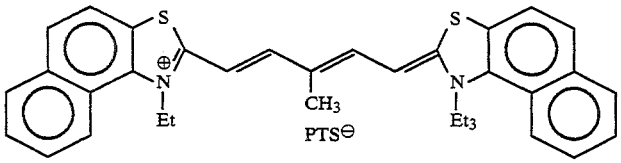

$4.5 \times 10^{-5}$ mol per mol of silver halide

Fifth Layer (infrared-sensitive cyan color forming layer)

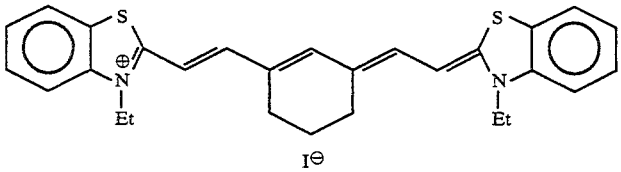

$1.0 \times 10^{-5}$ mol per mol of silver halide (Dye-4)

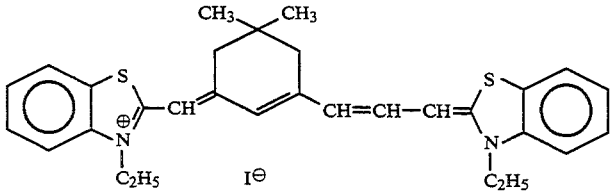

$1.0 \times 10^{-5}$ mol per mol of silver halide (Dye-5)

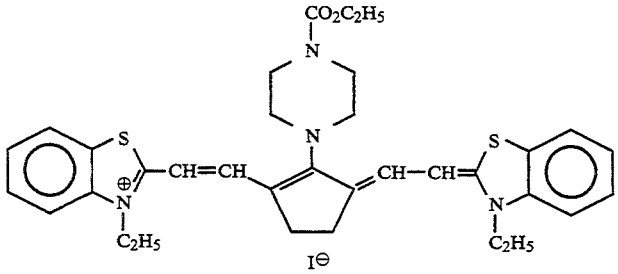

$1.0 \times 10^{-5}$ mol per mol of silver halide $8.0 \times 10^{-4}$ mol of 1-(5-methylureidophenyl)-5-mercaptotetrazole per mol of silver halide was added to each of the yellow color forming layer, the magenta color forming layer and the cyan color forming layers.

The following dyes were added to the emulsion layers to prevent irradiation.

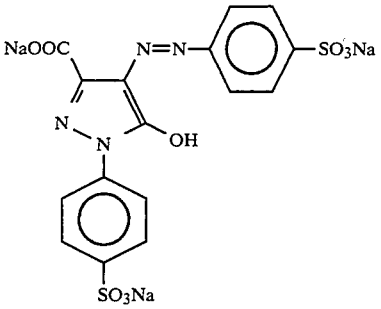
(10 mg/m²)
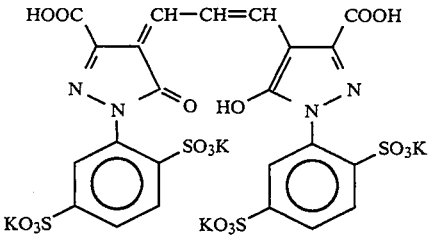
(10 mg/m²)
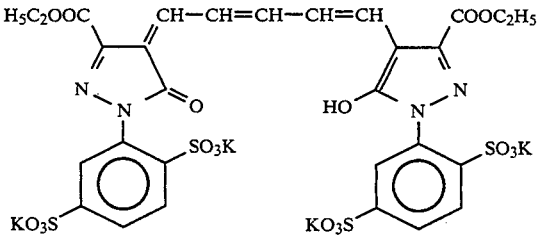
(40 mg/m²)
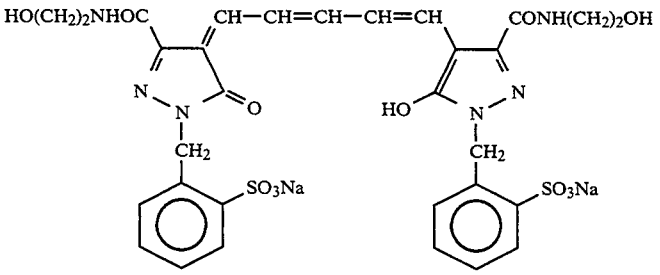
(20 mg/m²)
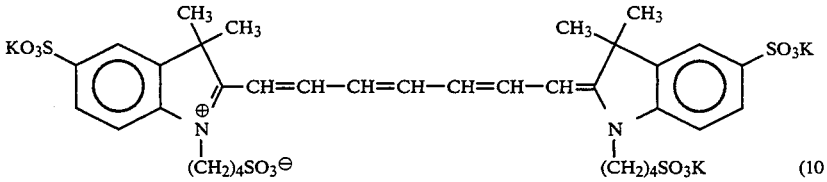
(10 mg/m²)
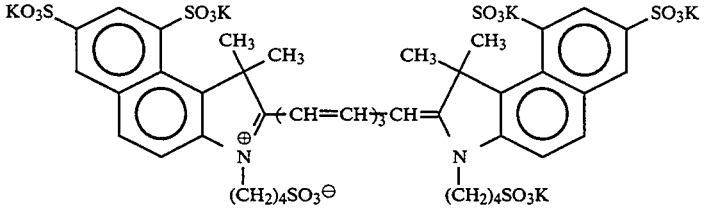
(5 mg/m²)
and -continued

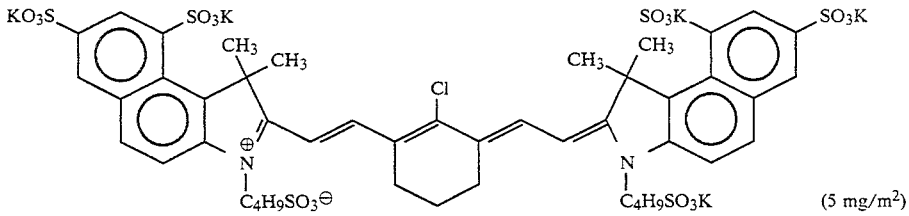

Layer Structure

Each layer had the following composition, The numerical amounts are coating weight (g/m$^2$). The amount of silver halide emulsion is represented by coating weight in terms of silver.

| Support | |
|---|---|
| First Layer (red-sensitive yellow color forming layer) | |
| Silver Chlorobromide Emulsion (A) | 0.30 |
| Gelatin | 1.22 |
| Second Layer (color mixing inhibiting layer) | |
| Gelatin | 0.64 |
| Third Layer (infrared-sensitive magenta color forming layer) | |
| Silver Chlorobromide Emulsion (A) | 0.12 |
| Gelatin | 1.28 |
| Fourth Layer (ultraviolet light absorbing layer) | |
| Gelatin | 1.41 |
| Fifth Layer (infrared-sensitive cyan color forming layer) | |
| Silver Chlorobromide Emulsion (A) | 0.23 |
| Gelatin | 1.04 |
| Sixth Layer (ultraviolet light absorbing layer) | |
| Gelatin | 0.48 |

Semiconductor laser AlGaInP (oscillating frequency: about 670 nm), GaAlAs (oscillating -frequency: about 750 nm) and GaAlAs (oscillating frequency: about 830 nm) were used. The device was so designed that the scanning exposure can be carried out in such a way that color photographic papers in turn are exposed to laser beams using a rotary polyhedron, the color photographic papers being transferred in the direction perpendicular to the scanning direction. This device was used, and the relationship D-log E between the density (D) of the image on the light-sensitive material and the amount of light (E) was determined by changing the amount of light. The exposure amount of semiconductor laser beam was controlled by the combination of a pulse width modulation system where the amount of light was modulated by changing the time of electricity applied to the semiconductor laser with an intensity modulation system wherein the amount of light was modulated by changing the amount of electricity applied. The scanning exposure was conducted at 400 dpi. The average exposure time per pixel was about $10^{-7}$ seconds.

Other processing procedures were the same as in Example 4. It was found that the effect of the present invention could be obtained when Sample 501 was used.

EXAMPLE 6

Light-Sensitive Material Samples 601 and 602 were prepared in the same manner as in the preparation of Samples 101 and 501 except for the following, Processing was carried out in the same manner as in Example 4.

| | Sample 601 | Sample 602 |
|---|---|---|
| Coating weight of gelatin in the first layer | 0.90 | 0.90 |
| Coating weight of gelatin in the second layer | 1.10 | 1.10 |
| Coating weight of gelatin in the third layer | 1.10 | 1.10 |
| Coating weight of gelatin in the fourth layer | 1.25 | 1.25 |
| Coating weight of gelatin in the fifth layer | 0.91 | 0.91 |
| Coating weight of gelatin in the sixth layer | 0.48 | 0.48 |
| Coating weight of gelatin in the seventh layer | 1.12 | 1.12 |

The results of processing showed that the effect of the present invention could be obtained even when the thickness of the light-sensitive material was reduced.

EXAMPLE 7

A light-sensitive material (Sample 701) was prepared in the same manner as in the preparation of Sample 101 except for the following. Processing was carried out in the same manner as in Example 4.

Modified Matters

| Fourth Layer (ultraviolet light absorbing layer) | |
|---|---|
| Gelatin | 1.42 |
| Ultraviolet light absorber (UV-1) | 0.47 |
| Color mixing inhibitor (Cpd-4) | 0.05 |
| Solvent (Solv-8) | 0.24 |
| Sixth Layer (ultraviolet light absorbing layer) | |
| Gelatin | 0.48 |
| Ultraviolet light absorber (UV-1) | 0.16 |
| Color mixing inhibitor (Cpd-4) | 0.02 |
| Solvent (Solv-8) | 0.08 |

The solvent (Solv-8) was the following compound.

(Solv-8)

$$H_{17}C_8OOC—(CH_2)_8—COOC_8H_{17}$$

It was found that the effect of the present invention could be obtained even when a ultraviolet light absorber was incorporated in a layer under the outmost light-sensitive layer.

EXAMPLE 8

Sample 102 was prepared in the same manner as in the preparation of Sample 100 except that Yellow Coupler (2) of the present invention was used in place of the Yellow Coupler ExY used in Sample 100 and the coating weights of all of the components used in the first layer were reduced to 70% of the coating weights of the components used in the first layer of Sample 100.

Further, Samples 401 to 408 were prepared in the same manner as in the preparation of Sample 102 except that Cyan Couplers C-1, C-3, C-19 or/and C-39 of the present invention and Yellow Coupler (1) or (2) of the present invention were used in combination as indicated in Table 4 below. These Samples 401 to 408 were processed in the same manner as that used in Example 1. Evaluation was made in the same manner as in Example 1.

The results obtained are shown in Table 4 below.

TABLE 4

| Light-Sensitive Material x Processing | Cyan Coupler | Yellow Coupler | Difference in Density Before and After Lapse of Time 430nm | 630 nm | Increase in Yellowing with Time 430 nm/630 nm |
|---|---|---|---|---|---|
| 100 10Z (Comp. Ex.) | ExC | ExY | 0.040 | 0.012 | 3.3 |
| 102 10A (Invention) | ExC | (2) | 0.023 | 0.010 | 2.3 |
| 401 10A (Invention) | C-1 | (2) | 0.021 | 0.011 | 1.9 |
| 402 10A (Invention) | C-1 | (1) | 0.021 | 0.009 | 2.3 |
| 403 10A (Invention) | C-3 | (2) | 0.019 | 0.010 | 1.9 |
| 404 10A (Invention) | C-3 | (1) | 0.020 | 0.010 | 2.0 |
| 405 10A (Invention) | C-19 | (2) | 0.021 | 0.011 | 1.9 |
| 406 10A (Invention) | C-19 | (1) | 0.019 | 0.010 | 1.9 |
| 407 10A (Invention) | C-39 | (2) | 0.019 | 0.012 | 1.6 |
| 408 10A (Invention) | C-39 | (1) | 0.020 | 0.009 | 2.2 |

It is apparent from the results in Table 4 above that the effect of the present invention is remarkable when the cyan coupler of the present invention is used in combination with the yellow coupler of the present invention.

It can be understood from the above disclosure that when the light-sensitive materials containing a pyrrolotriazole cyan coupler are processed with processing solutions containing a compound having sulfide group as a fixing agent, color reproducibility without turbidity can be achieved in a short processing period of time, and even when the light-sensitive materials are allowed to stand under high temperature and humidity conditions, prints of high quality which scarcely undergo a change in hue can be produced. Moreover, according to the present invention, ultra-rapid processing can be made.

While the invention has been described in detail and with reference to specific embodiments thereof, it will be apparent to one skilled in the art that various changes and modifications can be made therein without departing from the spirit and scope thereof.

What is claimed is:

1. A method for processing an imagewise exposed color photographic material comprising a support having on at least one surface thereof at least one layer containing a light-sensitive silver halide emulsion comprised of silver halide grains having a silver chloride content of at least 90% and a non-diffusing oil-soluble coupler capable of forming a dye by coupling with the oxidation product of an aromatic primary amine developing agent, wherein said color photographic material also contains at least one member selected from the group consisting of cyan couplers represented by the following general formulas (I) and (II) as said oil-soluble coupler

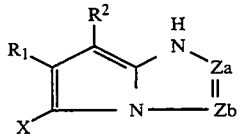

(I)

-continued

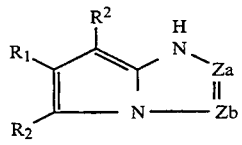

(II)

wherein Za and Zb each represents —C($R_3$)= or —N= provided that one of Za and Zb is —N= and the other is —C($R_3$)=; $R_1$ and $R_2$ each represents an electron attracting group having a Hammett's substituent constant $\sigma_p$ value of at least 0.20, and the sum of $\sigma_p$ values in $R_1$ and $R_2$ is at least 0.65; $R_3$ represents a hydrogen atom or a substituent; X represents a hydrogen atom or a group which is eliminated on coupling with the oxidation product of an aromatic primary amine color developing agent; and $R_1$, $R_2$, $R_3$ or X may be a bivalent group and the compound may be in the form of a dimer or a higher polymer through the bivalent group or may form a homopolymer or a copolymer wherein the compound is bonded to a high-molecular weight chain, wherein said processing comprises color developing said photographic material, then processing said material with a bath having a fixing agent, selected from the group consisting of nitrogen-containing compounds having a sulfide group, meso-ionic compounds and thioether compounds, and thereafter subjecting the material to a rinsing treatment with rinsing water or a stabilizing treatment with a stabilizing solution, and replenishing the rinsing water or stabilizing solution at a replenishment rate of not more than 150 ml/$m^2$ of the light sensitive material.

2. The method as in claim 1, wherein the processing comprises a drying stage after the rinsing or stabilizing treatment and the processing time of said color photographic material from commencement of color development to the drying stage is not longer than 120 seconds.

3. The method as in claim 2, wherein the processing comprises a drying stage after the rinsing or stabilizing treatment and the processing time of said color photographic material from commencement of color development to the drying stage is not longer than 120 seconds.

4. The method as in claim 1, wherein said cyan coupler is represented by the following general formula (I-a) or (I-b).

(I-a)

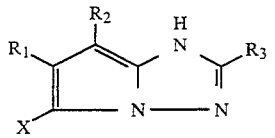

(I-b)

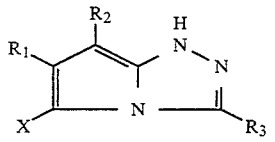

wherein $R_1$, $R_2$, $R_3$ and X are as defined in general formula (I).

5. The method as in claim 1, wherein said cyan coupler is represented by the following general formula (II-a) or (II-b).

(II-a)

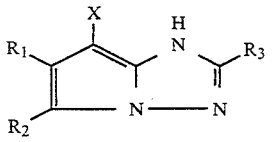

(II-b)

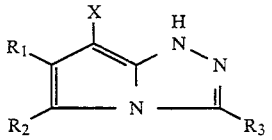

wherein $R_1$, $R_2$, $R_3$ and X are as defined in general formula (II).

6. The method as in claim 1, wherein $R_1$ and $R_2$ are each an electron attracting group having a Hammett's substituent constant up value of 0.20 to 1.0.

7. The method as in claim 6, wherein $R_1$ and $R_2$ are each an electron attracting group having a Hammett's substituent constant op value of 0.30 to 1.0.

8. The method as in claim 1, wherein the sum $\sigma p$ of values of $R_1$ and $R_2$ is within the range of 0.65 to 1.8.

9. The method as in claim 9, wherein the sum $\sigma p$ of values of $R_1$ and $R_2$ is within the range of 0.7 to 1.8.

10. The method as in claim 1, wherein said substituent represented by $R_3$ is selected from the group consisting of a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group.

11. The method as in claim 10, wherein $R_3$ is an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, or an azolyl group.

12. The method as in claim 12, wherein $R_3$ is an alkyl group or an aryl group.

13. The method as in claim 1, wherein said nitrogen-containing compound having a sulfide group is selected from the group consisting of

A-1.

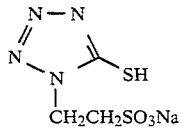

A-2.

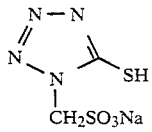

A-3.

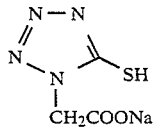

A-4.

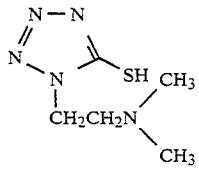

A-5.

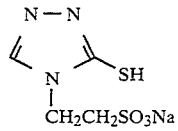

A-6.

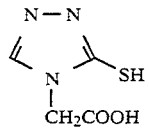

A-7.

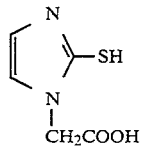

A-8.

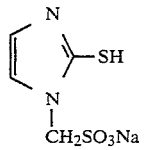

and

A-9.

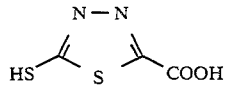

* * * * *